US005994019A

United States Patent [19]

Okado et al.

[11] Patent Number: 5,994,019

[45] Date of Patent: Nov. 30, 1999

[54] IMAGE FORMING METHOD

[75] Inventors: Kenji Okado, Yokohama; Toshiyuki Ugai, Tokyo; Ryoichi Fujita, Odawara; Kazumi Yoshizaki, Mishima, all of Japan

[73] Assignee: Canon Kabushiki Kaisha, Tokyo, Japan

[21] Appl. No.: 08/979,960

[22] Filed: Nov. 26, 1997

[30] Foreign Application Priority Data

| | | | |
|---|---|---|---|
| Nov. 26, 1996 | [JP] | Japan | 8-314323 |
| Jun. 13, 1997 | [JP] | Japan | 9-155628 |
| Oct. 23, 1997 | [JP] | Japan | 9-290774 |

[51] Int. Cl.[6] ..... G03G 9/083

[52] U.S. Cl. ..... 430/126; 430/106.6; 430/107; 430/111

[58] Field of Search ..... 430/126, 106.6, 430/107, 111; 399/174

[56] References Cited

U.S. PATENT DOCUMENTS

| | | | |
|---|---|---|---|
| 5,645,966 | 7/1997 | Koga | 430/126 |
| 5,724,632 | 3/1998 | Arahira et al. | 399/174 |
| 5,733,699 | 3/1998 | Asanae et al. | 430/106.6 |

FOREIGN PATENT DOCUMENTS

| | | |
|---|---|---|
| 61-57958 | 3/1986 | Japan . |
| 63-149669 | 6/1988 | Japan . |
| 2-33159 | 2/1990 | Japan . |
| 5-150539 | 6/1993 | Japan . |

OTHER PUBLICATIONS

Kagawa, et al., "Contact Changing Characteristic Using Conductive Roller", Japan Hardcopy '92 Papers, B–31, pp. 287–290, 1992.

*Primary Examiner*—Mark Chapman

*Attorney, Agent, or Firm*—Fitzpatrick, Cella, Harper & Scinto

[57] ABSTRACT

An image forming method is disclosed in which a contact charging means is brought into contact with a latent image bearing member to electrostatically charge the latent image bearing member on which electrostatic latent images are formed and developed with a one component type or two component type developer to form toner images, using a developing assembly provided with a developing container and a developer carrying member. The one component developer is comprised of toner particles. The two component type developer is comprised of toner particles and a magnetic carrier. The toner particles of the one component type and two component type developers contains fine particles as an external additive.

The latent image bearing member has a surface layer having a volume resistivity A of from $10^8$ to $10^{15}$ Ω·cm; the contact charging means comprises an assembly for electrostatically charging the latent image bearing member by applying a voltage to a charging member having a volume resistivity B of from $10^4$ to $10^9$ Ω·cm; the toner has, as an external additive, fine particles having a volume resistivity C of from $10^7$ to $10^{11}$ Ω·cm; the magnetic carrier has a volume resistivity D1 of from $10^9$ to $10^{15}$ Ω·cm; and the developer carrying member has a surface layer having a volume resistivity D2 of from $10^9$ to $10^{15}$ Ω·cm. The resistivities A, B, C, D1 and D2 stasisfy the following conditions: B<C<A<D1 or B<C<A<D2.

36 Claims, 5 Drawing Sheets

IMAGE FORMING METHOD

BACKGROUND OF THE INVENTION

1. Field of the Invention

This invention relates to an image forming method for forming and developing an electrostatic latent image in electrophotography or electrostatic printing. More particularly, this invention relates to an image forming method which comprises charging by the use of a contact charging means, forming an electrostatic latent image and developing the electrostatic latent image, in which injection charging performance and developing performance can be made stable over a long period of time.

2. Related Background Art

A number of methods are conventionally known as electrophotography. Copies are commonly obtained by forming an electrostatic latent image on a photosensitive member by a charging means and an image exposure means while utilizing a photoconductive material, subsequently developing the latent image with a toner to form a visible image (a toner image), transferring the toner image to a transfer-receiving medium such as paper, and thereafter fixing the toner image to the transfer-receiving medium by heat and/or pressure. Here, the toner not transferred to the transfer medium and remaining on the photosensitive member is removed through a cleaning step from the surface of the photosensitive member.

In recent years, various organic photoconductive materials have been brought out as photoconductive materials for electrophotographic photosensitive members. In particular, function-separated type ones in which a charge generation layer and a charge transport layer are laminated, have been put into practical use, and are mounted on copying machines, printers and facsimile machines. As charging means used in such electrophotographic apparatus, corona discharging has been utilized. Since, however, it causes ozone in a large quantity, the appratus must have a filter, and there have been such problems that the apparatus must be made large in size and the cost increases.

As techniques for solving such problems, charging methods have been proposed in which a charging member such as a roller or a blade is brought into contact with the surface of a photosensitive member so as to form a narrow space in the vicinity of the contact portion, and the discharge as can be explained by what is called the Paschen's law is formed so that the generation of ozone can be prevented as much as possible. In particular, a roller charging system making use of a charging roller as the charging member is preferably used in view of the stability of charging.

This charging is performed by causing discharge from the charging member to the member to be charged, and hence the charging takes place upon application of a voltage above a certain threshold voltage. For example, when a charging roller is brought into contact with a photosensitive member having an about 25 $\mu$m thick photosensitive layer and containing an organic photoconductive material, the surface potential of the photosensitive member begins to rise upon application of a voltage of about 640 V or above and, at voltages above that voltage, the photosensitive member surface potential linearly increases at a gradient 1 with respect to the applied voltage. This threshold voltage is hereinafter defined as charging start voltage Vth. Namely, in order to attain a photosensitive member surface potential Vd, an excessive DC voltage of Vd+Vth must be applied to the charging roller. In addition, since any environmental variations may change the resistivity of the charging roller, it has been difficult to control the potential of the photosensitive member to the desired value.

Accordingly, in order to uniform variable charging, as disclosed in Japanese Patent Application Laid-open No. 63-149669, a DC+AC charging system is employed in which a voltage formed by superimposing an AC voltage with a 2×Vth or higher peak-to-peak voltage on a DC voltage corresponding to the desired Vd. This is a system aiming at a potential-leveling effect which is attributable to AC, where the potential of the member to be charged converges at the Vd, the middle of the peak of AC voltage, and is hardly affected by external disturbance such as environmental variations.

Even in such contact charging methods, however, their fundamental charging mechanisms utilize the phenomenon of discharge from the charging member to the photosensitive member, and hence the voltage necessary for charging as stated above must be at a value over the surface potential of the photosensitive member. Moreover, the electric field of AC voltage may remarkably cause vibration and noise (hereinafter "AC charging noise") of the charging member and photosensitive member, and the discharge may remarkably cause deterioration of the surface of the photosensitive member. This involves another problem.

As disclosed in Japanese Patent Application Laid-open No. 61-57958, a charging method is known in which a photosensitive member having a conductive protective film is charged using conductive fine particles. This publication discloses that a photosensitive member having a semiconductive protective film having a resistance of from $10^7$ to $10^{13}$ Ω·cm is used and this photosensitive member is charged using conductive fine particles having a resistance of $10^{10}$ Ω·cm or below whereby the photosensitive member can be evenly and uniformly charged without injection of charges into the photosensitive layer, enabling good images to be reproduced. According to this method, the vibration and noise which has been a problem in AC charging can be prevented, but no sufficient charging efficiency can be achieved, and besides, since, e.g., the conductive fine particles serving as a charging member scrape off the transfer residual toner, the toner may adhere to the charging member and consequently a change in charging performance may occur as a result of many-sheet running.

As a charging method having a good charging efficiency, what is called injection charging is known, in which charges are directly injected into a photosensitive member.

This method, in which a voltage is applied to a contact charging member such as a charging roller, a charging fiber brush or a charging magnetic brush to inject charges into a trap level present on the photosensitive member surface, is disclosed in, e.g., Japan Hardcopy '92 Papers, p. 287, "Performance of Contact Charging Using Conductive Roller". In this method, charges are injected into a dark-portion insulating photosensitive member by means of a low-resistance charging member to which a voltage has been applied. This method has been conditioned on a sufficiently low resistance of the charging member and also on its surface to which a material providing the charging member with a conductivity is sufficiently laid bare. Hence, it is reported also in the above publication that aluminum foil or an ion-conductive charging member made to have a sufficiently low resistivity in a high humidity environment is preferable as the charging member. Studies made by the present inventors have revealed that the resistivity of charging members at which charges can be sufficiently injected into photosensitive members is $1\times10^3$ Ω·cm or below and, at a resistivity higher than that, a difference begins to occur between applied voltage and charge to cause a problem on the convergence of charge potential.

However, when the charging member having such a low resistivity is actually used, excess leak currents may flow from the charging member to scratches and pinholes produced on the photosensitive member surface to tend to cause faulty charging around them, expansion of the pinholes and electrification failure of the charging member.

To prevent such difficulties, it is necessary to make the charging member have a resistivity of about $1\times10^4$ Ω·cm or above. However, as stated previously, the charging member having this resistivity leads to such an inconsistency that the performance of charge injection into the photosensitive member may lower and sufficient charging cannot be effected.

Accordingly, with regard to contact type charging assemblies or image forming methods making use of such charging assemblies, it has been sought to solve the above problems, i.e., to simultaneously achieve conflicting performances of preventing the photosensitive member surface from pinhole leak which has not been able to be prevented in low-resistivity charging members and of performing sufficient charge injection.

As stated above, in the image forming method having the charging step making use of the charging member brought into contact with the photosensitive member, any faulty charging due to contamination of the charging member tends to cause faulty images and problems in running durability may arise. Thus, also in the charging carried out by injecting charges into the photosensitive member, it has been a pressing need for the realization of many-sheet printing to prevent the influence of the faulty charging due to contamination of the charging member.

Thus, the present inventors, as a result of extensive studies of the surface layers of latent image bearing members such as photosensitive members used when charged by charge injection and of contact charging members, have discovered that a sufficient charging performance can be attained when the contact charging member is made to have a volume resistivity (B) of from $10^4$ to $10^9$ Ω·cm and the surface layer of a latent image bearing member a volume resistivity (A) of from $10^8$ to $10^{15}$ Ω·cm, and such members are preferred.

However, it has been understood that the charge injection performance lowers and no satisfactory images can be formed when materials having a volume resistivity of $10^{14}$ Ω·cm or above such as silica used as what is called toner external additives are once taken into the contact charging member. This problem is serious especially in the case of cleanerless systems, in which no cleaning means for removing transfer residual toner is provided between the transfer zone and the charging zone.

It has also been understood that no satisfactory images can be formed because, when the surface layer of a latent image bearing member has a volume resistivity (B) of about $1\times10^8$ Ω·cm as stated above, electrostatic latent images formed on the latent image bearing member are disordered in the developing zone by rubbing friction with a two component type developer making use of an iron powder carrier or a commonly known ferrite carrier such as copper-zinc ferrite or nickel-zinc ferrite having a volume resistivity of from $1\times10^8$ to $1\times10^{10}$ Ω·cm.

SUMMARY OF THE INVENTION

An object of the present invention is to provide an image forming method having solved the problems as discussed above.

Another object of the present invention is to provide an image forming method that may cause no change in image density and no lowering of line reproducibility even in many-sheet continuous printing.

Still another object of the present invention is to provide an image forming method that can form images having sharp image characteristics and free of coarseness at halftone areas.

A further object of the present invention is to provide an image forming method promising a stable image density independent of environment and a fog-free, superior running stability.

A still further object of the present invention is to provide an image forming method that can achieve sharp image characteristics and a superior running stability.

To achieve the above objects, the present invention provides an image forming method comprising the steps of;

bringing a contact charging means into contact with a latent image bearing member for holding thereon an electrostatic latent image, to electrostatically charge the latent image bearing member;

forming an electrostatic latent image on the latent image bearing member thus charged; and using a developing assembly comprising a developing container holding therein a two component type developer having a toner with toner particles and a magnetic carrier and a developer carrying member for carrying thereon the two component type developer and transporting the developer to a developing zone, and developing in the developing zone the electrostatic latent image held on the latent image bearing member by the use of a toner of the two component type developer to form a toner image;

wherein;

the latent image bearing member has a surface layer having a volume-resistivity A of from $10^8$ to $10^{15}$ Ω·cm;

the contact charging means comprises an assembly for electrostatically charging the latent image bearing member by applying a voltage to a charging member having a volume resistivity B of from $10^4$ to $10^9$ Ω·cm;

the toner has, as an external additive, fine particles having a volume resistivity C of from $10^7$ to $10^{11}$ Ω·cm; and the magnetic carrier has a volume resistivity D1 of from $10^9$ to $10^{15}$ Ω·cm;

the volume resistivity A of the surface layer of the latent image bearing member, the volume resistivity B of the contact charging means, the volume resistivity C of the external additive of the toner and the volume resistivity D1 of the magnetic carrier satisfying the following relationship:

$$B<C<A<D1.$$

The present invention also provides an image forming method comprising the steps of;

bringing a contact charging means into contact with a latent image bearing member for holding thereon an electrostatic latent image, to electrostatically charging the latent image bearing member;

forming an electrostatic latent image on the latent image bearing member thus charged; and using a developing assembly comprising a developing container holding therein a one component type developer having toner particles and a developer carrying member for carrying thereon the one component type developer held in the developing container and transporting the developer to a developing zone, and developing in the developing zone the electrostatic latent image held on the latent image bearing member by bringing at least a developer layer formed of the one component type developer carried on the developer carrying member into contact with the surface of the latent image bearing member, to form a developer image;

wherein;

the latent image bearing member has a surface layer having a volume resistivity A of from $10^8$ to $10^{15}$ Ω·cm;

the contact charging means comprises an assembly for electrostatically charging the latent image bearing member by applying a voltage to a charging member having a volume resistivity B of from $10^4$ to $10^9$ Ω·cm;

the one component-type developer has, as an external additive, fine particles having a volume resistivity C of from $10^7$ to $10^{11}$ Ω·cm; and the developer carrying member has a surface layer having a volume resistivity D2 of from $10^9$ to $10^{15}$ Ω·cm;

the volume resistivity A of the surface layer of the latent image bearing member, the volume resistivity B of the contact charging means, the volume resistivity C of the external additive of the one component type developer and the volume resistivity D2 of the surface layer of the developer carrying member satisfying the following relationship:

$$B<C<A<D2.$$

DESCRIPTION OF THE PREFERRED EMBODIMENTS

Figure 1:
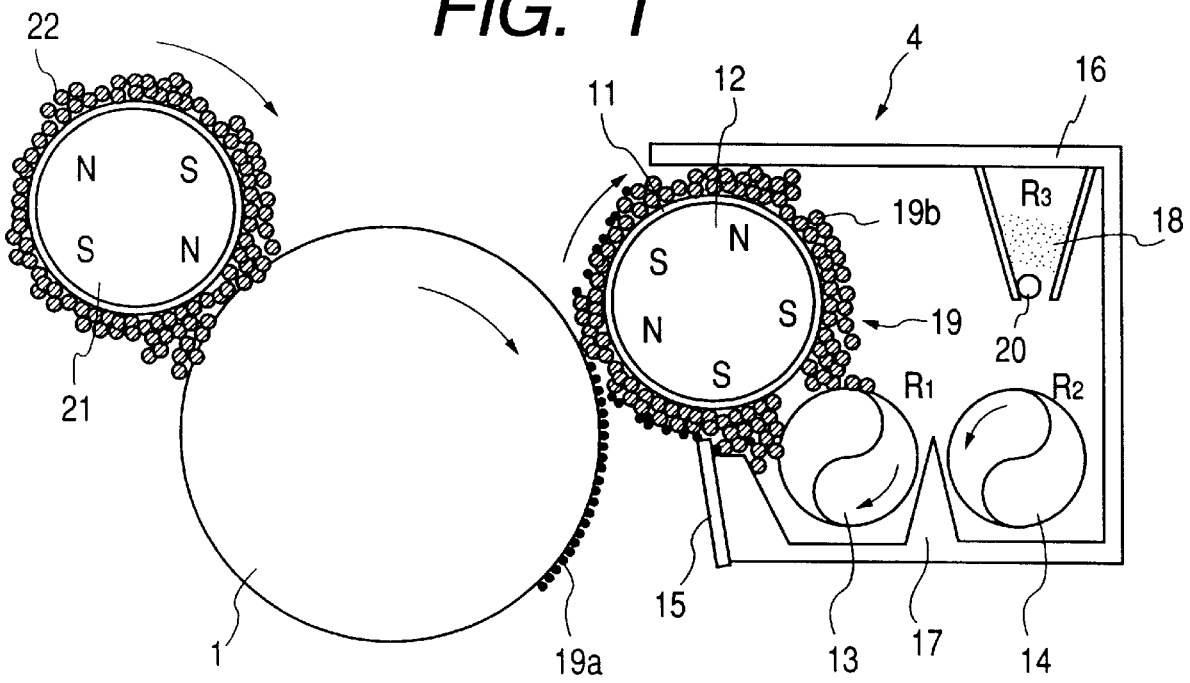
FIG. 1 schematically illustrates an image forming apparatus used in the image forming method of the present invention.

In the present invention, a charging member having a volume resistivity B of from $10^4$ to $10^9$ Ω·cm is brought into contact with a latent image bearing member having a surface layer having a volume resistivity A of from $10^8$ to $10^{15}$ Ω·cm, and the latent image bearing member is electrostatically charged by applying a voltage to this charging member. Accordingly, the surface layer of the latent image bearing member is controlled to have a relatively low resistivity so as to be readily injection-charged. In such an instance, if high-resistance fine particles such as fine silica particles or insulating resin particles conventionally preferably used are used alone or in the form of a mixture as an external additive constituting a toner, an external additive having a resistivity exceeding $10^{13}$ Ω·cm which is of the high-resistance fine particles may remain on the drum as a transfer residue, and this external additive is taken into the charging member, resulting in an increase in resistance of the charging member to cause a lowering of the performance of injection charging into the latent image bearing member.

In order not to cause an increase in resistance of the charging member, Japanese Patent Application Laid-open No. 5-150539, for example, discloses the addition of conductive particles for the purpose of preventing the charge of charging member from being inhibited. However, in the case when the latent image bearing member having a surface layer with a relatively low volume resistivity as in the present invention is used, the latent image formed on the latent image bearing member may be disordered in the developing zone, and consequently image deterioration such as unfocused images or a lowering of fine-line reproducibility may occur.

Hence, in the present invention; it is required to add at least one external additive having a volume resistivity C of from $10^7$ to $10^{11}$ Ω·cm and make the respective volume resistivities satisfy the relationship of B<C<A.

If the volume resistivity B is equal to the volume resistivity A or smaller than the volume resistivity A, discharge may become more predominant than injection in the charging to the latent image bearing member, resulting in a short lifetime of the latent image bearing member or accumulation of an electrical low-resistance product on the surface to tend to cause image deterioration such as smeared images or unfocused images.

If the volume resistivity C is equal to the volume resistivity B or smaller than the volume resistivity B, the electrostatic latent image formed on the latent image bearing member may be disordered by the low-resistance external additive as stated above.

The fine particles the external additive of the toner used in the present invention has may have a volume resistivity of from $10^7$ to $10^{11}$ Ω·cm, and preferably from $10^9$ to $10^{10}$ Ω·cm.

If the fine particles the external additive of the toner has have a volume resistivity lower than $10^7$ Ω·cm, the charge may greatly lower when the toner is left especially in an environment of high humidity, tending to cause toner scatter. If the fine particles the external additive of the toner has have a volume resistivity higher than $10^{11}$ Ω·cm, the toner may undergo charge-up especially in an environment of low humidity, tending to cause a decrease in image density.

The external additive used in the present invention may preferably be fine particles that fulfill the above conditions of volume resistivity and, in addition thereto, have an average dispersed-particle diameter of from 0.03 to 0.4 μm on toner particles. In particular, anatase type titanium oxide whose particle surfaces have been hydrophobic-treated (treated to be hydrophobic) is preferred because fluidity is imparted to toner, the charge is stabilized and the color is white.

As a hydrophobic-treating agent for such treatment, it may include, e.g., coupling agents such as silane coupling agents, titanium coupling agents and aluminum coupling agents, and oils such as fluorine type oils and various modified oils.

Of the above hydrophobic-treating agent, the coupling agents are particularly preferred in view of the stabilization of toner charging and the imparting of fluidity to toner.

Thus, the external additive used in the present invention may particularly preferably be anatase type fine titanium oxide particles surface-treated while hydrolyzing a coupling agent, which are very effective in view of the stabilization of toner charging and the imparting of fluidity to toner.

The above hydrophobic-treated fine particles (inorganic fine powder-) may preferably have a hydrophobicity of from 20 to 80%, and more preferably from 40 to 80%.

If the fine particles have a hydrophobicity smaller than 20%, the charge quantity may greatly decrease when the toner is left standing for a long period of time in an environment of high humidity, so that a mechanism for charge acceleration becomes necessary on the side of hardware, resulting in a complicated apparatus. If the fine particles have a hydrophobicity greater than 80%, it may be difficult to control the charging of the fine particles themselves, tending to result in charge-up of the toner in an environment of low humidity.

In view of the imparting of fluidity to toner and the prevention of liberation from toner particle surfaces, the hydrophobic-treated fine particles may preferably have an average dispersed-particle diameter of from 0.03 to 0.4 $\mu$m, and more preferably from 0.04 to 0.3 $\mu$m.

If the fine particles have an average dispersed-particle diameter smaller than 0.03 $\mu$m, it is difficult for them to come apart from the charging member surface, tending to cause scratches on the latent image bearing member as a result of their accumulation and problems such as melt adhesion.

If the fine particles have an average dispersed-particle diameter larger than 0.4 $\mu$m, the fluidity of toner is difficult to attain and the toner may be non-uniformly charged, so that toner scatter and fog tend to occur.

The above hydrophobic-treated fine particles may preferably have a light transmittance of 40% or more at a light wavelength of 400 nm.

Namely, the inorganic fine particles have a small primary particle diameter, but, when actually incorporated into the toner, they are not necessarily dispersed in the form of primary particles, and may sometimes be present in the form of secondary particles. Hence, whatever the primary particle diameter is small, the present invention may become less effective if the particles behaving as secondary particles has a large effective diameter. Nevertheless, those having a higher light transmittance at 400 nm which is the minimum wavelength in the visible region have a correspondingly smaller secondary particle diameter. Thus, good effects can be expected for the fluidity-imparting performance and the sharpness of projected images in OHP. The reason why 400 nm is selected is that it is a wavelength at a boundary region between ultraviolet and visible, and also it is said that light passes through particles with a diameter not larger than ½ of light wavelength. In view of these, any transmittance at wavelengths over 400 nm becomes higher as a matter of course and is not so meaningful.

In the present invention, the above fine particles may preferably be externally added in an amount of from 0.01 to 5 parts by weight, and more preferably from 0.03 to 2 parts by weight, based on 100 parts by weight of the toner particles, in view of the achievement of both of the control of charging and the improvement in fluidity and no inhibition of fixing performance.

In the present invention, the toner having the toner particles and the external additive or one component type developer may preferably have a weight average particle diameter of from 1 to 9 $\mu$m, and more preferably from 2 to 8 $\mu$m, in view of the achievement of both high image quality and high running performance.

If the toner or one component type developer has a weight average particle diameter smaller than 1 $\mu$m, its blending performance with the carrier may lower to tend to cause defects such as toner scatter and fog. If the toner or one component type developer has a weight average particle diameter larger than 9 $\mu$m, the reproducibility of fine-dot latent images may lower or toner scatter may occur at the time of transfer to obstruct the achievement of high image quality in some cases.

The charging member used in the present invention may have any forms as-exemplified by a conductive magnetic brush making use of conductive magnetic particles, a conductive fiber brush making use of conductive fibers or a conductive roller, so long as its part coming into contact with the latent image bearing member fulfills the conditions of the above volume resistivity. However, in order to apply the present invention to the cleanerless system, the conductive magnetic brush or the conductive fiber brush are preferred, and also, in order to stabilize the charge independent of the environment for a long period of time, the conductive magnetic brush is more preferred.

The conductive magnetic brush charging assembly preferably used in the present invention may comprise a non-magnetic sleeve, a magnet installed in the sleeve, and conductive magnetic particles magnetically bound onto the sleeve by the action of a magnetic force of the magnet.

The above charging magnetic particles may preferably have a weight average particle diameter of from 5 to 45 $\mu$m, preferably from 10 to 45 $\mu$m, and more preferably from 20 to 40 $\mu$m.

If the charging magnetic particles have a weight average particle diameter smaller than 5 $\mu$m, the charging performance may be good but the magnetic binding force may lower, so that the charging magnetic particles liberated from the conductive magnetic brush charging assembly may go to the developing step in such a state that they are adhered to the surface of the latent image bearing member, resulting in inclusion of the charging magnetic particles into the developing assembly to cause a disorder of electrostatic latent images at the time of development in some cases. If the charging magnetic particles have a weight average particle diameter larger than 45 $\mu$m, the brush ears formed of the charging magnetic particles may become coarse to tend to cause uneven charging and image deterioration.

The charging member used in the present invention may have a volume resistivity of from $10^7$ to $10^{11}$ $\Omega$·cm, and preferably from $10^7$ to less than $10^9$ $\Omega$·cm.

If the charging member have a volume resistivity lower than $10^7$ $\Omega$·cm, it may be difficult to prevent the magnetic particles serving as a charging member from adhering to the latent image bearing member. If the charging member have a volume resistivity higher than $10^{11}$ $\Omega$·cm, their charge-imparting performance to the latent image bearing member may lower especially in an environment of low humidity to tend to cause faulty charging.

The charging magnetic particles may also preferably be provided with surface layers on the core surfaces. Materials for such surface layers may include resins (preferably fluorine resins and silicone resins) containing coupling agents such as silane coupling agents and titanium coupling agents, conductive resins or conductive particles.

Charging magnetic particles not coated with resin and charging magnetic particles coated with resin may be used in combination. In such an instance, they may be mixed in a proportion not more than 50% by weight based on the total weight of magnetic particles in the charging assembly. This is because, if they are more than 50% by weight, the charging magnetic particles treated with the coupling agent may be less effective.

The weight loss on heating may preferably be 0.5% by weight or less, and more preferably 0.2% by weight or less.

Here, the weight loss on heating corresponds to a loss in weight at temperatures of from 150° C. to 800° C. in an nitrogen atmosphere in analysis using a thermobalance.

As previously stated, electrostatic latent images formed on the latent image bearing member are disordered when the ferrite carrier such as copper-zinc ferrite or nickel-zinc ferrite conventionally preferably used is used as a development carrier constituting the two component type developer used in the present invention. Hence, it is required for the development carrier to have a volume resistivity Dl of from $10^9$ to $10^{15}$ Ω·cm and to be A<D1 in the relation with the volume resistivity A of the surface layer of the latent image bearing member. If A>D1, the latent image potential may vary as a result of the rubbing friction with the development carrier, because, especially at the time of application of development bias, a voltage is applied and injected under the influence of the development bias, so that electrostatic latent images are disordered.

The development carrier used in the present invention may have a volume resistivity of from $10^9$ to $10^{15}$ Ω·cm, and preferably from more than $10^{13}$ to $10^{15}$ Ω·cm.

If the development carrier has a volume resistivity lower than $10^9$ Ω·cm, its resistance is so low that the development bias may be injected at the developing zone, resulting in the disorder of latent images. If the development carrier has a volume resistivity higher than $10^{15}$ Ω·cm, the carrier itself may undergo charge-up to tend to cause a lowering of the fluidity-imparting performance of the toner supplied.

Hence, as the development carrier used in the present invention, a resin-coated carrier whose carrier core surfaces have been coated with resin is preferred. As the carrier core, it is preferable to use a ferrite carrier core represented by the following Formula (I), or a magnetite-contain-ing polymerization resin carrier core produced by suspension polymerization. Formula (I)

$$(Fe_2O_3)_x(A)_y(B)_z \quad (I)$$

wherein A represents MgO, $Ag_2O$ or a mixture thereof; B represents $Li_2O$, MnO, CaO, SrO, $Al_2O_3$, $SiO_2$ or a mixture of any of these; and x, y and z each represent a weight ratio and fulfill the following conditions:

$0.2 \leqq x \leqq 0.95$;

$0.005 \leqq y \leqq 0.3$;

$0 < z \leqq 0.795$; and $x+y+z \leqq 1$.

The polymerization resin carrier core may preferably contain $Fe_3O_4$ and besides, as a metal oxide, $Fe_2O_3$, $Al_2O_3$, $SiO_2$, CaO, SrO, MgO or a mixture of any of these. The weight w of $Fe_3O_4$ may preferably be from 0.2 to 0.8 (weight ratio) based on the weight of the all oxides.

If x is less than 0.2 in the ferrite carrier core and the weight w of $Fe_3O_4$ is less than 0.2 in the polymerization resin carrier core, its magnetic properties may lower to tend to cause scatter of carrier or scratches on the photosensitive member surface. If x is more than 0.95 or w is more than 0.8, the resistance of the carrier is liable to be so low that the carrier core surfaces must be coated with a large amount of resin, tending to cause coalescence of carrier particles.

In the ferrite carrier core, if y is less than 0.005, proper magnetic properties is difficult to attain, and, if y is more than 0.3, the carrier particle surfaces can not be made homogeneous and spherical in some cases. In addition, if z is 0, i.e., the component B is not contained, particles with a sharp particle size distribution is difficult to obtain, and ultrafine powder of carrier may seriously cause scratches on the photosensitive member surface, or coalescence of particles at the time of firing to make it difficult to produce carriers. If z is more than 0.795, the magnetic properties may lower to seriously cause scatter of carrier.

As to the B in the formula (I), among $Li_2O$, MnO, CaO, SrO, $Al_2O_3$ and $SiO_2$, MnO, CaO, $SiO_2$ and $Al_2O_3$ are preferred in view of a small change in resistance at even the time of high-voltage application, and MnO and CaO are more preferred in view of better compatibility with the toner supplied.

As for the polymerization resin carrier core, its particle shape can be readily made spherical and a sharp particle size distribution can be achieved on account of its production process. Therefore, the polymerization resin carrier core is more advantageous with respect to the carrier adhesion to the photosensitive member even when made to have a smaller particle diameter than-the ferrite carrier core. Accordingly, the polymerization resin carrier core may have a 50% average particle diameter of from 10 to 45 μm, and preferably from 15 to 40 μm.

The metal oxide contained in the polymerization resin carrier core used in the present invention may preferably be treated to make lipophilic in order to prevent liberation of fine metal oxide particles. The metal oxide lipophilic-treated can be incorporated into the binder resin uniformly and in a high density when core particles are formed by dispersing it in binder resin. Especially when the carrier core particles are formed by polymerization, this is important in order to obtain spherical particles with smooth surfaces.

In such lipophilic treatment, the particle surfaces may be treated preferably with a coupling agent such as a silane coupling agent, a titanate coupling agent or an aluminum coupling agent, or a surface-active agent of various types.

In particular, it is preferable to carry out surface treatment with at least one selected from the group consisting of a silane coupling agent, a titanate coupling agent and a surface-active agent.

As the silane coupling agent, one having a hydrophobic group, an amino group or an epoxy group may be used. The silane coupling agent having a hydrophobic group may include, e.g., vinyltrichlorosilane, vinyltriethoxysilane and vinyltris(β-methoxy)silane. The silane coupling agent having an amino group may include
γ-aminopropyltrimethoxysilane,
γ-aminopropylmethoxydiethoxysilane,
γ-aminopropyltriethoxysilane,
N-β-(aminoethyl)-γ-aminopropyltrimethoxysilane,
N-β-(aminoethyl)-γ-aminopropylmethyldimethoxysilane and
N-phenyl-γ-aminopropyltrimethoxysilane. The silane coupling agent having an epoxy group may include
γ-glycidoxypropylmethyldiethoxysilane,
γ-glycidoxypropyltriethoxysilane and
β-(3,4-epoxycyclohexyl)trimethoxysilane.

The titanate coupling agent may include, e.g., isopropyltriisostearoyl titanate, isopropyltridodecylbenzenesulfonyl titanate and isopropyltris(dioctylpyrophosphate) titanate.

As the surface-active agent, commercially available surface-active agents may be used.

In the carrier used in the present invention, as the coat resin with which the carrier core surfaces are coated, a specific cross-linkable silicone resin or a copolymer of fluorine resin with acrylic resin may preferably be used. A cross-linkable silicone resin having a hydrolyzable reactive group and cceleratingly cured due to hydrolysis is particularly preferred.

Hitherto, it is proposed that a modified silicone resin is used to improve adhesion of magnetic carrier core particles. There are examples using a modified silicone resin such as an alkyd-modified, epoxy-modified, acryl-modified, polyester-modified, phenol-modified, melamine-modified or urethane-modified resin. These, however, tend to cause agglomeration of toner because of an increase in surface energy, and are not necessarily satisfactory in view of runnig durability of developers.

In order to improve adhesion while the surface energy is kept low, it is proposed that various additives are used in combination, as disclosed in Japanese Patent Application Laid-open No. 2-33159.

Such additives react with the silicone resin or with themselves to impart not only adhesion but also toughness. However, those disclosed in Japanese Patent Application Laid-open No. 2-33159 have certainly contributed to an improvement in the durability for coat resins, but can not necessarily be satisfactory in adhesion between the carrier core and the coat resin when coat layers are formed on carrier core surfaces in thin layers, and are sought to be more improved.

As a result of extensive studies made by the present inventors, they have discovered that, when in the carrier core a silicone resin having a hydrolyzable reactive group, preferably a cross-linkable silicone resin containing a curing agent represented by Formula (II) as shown below, and more preferably a cross-linkable silicone resin containing an aminosilane coupling agent and/or a polyisocyanate compound is used as the coat resin on the surface of the ferrite carrier core represented by Formula (I) as shown above and containing a metal oxide having a solubility of from 0.5 to 10 mg/100 ml, and preferably from 0.5 to 2 mg/100 ml, in 25° C. water, the water appropriately contained in the ferrite carrier core reacts with the hydrolyzable reactive group remaining in the silicone resin to accelerate the hydrolysis reaction, whereby good adhesion and charging performance can be achieved and a resin-coated carrier having a very high performance and long lifetime can be obtained.

Incorporation of the curing agent represented by Formula (II) is disclosed also in the Japanese Patent Application Laid-open No. 2-33159. In the present invention, however, it is important that the metal oxide having a specific solubility in water is incorporated in the polymerization resin carrier core in a specific quantity and the water contained in the ferrite carrier core is allowed to react with the cross-linkable silicone resin to accelerate the hydrolysis reaction, so that the resin-coated carrier more improved in the adhesion between the carrier core and the coat resin layer can be obtained. Thus, this is different from the above prior art.

The ferrite carrier core particles used in the present invention may contain MgO having a solubility of 0.62 mg/100 ml and $Ag_2O$ having a solubility of 1.74 mg/100 ml, and, in view of the resistance stability of the ferrite carrier core, may preferably contain at least MgO in an amount of from 0.5 to 30% by weight in terms of the oxide. These are preferable because the particles can be made to have homogeneous surfaces, can be made readily spherical and have an appropriate water content.

In respect of the polymerization resin carrier core, they have discovered that, when the binder resin of the carrier core contain a phenol resin, an affinity for the above cross-linkable silicone resin having a hydrolyzable reactive group and the adsorbed water present on the surface contribute to the acceleration of the hydrolysis reaction, whereby good adhesion and charging performance can be achieved and a resin-coated carrier having a very high performance and long lifetime can be obtained.

As the curing agent used in the present invention, an oxime type curing agent is suitable which is represented by the following Formula (II).

(II)

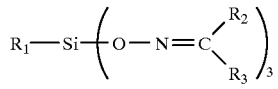

wherein $R_1$ represents a substituent selected from the group consisting of $CH_3$, $C_2H_5$ and

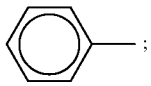

and $R_2$ and $R_3$ each represent a substituent selected from the group consisting of $CH_3$, $C_2H_5$ and derivatives thereof. More specifically, the oxime type curing agent is very superior in view of the appropriate control of the hydrolyzable reactive group remaining in the silicone resin, storage stability, and cost.

As coupling agents having a high reactivity, an acetic acid type (acetoxysilane) and an acetone type (propenoxysilane) are known. However, it has been found to be very difficult to set conditions for achieving the stable reaction with the silicone resin and for making the hydrolyzable reactive group appropriately remain, resulting in a poor production stability. Thus, these are not preferable in the present invention.

The curing agent used in the present invention may specifically include the following (1) to (4).

(1)

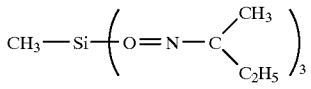

(2)

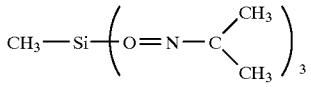

(3)

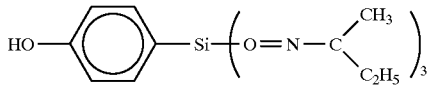

(4)

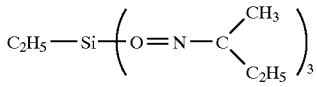

The above curing agent may preferably be added in an amount of from 0.1 to 10 parts by weight, and more preferably from 0.5 to 5 parts by weight, based on 100 parts by weight of siloxane solid content. If it is less than 0.1 part by weight, sufficient cross-linking effect cannot be attained. If it is more than 10 parts by weight, the residue cannot be well removed or compounds insufficiently reacted may remain to cause a lowering of charging performance and coat strength. In the present invention, the siloxane solid content indicates a non-volatile component at 120° C.

In the present invention, the aminosilane coupling agent that may be contained in the cross-linkable silicone resin used as the coat resin may include those shown in the following (5) to (14).

(5)

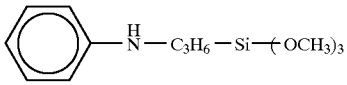

(6)

$H_5C_2—\overset{H}{N}—C_3H_6—Si—(OCH_3)_3$ (7)

$H_2N—C_3H_6—Si—(OCH_3)_3$ (8)

$H_2N—C_2H_4—\overset{H}{N}—C_3H_6—Si—(OCH_3)_3$ (9)

$H_9C_4—\overset{H}{N}—C_3H_6—Si—(OCH_3)_3$ (10)

$H_2N—C_2H_4—NH—C_3H_6—Si(CH_3)—(OCH_3)_2$ (11)

$(CH_3)_2—N—C_3H_6—Si—(OCH_3)_3$ (12)

$(C_2H_5)_2—N—C_3H_6—Si—(OCH_3)_3$ (13)

$(C_4H_9)_2—N—C_3H_6—Si—(OCH_3)_3$ (14)

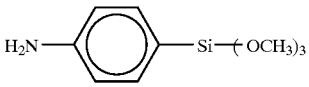

Any of these may be used alone or in a combination of two or more. Of these, preferably used in the present invention in view of compatibility, reactivity and stability are the following coupling agents having at least one nitrogen atom having one hydrogen atom.

(5)

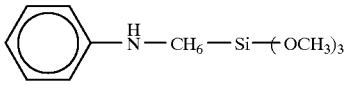

(6)

$H_5C_2—\overset{H}{N}—C_3H_6—Si—(OCH_3)_3$ (8)

$H_2N—C_2H_4—\overset{H}{N}—C_3H_6—Si—(OCH_3)_3$ (9)

$H_9C_4—\overset{H}{N}—C_3H_6—Si—(OCH_3)_3$ (10)

$H_2N—C_2H_4—NH—C_3H_6—Si(CH_3)—(OCH_3)_2$

The above coupling agent may preferably be added in an amount of from 0.1 to 8 parts by weight, and more preferably from 0.3 to 5 parts by weight, based on 100 parts by weight of siloxane solid content.

If the coupling agent is added in an amount less than 0.1 part by weight, its addition can not be well effective to tend to cause deterioration of charging performance and a lowering of coat strength. If the coupling agent is added in an amount more than 8 parts by weight, the reaction can not be sufficiently carried out, resulting in a lowering of coat strength.

In the present invention, as the coupling agent, a coupling agent represented by the following Formula (III) may be used alone or in combination.

$$R_4—Si—X_v \quad \text{(III)}$$

wherein $R_4$ represents a substituent selected from the group consisting of an alkyl group having 1 to 12 carbon atoms, a vinyl group, a methacrylic group, an epoxy group, an amino group, a mercapto group and derivatives thereof; X represents a halogen atom or an alkoxyl group; and v represents an integer of 1 to 3.

Such a coupling agent may include those represented by the following (15) to (18).

$$CH_2=CH—Si—(OCH_3)_3 \quad (15)$$

$$CH_3—Si—(OCH) \quad (16)$$

$$CH_3—Si—(OCH_5)_3 \quad (17)$$

$$C_3H_7—Si—(OCH_3)_3 \quad (18)$$

In the present invention, the silicone resin may preferably be a resin having a siloxane bond in the backbone chain.

As methods for forming the resin coat layer on the carrier core particle surfaces using the coat resin, any of the following may be used: A method in which a resin composition is dissolved in a suitable solvent and carrier core particles are immersed in the resultant solution, followed by desolvation, drying and high-temperature baking; a method in which carrier core particle are suspended in a fluidized system and a solution prepared by dissolving the above resin composition is spray-coated, followed by drying and high-temperature baking; and a method in which carrier core particle are mixed with a powder or aqueous emulsion of the resin composition.

A method preferably used in the present invention is a method making use of a mixed solvent prepared by incorporating 0.1 to 5 parts by weight, and preferably 0.3 to 3 parts by weight, of water in 100 parts by weight of a solvent containing at least 5% by weight, and preferably at least 20% by weight, of a polar solvent such as a ketone or an alcohol. This method is preferred because the reactive silicone resin can be firmly made to adhere to the magnetic carrier core particles. If the water is less than 0.1 part by weight, the hydrolysis reaction of the reactive silicone resin can not be well take place to make it difficult to achieve thin-layer and uniform coating on the magnetic carrier core particles. If it is more than 5 parts by weight, the reaction is difficult to control, resulting in a lowering of coat strength.

The development carrier used in the present invention may also preferably have a 50% average particle diameter (median diameter) of from 20 to 50 $\mu$m, and more preferably from 20 to 45 $\mu$m, in view of the uniformity of solid images and reproducibility of fine dots. In the present invention, the 50% average particle diameter refers to the volume-based median cumulative value (50%).

If the development carrier has a 50% average particle diameter larger than 50 $\mu$m, the uniformity of solid images and reproducibility of fine dots is liable to lower. If the development carrier has a 50% average particle diameter smaller than 20 $\mu$m, the development carrier tends to adhere to the photosensitive member and scratches or the like may occur on the photosensitive member to cause an image deterioration.

In the present invention, in order to more enhance the effect of good developing performance, the development carrier may also preferably have an apparent density of from 1.2 to 3.2 g/cm$^2$, and more preferably from 1.5 to 2.8 g/cm$^2$.

If the development carrier has an apparent density smaller than the lower limit of the above range, the carrier adhesion tends to occur. If the development carrier has an apparent density greater than the upper limit of the above range, the two component type developer may be not well circulated to not only tend to cause toner scatter but also accelerate image deterioration.

The development carrier used in the present invention may also have magnetic properties of a saturation magnetization of from 20 to 65 Am$^2$/kg, and preferably from 20 to 45 Am$^2$/kg in order for the toner and carrier to be well transported to and carried on the developing sleeve. This is preferable in view of the solid image uniformity and fine-line reproducibility because the density of the development carrier in the ears of the magnetic brush formed by the development magnetic carrier can be made higher.

If the development carrier has a saturation magnetization lower than 20 Am$^2$/kg, the carrier tends to adhere to the latent image bearing member. If the development carrier has a saturation magnetization higher than 65 Am$^2$/kg, the rise of ears may come into a firmly tight state to cause a lowering of gradation or halftone reproduction.

In view of the developing performance, the development carrier may preferably have a 50% average particle diameter of from 20 to 50 $\mu$m as described above. However, the development carrier having such a small particle diameter, when used in the image forming method making use of the latent image bearing member having the surface layer with a low volume resistivity as used in the present invention, tends to disorder the electrostatic latent images formed on the latent image bearing member at the time of development. The reasons are as follows.

That is, this is because, as the development carrier has a smaller particle diameter, the ears of the magnetic brush formed by this development carrier becomes denser, and the points at which the magnetic brush comes in contact with the surface of the latent image bearing member increase, so that the phenomenon of charge injection into the surface of the latent image bearing member tends to occur when the development bias is applied to the developing sleeve at the time of development.

In view of developing performance, the development carrier may preferably have a saturation magnetization of from 20 to 45 Am$^2$/kg as also described above. However, the development carrier having such magnetic properties may cause an increase in the density of the development carrier in the ears of the magnetic brush formed by the development carrier, and the points at which the magnetic brush comes in contact with the surface of the latent image bearing member increase. Thus, due to the same reason as the above, it tends to disorder the electrostatic latent image formed on the latent image bearing member at the time of development.

However, since in the present invention the volume resistivity D1 of the development magnetic carrier and the volume resistivity A of the surface layer of the latent image bearing member fulfill the conditions of A<D1, it is possible to control the phenomenon of charge injection into the surface of the latent image bearing member at the time of development, and hence it has become possible to use the carrier having the above specific 50% average particle diameter and specific magnetic properties.

In the present invention, the development magnetic carrier may preferably have an impedance of from $9\times10^7$ to $1\times10^{10}$ Ω·cm, and more preferably from $1\times10^8$ to $3\times10^9$ Ω·cm. This is preferable because the phenomenon of charge injection into the surface of the latent image bearing member at the time of development can be better controlled.

If the development carrier has an impedance lower than $9\times10^7$ Ω·cm, the electrostatic latent image on the photosensitive member used in the present invention may be disordered as a result of rubbing friction with the development carrier at the time of development, and may be attenuated to cause a lowering of image quality.

In order to improve the uniformity of the impedance on the carrier particle surfaces, it is particularly preferable for the ferrite carrier to contain MgO in an appropriate quantity and for the polymerization carrier to contain $Fe_2O_3$ in an appropriate quantity.

In the present invention, in the case where the carrier is blended with the toner to prepare the two component type developer, good results are usually obtained when they are blended in such a proportion that the toner in the two component type developer is in a concentration of from 1 to 15% by weight, preferably from 3 to 12% by weight, and more preferably from 5 to 10% by weight.

If the toner concentration is less than 1% by weight, the image density tends to lower. If the toner concentration is more than 15% by weight, fog and in-machine scatter may increase to shorten the running lifetime of the two component type developer.

In the present invention, when images are formed by using the one component type developer, the developer carrying member is made to have the function of the carrier described above.

More specifically, a contact development system in which a developer layer of a one component type developer carried on the developer carrying member is brought into contact with the surface of the latent image bearing member is used to develop an electrostatic latent image, where the developer carrying member is required to have a surface layer with a volume resistivity D2 of from $10^9$ to $10^{15}$ Ω·cm and satisfying A<D2. If A>D2, the electrostatic latent image may be disordered for the same reasons as the rubbing friction of the development carrier described above.

The developer carrying member used in the present invention has a surface layer with volume resistivity of from $10^9$ to $10^{15}$ Ω·cm and preferably from $10^{13}$ to $10^{15}$ Ω·cm.

If the developer carrying member has a surface layer with a volume resistivity lower than $10^9$ Ω·cm, its resistance is so low that the development bias may be injected at the developing zone to cause disorder of latent images. If the developer carrying member has a surface layer with a volume resistivity higher than $10^{15}$ Ω·cm, the toner may have an extremely poor developing performance to tend to cause uneven image density.

Figure 7:
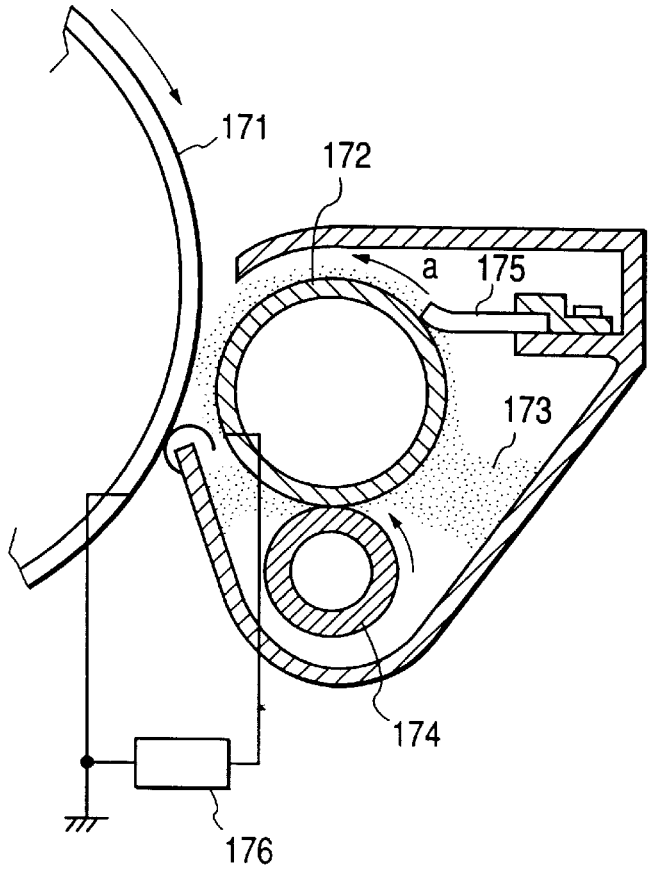
FIG. 7 schematically illustrates a developing assembly used when non-magnetic one component type development is performed.

The contact development system will be described below in more detail. FIG. 7 shows an example of a developing assembly used when non-magnetic one component type development is performed using the toner used in the present invention. The example is by no means limited to this. Reference numeral 171 denotes a latent image bearing member. The electrostatic latent image is formed by an electrophotographic processing means or electrostatic recording means (not shown). Reference numeral 172 denotes a developer carrying member, which may preferably comprise an elastic rubber sleeve formed of silicone rubber, urethane rubber, styrene-butadiene rubber or polyamide resin. In the present invention, in order to provide a preferable volume resistivity as the occasion demands, an organic resin may be incorporated or organic fine particles or inorganic fine particles may be dispersed therein.

A non-magnetic one component type developer is reserved in a hopper 173 and is fed onto the developer carrying member 172 by a feed roller 174. The feed roller 174 also scrapes off the non-magnetic one component type developer remaining on the developer carrying member after development. The non-magnetic one component type developer fed onto the developer carrying member is coated thereon by a developer coating blade 175 in a uniform and thin layer. It is effective for the developer coating blade to be brought into touch with the developer carrying member at a pressure of 3 to 250 g/cm, and preferably from 10 to 120 g/cm, as a linear pressure in the sleeve generatrix direction.

If the touch pressure is smaller than 3 g/cm, it is difficult to uniformly coat the non-magnetic one component type developer, resulting in a broad charge quantity distribution of the non-magnetic one component type developer to cause fog or black spots around line images. If the touch pressure is greater than 250 g/cm, a great pressure is applied to the non-magnetic one component type developer to tend to cause agglomeration between toner particles or pulverization, and such a pressure is not preferable.

Controlling the touch pressure at 3 to 250 g/cm makes it possible to well loosen agglomerates peculiar to toners with small particle diameters, and enables the charge quantity of the non-magnetic one component type developer to instantaneously rise.

The developer coating blade may be made of a material of triboelectric series suited for electrostatically charging the non-magnetic one component type developer to the desired polarity.

In the present invention, the developer coating blade may preferably be made of silicone rubber, urethane rubber or styrene-butadiene rubber. Its surface may also be coated with a polyamide resin. The use of a conductive rubber is preferred because the non-magnetic one component type developer can be prevented from being charged in excess.

In the present invention, it is particularly preferred to use a cleanerless system, which is carried out by applying a development bias while bringing the developer into contact with the latent image bearing member, in order to well collect in the developing zone the non-magnetic one component type developer remaining after transfer so as to be reused. In such an instance, as the development bias, only a direct-current electric field may be applied or optionally an alternating electric field may be superimposed thereon.

The two component type developer used in the present invention is constituted of the carrier previously described and a toner.

The toner used in the present invention may be constituted as described below.

The toner used in the present invention has toner particles and the external additive previously described.

As a binder resin used in the toner of the present invention, various resins can be used.

For example, it may include polystyrene, styrene copolymers such as a styrene-butadiene copolymer and a styrene-acrylate copolymer, polyethylene, ethylene copolymers such as an ethylene-vinyl acetate copolymer and an ethylene-vinyl alcohol copolymer, phenol resins, epoxy resins, acrylphthalate resins, polyamide resins, polyester resins, and maleic acid resins. Regarding all the resins, there are no particular limitations on their preparation process.

As a colorant contained in the toner particles in the present invention, it may include known dyes and pigments as exemplified by Phthalocyanine Blue, Indanthrene Blue, Peacock Blue Lake, Permanent Red, Lake Red, Rhodamine Lake, Hanza Yellow, Permanent Yellow and Benzidine Yellow, any of which may be used.

The colorant may be contained in an amount not more than 12 parts by weight, and preferably from 2 to 10 parts by weight, based on 100 parts by weight of the toner, taking account of the sensitivity to the light transmission properties of OHP films.

The toner used in the present invention may be optionally mixed with additives so long as the properties of the toner are not deteriorated. Such additives may include, e.g., lubricants such as Teflon, zinc stearate and polyvinylidene fluoride; fixing auxiliaries as exemplified by a low-molecular weight polyethylene and a low-molecular weight polypropylene; and transfer auxiliaries such as silica particles, silicone resin particles, alumina particles and organic resin particles.

In preparing the toner used in the present invention, it is possible to apply a method in which component materials are well kneaded by means of a heat-kneading machine such as a heat roll, a kneader or an extruder, followed by pulverization by a mechanical means and then classification to obtain a toner; a method in which materials such as colorants are dispersed in a binder resin solution, followed by spray drying to obtain a toner; and a method of preparing toner particles by polymerization, which comprises mixing given materials with polymerizable monomers capable of constituting a binder resin, and thereafter subjecting a suspension of the resultant mixture to polymerization.

In particular, the toner particles may preferably be produced by the polymerization toner production process in view of such advantages that toner particles have a particle diameter close to one feasible of achieving a high transfer efficiency required when the cleanerless system is used and free shells containing no colorant may hardly be formed.

In the present invention, when the toner particles are directly produced by polymerization, a polymerization initiator is used, which may include, e.g., azo or diazo type polymerization initiators such as 2,2'-azobis-(2,4-dimethylvaleronitrile), 2,2'-azobisisobutyronitrile), 1,1'-azobis-(cyclohexane-1-carbonitrile), 2,2'-azobis-4-methoxy-2,4-dimethylvaleronitrile and azobisisobutyronitrile; and peroxide type polymerization initiators such as benzoyl peroxide, methyl ethyl ketone peroxide, diisopropylperoxy carbonate, cumene hydroperoxide, 2,4-dichlorobenzoyl peroxide and lauroyl peroxide.

The polymerization initiator may preferably be added in an amount of from 0.5 to 20% by weight based on the weight of the monomers, which amount may vary depending on the intended degree of polymerization.

The types of the polymerization initiators may a little differ depending on the polymerization method, and may be used alone or in combination, making reference to the 10-hour half-life period temperature.

To control the polymerization degree, any known cross-linking agent, chain transfer agent and polymerization inhibitor may be further added.

In the present invention, when suspension polymerization is used as a production process for the toner particles, an inorganic oxide or organic compound may be used as a dispersant by dispersing it in an aqueous phase.

The inorganic oxide may include, e.g., tricalcium phosphate, hydroxyapatite, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, alumina, magnetic materials and ferrite.

The organic compound may include, e.g., polyvinyl alcohol, gelatin, methyl cellulose, methyl hydroxypropyl cellulose, ethyl cellulose, carboxymethyl cellulose sodium salt, and starch.

Any of these dispersants may preferably be used in an amount of from 0.2 part to 20 parts by weight based on 100 parts by weight of polymerizable monomers.

As these dispersants, those commercially available may be used as they are. In order to obtain dispersion particles having fine and uniform particle size, particles of the inorganic dispersant may be formed in a dispersion medium with high-speed stirring. For example, in the case of tricalcium phosphate, an aqueous sodium phosphate solution and an aqueous calcium chloride solution may be mixed with high-speed stirring, whereby the dispersant preferable for the suspension polymerization can be obtained.

In order to make these dispersants finer, 0.001 to 0.1% by weight of a surface-active agent may be used in combination. Specifically, commercially available nonionic, anionic or cationic surface-active agents may be used. For example, preferred are the use of sodium dodecylsulfate, sodium tetradecylsulfate, sodium pentadecylsulfate, sodium octylsulfate, sodium oleate, sodium laurate, potassium stearate or calcium oleate.

When the direct polymerization is employed as the production process for the toner particles, the toner particles can be specifically produced by a production process as described below.

A monomer composition comprising polymerizable monomers and a colorant added therein, a charge control agent, a polymerization initiator and other additives, which are uniformly dissolved or dispersed by means of a dispersion machine such as a homogenizer or an ultrasonic dispersion machine, is dispersed in an aqueous medium containing a dispersion stabilizer, by means of a dispersion machine such as a conventional stirrer, homomixer or homogenizer. Granulation is carried out preferably while controlling stirring conditions such as stirring speed and stirring time so that droplets comprised of the monomer composition can have the desired toner particle size. After the granulation, stirring may be carried out to such an extent that the state of particles is maintained and the particles can be prevented from settling, by the acton of the dispersion stabilizer. The polymerization may be carried out at a polymerization temperature set at 40° C. or above, usually from 50 to 90° C. At the latter half of the polymerization reaction, the temperature may be elevated, and the aqueous medium may be removed in part at the latter half of the reaction or after the reaction has been completed, in order to remove unreacted polymerizable monomers, by-products and so forth, for the purpose of improving the running durability in the image forming method of the present invention. After the reaction has been completed, the toner particles formed are collected by washing and filtration, followed by drying. In the case of suspension polymerization, water may preferably be used as the dispersion medium usually in an amount of from 300 to 3,000 parts by weight based on 100 parts by weight of the monomer composition.

In the present invention, as the toner used in the image forming method having the cleanerless system, it is preferred that the toner particles have a shape close to a sphere. Specifically, the toner particles may have shape factors SF-1 within the range of from 100 to 150, preferably from 100 to 140, and more preferably from 100 to 130, and SF-2 within the range of from 100 to 140, preferably from 100 to 130, and more preferably from 100 to 120.

This spherical magnetic toner may more preferably have a shape factor SF-1 within the range of from 100 to 145, and SF-2, from 100 to 125.

If the toner particles has a shape factor SF-1 of more than 150 or SF-2 of more than 140, the transfer efficiency of toner may lower, the rate of re-transfer of toner may increase and the wear of the latent image bearing member surface may increase, undesirably.

The SF-1 and SF-2 each indicating the shape factor of the toner particles used in the present invention are values obtained by sampling at random 100 toner particle images magnified 3,000 times by the use of FE-SEM (S-800; an electron scanning microscope manufactured by Hitachi Ltd.), introducing their image informations in an image analyzer (LUSEX-3) manufactured by Nikore Co. through an interface to carry out analysis, and calculating the data according to the following expression.

$$SF\text{-}1=(MXLNG)_2/AREA\times\pi/4\times100$$

$$SF\text{-}2=(PERI)_2/AREA\times\tfrac{1}{4}\pi\times100$$

(AREA: projected area of toner particle; MXLNG: absolute maximum length; PERI: peripheral length)

The shape factor SF-1 of the toner indicates the degree of sphericity; as the value is greater than 100, the toner particles become gradually more amorphous (shapeless). SF-2 indicates the degree of irregularity; as the value is greater than 100, the toner particle surfaces become remarkably more irregular.

An example of preferred embodiments of the latent image bearing member (photosensitive member drum 90) used in the present invention will be described below with reference to FIG. 5.

It basically comprises a conductive substrate 91, and a photosensitive layer 92 functionally separated into a charge generation layer and a charge transport layer.

As the conductive substrate 91, a cylindrical member or a belt is used. This conductive substrate is formed of a metal such as aluminum or stainless steel, an alloy such as aluminum alloy or an indium oxide-tin oxide alloy, or a plastic having a coat layer formed of any of these metals and alloys, a paper or plastic impregnated with conductive particles or a plastic having a conductive polymer.

On the conductive substrate 91, a subbing layer may be provided for the purposes of, e.g., improving adhesion of the photosensitive layer 92, improving coating properties, protecting the substrate, covering defects on the substrate, improving properties of charge injection from the substrate 91 and protecting the photosensitive layer 92 from electrical breakdown.

The subbing layer may be formed of polyvinyl alcohol, poly-N-vinyl imidazole, polyethylene oxide, ethyl cellulose, methyl cellulose, nitrocellulose, an ethylene-acrylate copolymer, polyvinyl butyral, phenol resin, casein, polyamide, copolymer nylon, glue, gelatin, polyurethane or aluminum oxide. The subbing layer may usually be in a thickness approximately of from 0.1 to 10 $\mu$m, and preferably from 0.1 to 3 $\mu$m.

The charge generation layer may be formed by applying a fluid prepared by dispersing a charge-generating material in a charge generation layer binder resin, or by vacuum deposition of the charge-generating material. The charge-generating material includes, for example, azo pigments, phthalocyanine pigments, indigo pigments, perylene pigments, polycyclic quinone pigments, squarilium dyes, pyrylium salts, thiopyrylium salts, triphenylmethane dyes, and inorganic substances such as selenium and amorphous silicon.

As the charge generation layer binder resin, it can be selected from a vast range of binder resins, including, e.g., polycarbonate resins, polyester resins, polyvinyl butyral resins, polystyrene resins, acrylic resins, methacrylic resins, phenol resins, silicone resins, epoxy resin and vinyl acetate resins.

The binder resin contained in the charge generation layer may be in an amount not more than 80% by weight, and preferably from 0 to 40% by weight. The charge generation layer may preferably have a thickness of 5 $\mu$m or smaller, and particularly from 0.05 to 2 $\mu$m.

The charge transport layer has the function to receive charge carriers from the charge generation layer in the presence of an electric field, and transport them. The charge transport layer is formed by applying a solution prepared by dissolving a charge-transporting material in a solvent optionally together with a charge transport layer binder resin, and usually may preferably have a layer thickness of from 5 to 40 $\mu$m. The charge-transporting material may include polycyclic aromatic compounds having in its main chain or side chain a structure such as biphenylene, anthracene, pyrene or phenanthrene; nitrogen-containing cyclic compounds such as indole, carbazole, oxadiazole and pyrazoline; hydrozone compounds; styryl compounds; and inorganic compounds such as selenium, selenium-tellurium, amorphous silicon and cadmium sulfide.

The charge transport layer binder resin used to disperse the charge-transporting material therein may include polycarbonate resins, polyester resins, polymethacrylates, polystyrene resins, acrylic resins, polyamide resins, and organic photoconductive polymers such as poly-N-vinyl carbazole and polyvinyl anthracene.

The photosensitive member (latent image bearing member) used in the present invention has a charge injection layer 93 as a layer most distant from the support, i,e, as a surface layer 92. This charge injection layer 93 may have a volume resistivity of from $1\times10^{8}$ Ω·cm to $1\times10^{15}$ Ω·cm, and preferably from $1\times10^{8}$ Ω·cm to $1\times10^{14}$ Ω·cm, in order to obtain a satisfactory charging performance and to barely cause smeared images. Especially in view of the smeared images, it may more preferably be from $1\times10^{10}$ Ω·cm to $1\times10^{15}$ Ω·cm, and still more preferably from $1\times10^{10}$ Ω·cm to $1\times10^{14}$ Ω·cm. Further taking account of environmental variations and so forth, it may most preferably be from $1\times10^{10}$ Ω·cm to $1\times10^{13}$ Ω·cm. If it is lower than $1\times10^{8}$ Ω·cm, the charges produced may not be retained in the surface direction in an environment of high humidity, tending to cause smeared images. If it is higher than $1\times10^{15}$ Ω·cm, the charges injected from the charging member may not be well retained, tending to cause faulty charging.

When such a functional layer is provided on the photosensitive member surface, the layer has the function of retaining the charges injected from the charging member, and also has the function of allowing the charges to transfer to the photosensitive member support to make the residual potential lower.

In the present invention, the use of the above specific charging member and the above specific photosensitive member in combination has enabled the charge start voltage Vth to be small and the charge potential of the photosensitive member to converge on about 90% or more of the voltage applied to the charging member.

For example, when a DC voltage of 100 to 2,000 V as an absolute value is applied to the charging member at a process speed of 1,000 mm/minute or below, the charge potential of the electrophotographic photosensitive member having the charge injection layer of the present invention can be controlled to be 80% or more or further 90% or more of the applied voltage. On the other hand, the photosensitive member charge potential attained by conventional discharging has been about 200 V which is only about 30%, when the applied voltage is a DC voltage of 700 V.

This charge injection layer 93 is constituted of an inorganic layer of a metal-deposited film, or a conductive fine particle-dispersed resin layer formed by dispersing conductive fine particles in a charge injection layer binder resin. The deposited film is formed by vacuum deposition, and the conductive fine particle-dispersed resin layer is formed by using a suitable coating process such as dip coating, spray coating, roll coating or beam coating. This layer may also be constituted by mixing or copolymerizing an insulating binder resin with a resin having light-transmission properties and a high ion conductivity, or may be constituted solely of a resin having a medium resistance and a photoconductivity.

In the case of the conductive fine particle-dispersed resin layer, the conductive fine particles may preferably be added in an amount of 2 to 190% by weight based on the weight of the charge injection layer binder resin.

If the conductive fine particles are added in an amount less than 2% by weight, the desired volume resistivity may be difficult to attain. If the conductive fine particles are added in an amount more than 190% by weight, the film strength may lower and the charge injection layer is liable to be scraped off, tending to result in a short lifetime of the photosensitive member.

The charge injection layer binder resin of the charge injection layer 93 may include polyester, polycarbonate, acrylic resins, epoxy resins and phenol resins, as well as a curing agent for these resins, any of which may be used alone or in a combination of two or more. When the conductive fine particles are dispersed in a large quantity, it is preferred that the conductive fine particles are dispersed by the use of a reactive monomer or a reactive oligomer, and the photosensitive member surface is coated with the resultant dispersion, followed by curing with light or heat.

When the photosensitive layer 92 is formed of amorphous silicon, the charge injection layer 93 may preferably be formed of SiC.

The conductive fine particles dispersed in the charge injection layer binder resin of the charge injection layer 93 may include fine particles of metals or metal oxides. Preferably, they are ultrafine particles of metals or metal oxides such as zinc oxide, titanium oxide, tin oxide, antimony oxide, indium oxide, bismuth oxide, tin oxide-coated titanium oxide, tin-coated indium oxide, antimony-coated tin oxide and zirconium oxide. Any of these may be used alone or in a combination of two or more.

In general, when particles are dispersed in the charge injection layer 93, in order to prevent the incident light from being scattered by dispersed particles, it is necessary for the particles to have a diameter smaller than the wavelength of the incident light. The conductive fine particles dispersed in the surface layer in the present invention may preferably have particle diameters of 0.5 $\mu$m or smaller.

In the present invention, the charge injection layer 93 may preferably contain lubricant particles. The reason therefor is-that the friction between the photosensitive member and the charging member may be reduced at the time of charging and hence the charging nip can be expanded to bring about an improvement in charging performance. In particular, as the lubricant particles, it is preferable to use fluorine resins, silicone resins or polyolefin resins, having a low critical surface tension. More preferably, tetrafluoroethylene resin (PTFE) may be used. In this instance, the lubricant particles may be added in an amount of from 2 to 50% by weight, and preferably from 5 to 40% by weight, based on the weight of the resin. This is because, if they are of less than 2% by weight, the lubricant particles are not in a sufficient quantity and hence the charging performance may not be sufficiently improved, and, if they are of more than 50% by weight, the resolution of images and the sensitivity of the photosensitive member may greatly lower.

The charge injection layer 93 in the present invention may preferably have a layer thickness of from 0.1 to 10 $\mu$m, and particularly from 1 to 7 $\mu$m.

If it has a layer thickness smaller than 0.1 $\mu$m, the layer may lose its durability to fine scratches, and consequently faulty images due to faulty injection tend to occur. If it has a layer thickness larger than 10 $\mu$m, the injected charges may diffuse to tend to cause disorder of images.

In the present invention, fluorine-containing fine resin particles may be used in the electrostatic latent image bearing member. The fluorine-containing fine resin particles are comprised of one or more materials selected from polytetrafluoroethylene, polychlorotrifluoroethylene, polyvinylidene fluoride, polydichlorodifluoroethylene, a tetrafluoroethylene-perfluoroalkyl vinyl ether copolymer, a tetrafluoroethylene-hexafluoropropylene copolymer, a tetrafluoroethylene-ethylene copolymer and a tetrafluoroethylene-hexafluoropropylene -perfluoroalkyl vinyl ether copolymer. Commercially available fluorine-containing fine resin particles may be used as they are. Those having a molecular weight of from 3,000 to 5,000,000 may be used, and these may preferably have a particle diameter of from 0.01 to 10 $\mu$m, and more preferably from 0.05 to 2.0 $\mu$m.

In many instances, the above fluorine-containing fine resin particles, charge-generating material and charge-transporting material are dispersed and incorporated respectively into binder resins having film forming properties to form each of protective layers and photosensitive layers. Such binder resins may include polyester, polyurethane, polyacrylate, polyethylene, polystyrene, polycarbonates, polyamides, polypropylene, polyimides, phenol resins, acrylic resins, silicone resins, epoxy resins, urea resins, allyl resins, alkyd resins, polyamide-imide, nylons, polysulfone, polyallyl ethers, polyacetals and butyral resins.

The conductive support of the electrostatic latent image bearing member may be made of a metal such as iron, copper, gold, silver, aluminum, zinc, titanium, lead, nickel, tin, antimony or indium or an alloy thereof, an oxide of any of these metals, carbon, or a conductive polymer. It may have a drum shape such as a cylinder or a column, a belt, or a sheet. The above conductive materials may be molded as they are, may be used in the form of coating materials, may be vacuum-deposited, or may be processed by etching or plasma treatment.

The image forming method making use of the two component type developer described above will be described below.

The image forming method of the present invention comprises circulating and transporting the two component type developer carried onto a developer carrying member, and developing in a developing zone defined by a latent image bearing member and the developer carrying member provided opposed thereto, and developing a latent image held on the latent image bearing member, by the use of the toner of the two component type developer carried on the developer carrying member.

Magnetic properties of development carriers are influenced by a magnet roller installed in a developing sleeve, and greatly influence the developing performance and transport performance of developers.

In the image forming method of the present invention, of the developing sleeve (developer carrying member) and the magnet roller installed therein, for example, the magnet roller is set stationaily and the developing sleeve alone is rotated, where the two component type developer comprised of the carrier comprising magnetic particles and the insulative color toner is circulated and transported onto the developing sleeve and an electrostatic latent image held on the surface of a latent image bearing member is developed using the two component type developer.

In the image forming method of the present invention, copying can enjoy good image uniformity and good gradation reproduction when (1) the magnet roller is comprised of poles having a repulsion pole, (2) the magnetic flux density in the developing zone is 500 to 1,200 gausses and (3) the development carrier has a saturation magnetization of 20 to 65 $Am^2/g$.

In the image forming method of the present invention, the electrostatic latent image may preferably be developed by the toner of the two component type developer under application of a developing bias in the developing zone.

A particularly preferred developing bias will be described below in detail.

Figure 3:
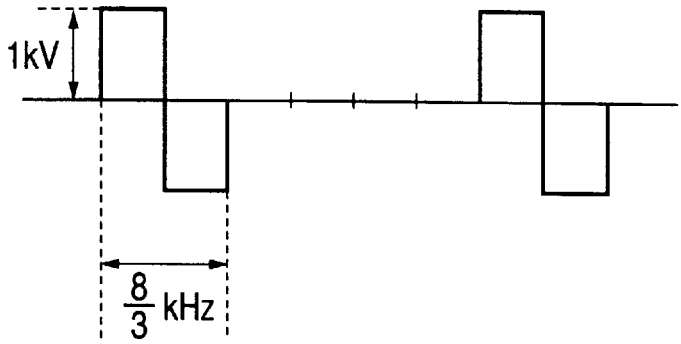
FIG. 3 shows an alternating electric field used in Example 1.

The image forming method of the present invention, in order to form a developing electric field in the developing zone defined between the latent image bearing member and the developer carrying member, it is preferred that the developer carrying member a development voltage having a discontinuous AC component as shown in FIG. 3 is applied to the developer carrying member to develop the latent image held on the latent image bearing member, by the use of the toner of the two component type developer carried on the developer carrying member. This development voltage is specifically constituted of a first voltage for directing the toner from the latent image bearing member toward the developer carrying member in the developing zone, a second voltage for directing the toner from the developer carrying member toward the latent image bearing member and a third voltage intermediate between the first voltage and the second voltage.

In addition, the time ($T_2$) for which the third voltage intermediate between the first voltage and the second voltage is applied to the developer carrying member, i.e., the time for which the AC voltage pauses, may be made longer than the total time ($T_1$) for which the first voltage for directing the toner from the latent image bearing member toward the developer carrying member and the second voltage for directing the toner from the developer carrying member toward the latent image bearing member are applied to the developer carrying member, i.e., the time for which the AC component operates. This is particularly preferred because the phenomenon of injection into the latent image bearing member in the developing step can be more controlled and the toner can be rearranged on the latent image bearing member to reproduce images faithful to latent images.

Specifically, between the latent image bearing member and the developer carrying member in the developing zone, an electric field in which the toner is directed from the latent image bearing member toward the developer carrying member and an electric field in which the toner is directed from the developer carrying member toward the latent image bearing member may be formed at least once, and thereafter an electric field in which the toner is directed from the developer carrying member toward the latent image bearing member in an image area of the latent image bearing member and an electric field in which the toner is directed from the latent image bearing member toward the developer carrying member in a non-image area of the latent image bearing member may be formed for a given time, thereby developing a latent image held on the latent image bearing member by the use of the toner of the two component type developer carried on the developer carrying member, where the time ($T_2$) for forming the electric field in which the toner is directed from the developer carrying member toward the latent image bearing member in an image area of the latent image bearing member and the electric field in which the toner is directed from the latent image bearing member toward the developer carrying member in a non-image area of the latent image bearing member may preferably be made longer than the total time ($T_1$) for forming the electric field in which the toner is directed from the latent image bearing member toward the developer carrying member and the electric field in which the toner is directed from the developer carrying member toward the latent image bearing member.

The electrostatic latent image may hardly be disordered by the phenomenon of injection into the latent image bearing member and the carrier adhesion may more hardly occur, when development is carried out in the presence of a developing electric field where alternation is periodically made off in the developing process in which development is carried out while forming the above specific developing electric field, i.e., an alternating electric field. The reason therefor is still unclear, and is presumed as follows:

In conventional continuous sinusoidal or rectangular waves, when an electric field intensity is made higher in an attempt to achieve a higher image density, the phenomenon of carrier adhesion or phenomenon of injection at the time of development tend to occur. The phenomenon of carrier adhesion more remarkably occurs when the particle diameter of the carrier is made smaller or the magnetic force is made smaller. Also, the phenomenon of injection remarkably occurs at the volume resistivity of the surface layer of the latent image bearing member used in the present invention.

Moreover, in conventional continuous sinusoidal or rectangular waves, when an electric field intensity is made higher in an attempt to achieve a higher image density, the toner and development carrier together reciprocate between the latent image bearing member and the developer carrying member, so that the development carrier strongly rubs against the latent image bearing member to cause the carrier adhesion. This more remarkably tends to occur with an increase in the fine powder carrier.

However, the application of the specific developing electric field as in the present invention causes the toner or the carrier to reciprocate between the developer carrying member and the latent image bearing member in an incomplete reciprocation under one pulse. Hence, after that, in the case when a potential difference $V_{cont}$ between the surface potential of the latent image bearing member and the potential of a direct current component of a developing bias is $V_{cont}<0$, the $V_{cont}$ acts so as to allow the carrier to fly from the developer carrying member. However, the carrier adhesion can be prevented by controlling the magnetic properties of the development carrier and the magnetic flux density at the developing zone of the magnet roller. When $V_{cont}>0$, the force of a magnetic field and the $V_{cont}$ act to attract the development carrier to the side of the developer carrying member, so that no carrier adhesion occurs.

An image forming apparatus that can carry out the image forming method of the present invention will be described with reference to FIG. 1 (or FIG. 8).

As shown in FIG. 1 (or FIG. 8), the image forming apparatus comprises a photosensitive drum 1 (or 101) serving as the electrostatic latent image bearing member, and a developing assembly 4 (or 104) in which the inside of a developing container 16 (or 116) is partitioned into a developing chamber (first chamber) R1 (or R101) and an agitator chamber (second chamber) R2 (or R102) by a partition wall 17 (or 117). At the upper part of the agitator chamber R2 (or R102), a toner storage chamber R3 (or R103) is formed on the other side of the partition wall 17 (or 117). A developer 19 (or 119) is held in the developing chamber R1 (or R101) and agitator chamber R2 (or R102), and a replenishing toner (non-magnetic toner) 18 (or 118) is held in the toner storage chamber R3 (or R103). The toner storage chamber R3 (or R103) is provided with a supply opening 20 (or 120) so that the replenishing toner 18 (or 118) is dropwise supplied through the supply opening 20 (or 120) into the agitator chamber R2 (or R102) in a quantity corresponding to the toner consumed.

A transport screw 13 (or 113) is provided in the developing chamber R1 (or R101). As the transport screw 13 (or 113) is rotated driven, the developer 19 (or 119) held in the developing chamber R1 (or R101) is transported in the longitudinal direction of a developing sleeve 11 (or 111). Similarly, a transport screw 14 (or 114) is provided in the agitator chamber R2 (or R102) and, as the transport screw 14 (or 114) is rotated, the toner having dropped from the supply opening 20 (or 120) into the agitator chamber R2 (or R102) is transported in the longitudinal direction of the developing sleeve 11 (or 111).

The developer 19 (or 119) is a two component type developer comprising a non-magnetic toner 19*a* and a magnetic carrier 19*b*.

The developing container 16 (or 116) is provided with an opening at its-part adjacent to the photosensitive drum 1 (or 101), and the developing sleeve 11 (or 111) protrudes outward from the opening, where a gap is formed between the developing sleeve 11 (or 111) and the photosensitive drum 1 (or 101). The developing sleeve 11 (or 111), formed of a non-magnetic material, is provided with a bias applying means 30 (or 130) for applying a bias voltage.

The magnet roller serving as a magnetic field generating means fixed inside the developing sleeve 11 (or 111), that is, a magnet 12 (or 112) has a developing magnetic pole N, a magnetic pole S positioned downstream therefrom, and magnetic poles N, S and S for transporting the developer 19 (or 119). The magnet 12 (or 112) is provided in the developing sleeve 11 (or 111) in such a way that the developing magnetic pole S faces the photosensitive drum 1 (or 101). The developing magnetic pole S produces a magnetic field in the vicinity of a developing zone defined between the developing sleeve 11 (or 111) and the photosensitive drum 1 (or 101), where a magnetic brush is formed by the magnetic field.

A developer regulating blade 15 (or 115) provided blow the developing sleeve 11 (or 111) to control the layer thickness of the developer 19 (or 119) on the developing sleeve 11 (or 111) is a non-magnetic blade 15 (or 115) made of a non-magnetic material such as aluminum or SUS316 stainless steel, and the distance between the end of the non-magnetic blade and the face of the developing sleeve 11 (or 111) is 300 to 1,000 μm, and preferably 400 to 900 μm. If this distance is smaller than 300 μm, the magnetic carrier may be caught between them to tend to make the developing layer uneven, and also the developer necessary for carrying out good development may not be coated on the sleeve, bringing about such a problem that only developed images with a low density and much unevenness can be obtained. In order to prevent uneven coating (what is called the blade clog) due to unnecessary particles included in the developer, the distance may preferably be 400 μm or larger. If it is larger than 1,000 μm, the quantity of the developer applied on the developing sleeve 11 (or 111) increases so that the developer layer thickness cannot be regulated, bringing about such problems that the magnetic carrier particles adhere to the photosensitive drum 1 (or 101) in a large quantity and the rotation of the developer and the control of the developer by the non-magnetic blade 15 (or 115) may become less effective for development control to cause fog because of a shortage of triboelectricity of the toner.

This layer of magnetic carrier particles, even when the developing sleeve 11 (or 111) is rotated in the direction of an arrow, moves slower as it separates from the sleeve surface in accordance with the balance between the binding force based on magnetic force and gravity and the transport force acting toward the transport of the sleeve 11 (or 111). Some particles, of course, drop down due to gravity.

Accordingly, the position to arrange the magnetic poles N and N and the fluidity and magnetic properties of the magnetic carrier particles are appropriately selected, so that the magnetic carrier particle layer is transported toward the magnetic pole N as it stands nearer to the sleeve, to form a moving layer. Along this movement of the magnetic carrier particles, the developer is transported to the developing zone as the developing sleeve 11 (or 111) is rotated, and participates in development.

The photosensitive member 1 (or 101) is contact injection-charged by the magnetic particles carried on a transport sleeve 21, and thereafter a latent image is formed thereon by an image exposure means (not shown) and a developed image is formed by the use of the toner.

In the image forming method of the present invention, the developing sleeve may have a surface shape that fulfill the following conditions: 0.2 μm≦center line average roughness (Ra)≦5.0 μm $$10\ \mu m \leqq \text{irregularity average distance (Sm)} \leqq 80\ \mu m$$

$$0.05 \leqq Ra/Sm \leqq 0.5.$$

The Ra and Sm are values that prescribe the center line average roughness and the average distance of irregularities described in JIS-B0601 and IS00468, respectively, and are determined according to the following expressions:

$$Ra = (1/l)\int_0^l |f(x)|\,dx$$

$$Sm = (1/n)\sum_{i=1}^{n} Sm_i$$

If the Ra is smaller than 0.2 μm, the developer transport performance may be insufficient to tend to cause uneven images or uneven image density as a result of running (i.e., after making many copies). If the Ra is larger than 5 μm, the developer transport performance can be good but the regulating force at the part where the developer transport quantity is regulated by the blade or the like may become so large that the external additive may be deteriorated by rubbing friction, bringing about deterioration of image quality when making a large number of copies.

If the Sm is larger than 80 μm, the developer is difficult to hold on the developing sleeve to cause a decrease in image density. The details of the cause attributable to the Sm are unclear, but are considered to be due to the slippage occurring between the developing sleeve and the developer carrying member at the former's transport quantity regulating part or so, where the developer may act as a densely packed mass if the irregularity distance (distance between hills or convexties) is too large and its force exceeds the holding power acting between the developing sleeve and the developer. If the Sm is smaller than 10 μm, most of irregularities (hills or convexties and valleys or concavities) on the developer carrying member surface are smaller than the average particle diameter of the developer, and hence the developer entering in valleys comes to have a particle size selectivity, tending to cause its melt-adhesion due to fine powder components of the developer, and in addition bringing about a difficulty in manufacture.

From the foregoing viewpoints, the hill-valley gradient [≈ f(Ra/Sm)] determined from the height of hills and the distance between hills on the developing sleeve is important in the present invention. In the present invention, it may preferably be:

$$0.05 \leqq Ra/Sm \leqq 0.5.$$

and more preferably from 0.07 to 0.3.

If the Ra/Sm is less than 0.05, the developer holding power on the developing sleeve is so weak that the developer is difficult to hold on the developing sleeve and hence its transport quantity can not be controlled at the developer regulating part, resulting in uneven images. If the Ra/Sm is more than 0.5, the developer entering valleys of the developing sleeve may not be circulated together with other developer to cause the melt-adhesion of developer.

Grooves (what is called knurls) may be made in some lines on the developing sleeve in its lengthwise direction, whereby even the developer with a good fluidity can be uniformly applied on the surface layer.

The Ra and Sm in the present invention are measured using a contact type surface roughness measuring device SE-3300 (manufactured by Kosaka Kenkyusho K.K.) and according to JIS-B0601.

The developing sleeve having the given surface roughness in the present invention can be produced by, e.g., sandblasting making use of particles with definite or indefinite form as abrasive particles, sand paper processing in which the sleeve surface is rubbed with sand paper in the axial direction to form irregularities in the circumferencial direction of the sleeve, processing by chemical treatment, or processing in which the surface is coated with an elastic resin and thereafter resin hills or convexes are formed.

Another example of the image forming apparatus that can carry out the image forming method of the present invention will be described below with reference to FIG. 9.

Figure 9:
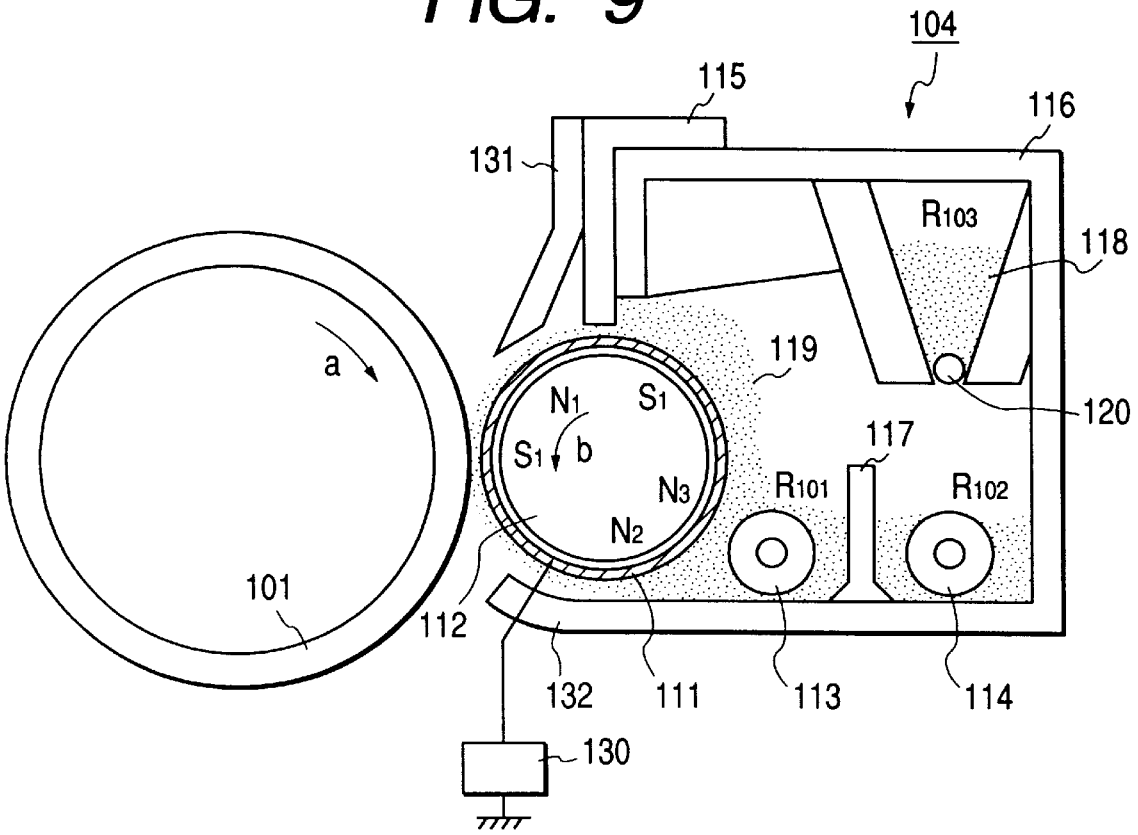
FIG. 9 schematically illustrates another example of an image forming apparatus that can carry out the image forming method of the present invention.

The developing system 104 as shown in FIG. 9 comprises a developing container 116 receiving a developing chamber R101 having therein a non-magnetic developing sleeve 111 serving as the developer carrying member, which is provided opposite to a photosensitive drum 101 serving as the electrostatic latent image bearing member, rotatable in the direction of an arrow a. In this developing sleeve 111, a magnet 112 as a magnetic field generating means is left standing stationary, and the magnet 112 is magnetized to have magnetic poles in the order of S1, N1, S2, N2 and N3 from its approximate top in the rotational direction of an arrow b.

The developing chamber R101 holds therein a two component type developer 119 comprised of a blend of a toner with a carrier.

This developer 119 is sent to the inside of an agitator chamber R102 of the developing container 116 through one opening (not shown) made in a partition wall 117 whose upper end is open at one end of the developing chamber R101, where a toner 118 having been fed into the agitator chamber R102 is supplied from a toner chamber R103 and is transported to the other end of the agitator chamber R102 while being blended by a transporting screw 114 in the agitator chamber R102. The developer 119 having been transported to the other end of the agitator chamber R102 is sent back to the inside of the developing chamber R101 through the other opening (not shown) made in the partition wall 117, and then fed onto the developing sleeve 111 while being agitated and transported by a transporting screw (not shown) for transporting the developer at the upper part in the developing chamber R101 in the direction reverse to the direction in which the developer is transported by the transporting screw 113.

The developer 119 fed onto the developing sleeve 111 is magnetically bound thereto by the action of a magnetic force of the magnet 112, and thus carried on the developing sleeve 111. Then the developer is transported in the direction of the arrow b of the developing sleeve 111 while being formed into a thin layer of the developer 119 on the developing sleeve 111 by the regulation of a developer regulating blade 115 provided above the approximate top of the developing sleeve 111, and, in the developing zone, used to develop the electrostatic latent image on the photosensitive drum 101 by applying a development bias from a development bias applying means 130. Remaining two component type developer not consumed for the development is collected into the developing container 116 as the developing sleeve 111 is rotated. Reference numeral 131 denotes an upstream side toner scatter preventive member, and 132, a downstream side toner scatter preventive member. These upstream side toner scatter preventive member 131 and downstream side toner scatter preventive member 132 prevent the toner from scattering.

In the developing container 116, the remaining two component type developer not consumed for the development, magnetically bound onto the developing sleeve 111, is designed so as to be taken off by a repulsive magnetic field between N2 and N3 having the same polarity. In order to prevent toner scatter from occurring when the two component type developer rises in ears along the magnetic line of force by the action of the magnetic pole N2, an elastic seal member is provided stationarily at the lower part of the developing container 116 in such a manner that its one end comes in touch with the developer.

Figure 6:
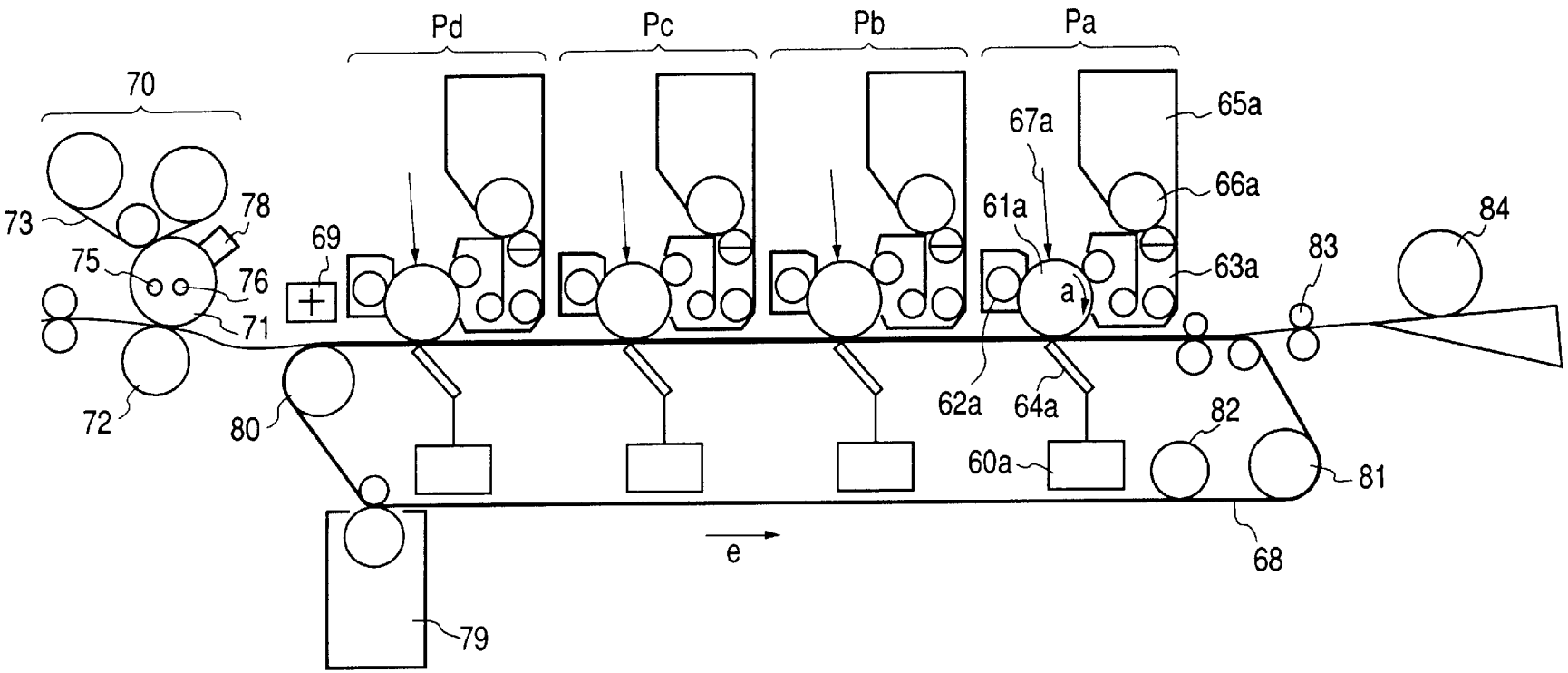
FIG. 6 schematically illustrates another example of an image forming apparatus used in the image forming method of the present invention.

FIG. 6 schematically illustrates still another image forming apparatus that can carry out the image forming method of the present invention.

The main body of the image forming apparatus is provided side by side with a first image forming unit Pa, a second image forming unit Pb, a third image forming unit Pc and a fourth image forming unit Pd, and images with respectively different colors are formed on a transfer-receiving medium through the process of latent image formation, development and transfer.

The respective image forming unit provided side by side in the image forming apparatus are each constituted as described below taking the first image forming unit Pa as an example.

The first image forming unit Pa has an electrophotographic photosensitive drum 61*a* of 30 mm diameter as the latent image bearing member. This photosensitive drum 61*a* is rotated in the direction of an arrow a. Reference numeral 62*a* denotes a primary charging assembly as a charging means, and a magnetic brush charging assembly is used which comprises a 16 mm diameter sleeve on which conductive magnetic particles are carried in contact with the photosensitive drum 61*a*. Reference numeral 67*a* denotes an exposure device as a latent image forming means for forming an electrostatic latent image on the photosensitive drum 61*a* whose surface has been uniformly charged by means of the primary charging assembly 62*a*. Reference numeral 63*a* denotes a developing assembly as a developing means for developing the electrostatic latent image held on the photosensitive drum 61*a*, to form a color toner image, which holds a color toner. Reference numeral 64*a* denotes a transfer blade as a transfer means for transferring the color toner image formed on the surface of the photosensitive drum 61*a*, to the surface of a transfer medium transported by a belt-like transfer medium carrying member 68. This transfer blade 64*a* comes into touch with the back of the transfer medium carrying member 68 and can apply a transfer bias.

In this first image forming unit Pa, a photosensitive member of the photosensitive drum 61*a* is uniformly primarily charged by the primary charging assembly 62*a*, and thereafter the electrostatic latent image is formed on the photosensitive member by the exposure means 67*a*. The electrostatic latent image is developed by the developing assembly 63*a* using a color toner. The toner image thus formed by development is transferred to the surface of the transfer medium by applying transfer bias from the transfer blade 64*a* coming into touch with the back of the belt-like transfer medium carrying member 68 carrying and transporting the transfer medium, at a first transfer zone (where the photosensitive member comes into contact with the transfer-receiving medium).

The toner remaining on the photosensitive drum 61*a* after transfer is transported following the rotation of the photosensitive drum 61*a*, passed through the part charged by the primary charging assembly 62*a*, and collected and removed by the developing assembly 63*a* at the developing zone, thus a cleanerless system is employed.

In the image forming apparatus, the second image forming unit Pb, third image forming unit Pc and fourth image forming unit Pd, constituted in the same way as the first image forming unit Pa but having respectively different color toners held in the developing assemblies, are provided side by side as shown in FIG. 6. For example, a yellow toner is used in the first image forming unit Pa, a magenta toner in the second image forming unit Pb, a cyan toner in the third image forming unit Pc and a black toner in the fourth image forming unit Pd, and the respective color toners are successively transferred to the transfer-receiving medium at the transfer zones of the respective image forming units. In this course, the respective color toners are superimposed while adjusting registration, on the same transfer-receiving medium every time the transfer-receiving medium moves once. After the transfer is completed, the transfer medium is separated from the surface of the transfer medium carrying member 68 by a separation charging assembly 69, and then sent to a fixing assembly 70 by a transport means such as a transport belt, where a final full-color image is formed by carrying out fixing just once.

The fixing assembly 70 has a 40 mm diameter fixing roller 71 and a 30 mm diameter pressure roller 72 in pair. The fixing roller 71 has heating means 75 and 76. Reference numeral 73 denotes a web for removing any stains on the fixing roller.

The unfixed color toner images transferred onto the transfer medium are passed through the pressure contact area between the fixing roller 71 and the pressure roller 72, whereupon they are fixed onto the transfer medium by the action of heat and pressure.

In the apparatus shown in FIG. 6, the transfer medium carrying member 68 is an endless belt-like member. This belt-like member is moved in the direction of an arrow e by a drive roller 80. Reference numeral 79 denotes a transfer belt cleaning device; 81, a belt follower roller; and 82, a belt charge eliminator. Reference numeral 83 denotes a pair of resist rollers for transporting to the transfer-receiving medium carrying member 68 the transfer-receiving medium kept in a transfer medium holder.

As the transfer means, the transfer blade coming into touch with the back of the transfer-receiving medium carrying member may be replaced with a contact transfer means that comes into contact with the back of the transfer-receiving medium carrying member and can directly apply a transfer bias, as exemplified by a roller type transfer roller.

The above contact transfer means may also be replaced with a non-contact transfer means that performs transfer by applying a transfer bias from a corona charging assembly provided in non-contact with the back of the transfer-receiving medium carrying member as commonly used.

However, in view of such an advantage that the quantity of ozone generated when the transfer bias is applied can be controlled, it is more preferable to use the contact transfer means.

In the image forming method making use of the above two component type developer, as a moving speed (S2) of the developer carrying member surface with respect to a moving speed (S1) of the latent image bearing member surface, the developer carrying member surface may preferably be moved at 100 to 300%, and more preferably 120 to 200%, in the counter direction to the direction of the movement of the latent image bearing member surface. This is preferable because the frequency that the magnetic brush of the development magnetic carrier is brought into contact with the latent image bearing member surface increase and hence the developing performances such as solid-image uniformity and halftone-image gradation can be more improved.

However, in the relation between the moving direction and speed of the latent image bearing member surface and the moving direction and speed of the developer carrying member surface as stated above, the frequency that the magnetic brush of the development magnetic carrier is brought into contact with the latent image bearing member surface is so high that the phenomenon of charge injection into the latent image bearing member surface caused by the development bias applied to the developing sleeve at the time of development is liable to occur to, tending to disorder the electrostatic latent image held on the latent image bearing member.

However, in the present invention, the volume resistivity D1 of the development magnetic carrier and the volume resistivity A of the surface layer of the latent image bearing member fulfill the condition of A<D1 as previously described, and hence the phenomenon of charge injection into the latent image bearing member surface at the time of development can be controlled. Thus, when developed under the above relation between the moving direction and speed of the latent image bearing member surface and the moving direction and speed of the developer carrying member surface, the disorder of electrostatic latent images can be controlled to such a degree that no problem arises in practical use.

Moreover, when the latent image bearing member has a cylindrical shape, the ratio of diameter (d1) of such a cylindrical latent image bearing member to the diameter (d2) of the cylindrical developer carrying member magnetically binding the development magnetic carrier thereon, d1/d2, may preferably be from 1.0 to 3.0, more preferably from 1.0 to 2.2, and still more preferably from 1.0 to 2.0. The reason is that the area of the magnetic brush of the development magnetic carrier in contact with the latent image bearing member surface decreases so that the phenomenon of charge injection caused by the development bias applied at the time of development tends to occur, and the electrostatic latent image is liable to be disordered, but the apparatus can be miniaturized as a whole.

When the above relation of the ratio of the diameter of the latent image bearing member to the diameter of the developer carrying member is satisfied, the area of the magnetic brush of the development magnetic carrier in contact with the latent image bearing member is reduced and hence the developing performance tends to lower. Since, however, in the present invention, the volume resistivity D1 of the development magnetic carrier and the volume resistivity A of the surface layer of the latent image bearing member fulfill the condition of A<D1 as previously described, the phenomenon of charge injection into the latent image bearing member surface at the time of development can be controlled. Thus, the electric field intensity of the development bias applied to the developer carrying member at the time of development can be made higher to improve the developing performance without causing the latent image disorder.

As described previously, in the present invention, the cleanerless system refers to a system in which (I) the latent image bearing member charging zone in the charging step, (II) the electrostatic latent image developing zone in the developing step and (III) the toner image transfer zone in the transfer step are successively positioned in the direction the latent image bearing member moves, where any cleaning means for removing, in contact with the latent image bearing member surface, the toner remaining on its surface after the transfer step is not provided between the transfer zone and the charging zone and between the charging zone and the developing zone, and the toner remaining on the latent image bearing member surface after the transfer step is removed by the developing assembly in the developing step at the same time.

In the present invention, the "charging zone" refers to a zone at which the contact charging means comes into contact with the latent image bearing member surface whereupon the latent image bearing member is electrostatically charged, the "developing zone" refers to a zone at which the two component type developer or one component type developer carried on the developer carrying member comes into contact with the latent image bearing member surface whereupon the electrostatic latent image is developed, and the "transfer zone" refers to a zone at which the toner image formed on the latent image bearing member comes into contact with the transfer-receiving medium (or recording medium) and is transferred to the transfer-receiving medium (or recording medium).

Figure 5:
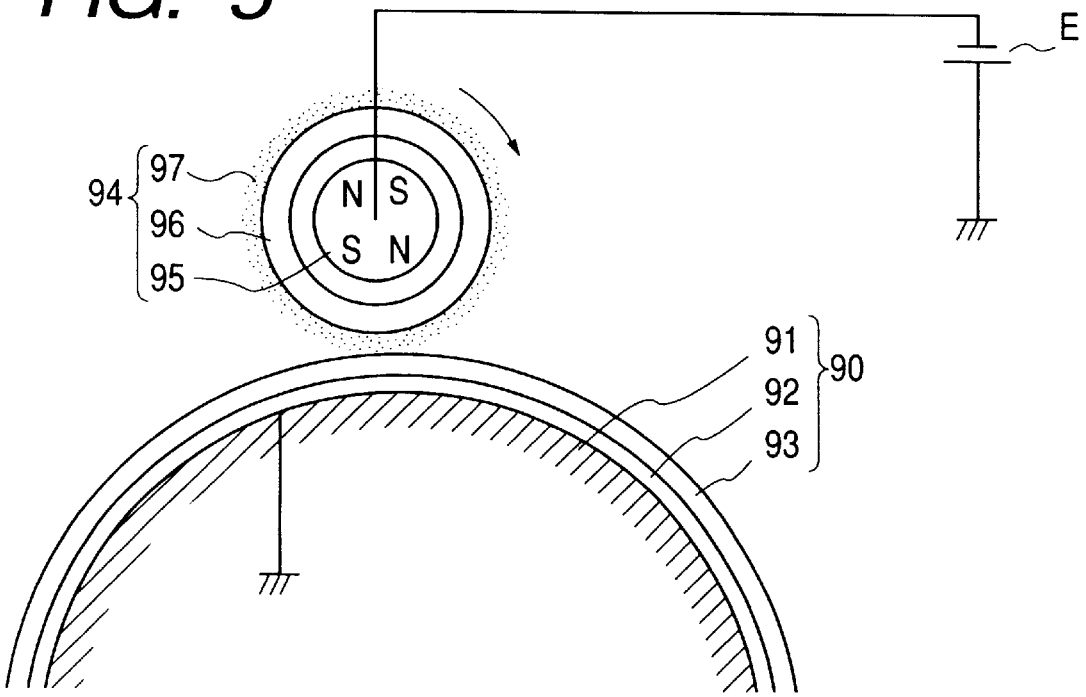
FIG. 5 schematically illustrates a magnetic-brush charging assembly.

FIG. 5 schematically illustrates a magnetic brush charging assembly as an embodiment of the contact charging means preferably used in the present invention.

The magnetic brush charging assembly 94 is constituted of a non-magnetic sleeve 96, a magnet roll 95 installed inside the sleeve 96 and charging conductive magnetic particles 97 magnetically bound onto the sleeve 96.

For the charging conductive magnetic particles, various materials may be used which include single-component crystals or mixed crystals of conductive metals such as ferrite and magnetite. These are conductive particles once sintered, which are then subjected to reduction or oxidation treatment to control their resistance. The charging conductive magnetic particles may be constituted as follows: the conductive and magnetic fine particles is kneaded into a binder polymer and formed into particles to obtain particles comprising conductive and magnetic particles dispersed in the binder polymer, and preferably, the above conductive magnetic particles are further coated with a resin. In this instance, the resistance of the coated resin layer is controlled by adjusting the content of a conductive agent such as carbon so that the resistance of the whole conductive magnetic particles is controlled.

The magnetic brush charging assembly 94 is fixed to a photosensitive drum 90 through a spacer member (not shown) at its each end in the longitudinal direction so as to leave a distance of 0.1 to 1 mm between the surfaces of the sleeve 96 and drum 90. The magnetic brush is brought into touch with the surface of the photosensitive drum 90 and the sleeve 96 is rotated in the same direction as the drum 90 (in the clockwise direction as viewed in FIG. 5 and in the counter direction to the drum surface) while the magnet roll 95 is set stationary, thereby electrostatically charging the photosensitive drum.

As the charging bias used to charge the photosensitive drum by means of this magnetic brush charging assembly, it is preferable to superimpose an alternating electric field on a DC electric field. The alternating electric field may preferably be a rectangular wave voltage of from 0.5 to 3 kV (peak-to-peak value) with a frequency of from 0.5 to 3 kHz. More preferably, a frequency of from 0.8 to 2.2 kHz and a voltage of from 1.0 to 2.1 kV are preferred because of a wide latitude for preventing fog caused by uneven charge pitch due to the frequency.

Measuring methods used in the present invention will be described below.

(1) Measurement of magnetic properties of development magnetic carrier:

A BHU-60 type magnetization measuring device (manufactured by Riken Sokutei Co.) is used as an apparatus for measurement. About 1.0 g of a sample for measurement is weighed and packed in a cell of 7 mm diameter and 10 mm high, which is then set in the above apparatus. Measurement is made while gradually increasing an applied magnetic field to be changed to 3,000 oersteds at the maximum. Subsequently, the applied magnetic field is decreased, and finally a hysteresis curve of the sample is obtained on a recording paper. Saturation magnetization, residual magnetization and coercive force are determined therefrom.

(2) Measurement of particle size distribution of development magnetic carrier:

An SRA type microtrack particle size analyzer (manufactured by Nikkiso K.K.) is used as an apparatus for measurement. Measurement range is set at from 0.7 to 125 $\mu$m, and the 50% average particle diameter is calculated from volume-based data.

(3) Measurement of apparent density of development magnetic carrier:

Using a powder tester (manufactured by Hosokawa Micron Co.), a sieve with 75 $\mu$m meshes is vibrated at a vibrational amplitude of 1 mm, and apparent density is measured in the state the particles have been passed.

Figure 2:
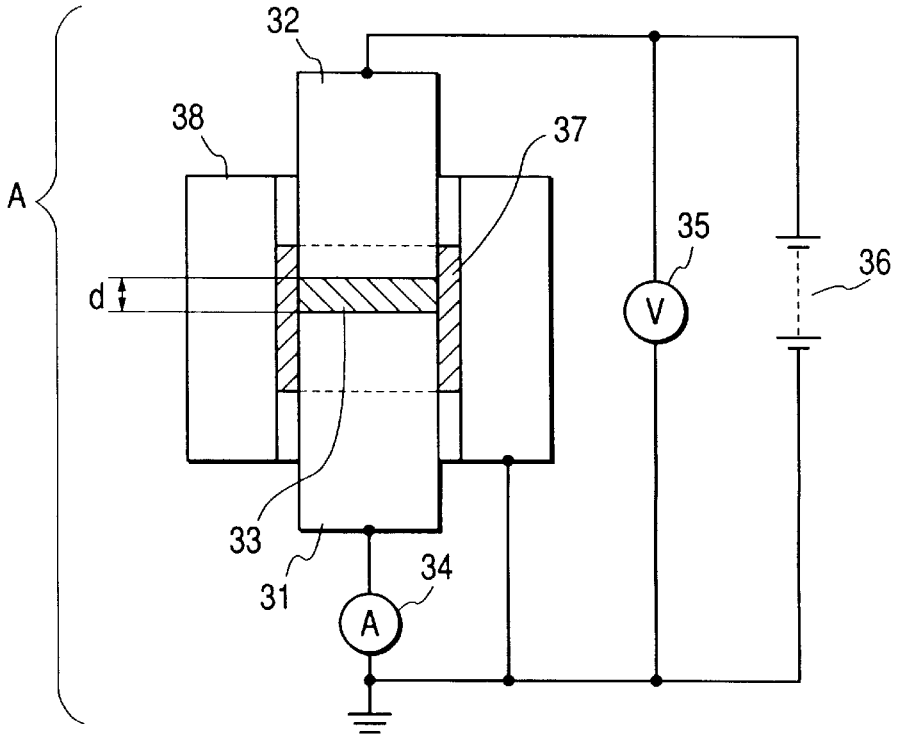
FIG. 2 schematically illustrates an apparatus used to measure volume resistivity and impedance.

(4) Measurement of impedance of development magnetic carrier:

Measured using a cell shown in FIG. 2. In the measuring apparatus shown in FIG. 2, reference numeral 31 denotes a lower electrode; 32, an upper electrode; 33, a sample to be measured; 34, an ammeter; 35, a voltmeter; 36, a voltage stabilizer; 37, an insulating material; 38, a guide ring; and A, a resistance measuring cell. The cell A is packed with the sample 33 and the electrodes 31 and 32 are so provided as to come into contact with the sample 33, where a 2 kHz and 2 kvpp sinusoidal AC voltage is applied across the electrodes and the alternating currents flowing at that time are measured to determine impedance. The measurement is made under conditions of contact area S between the packed sample 33 and the cell; 2 $cm^2$; thickness d: 3 mm; and load of the upper electrode: 15 kg. Here, the value of impedance is determined according to the following expression.

$$(\text{Alternating voltage amplitude/electric current value})\times(S/d)$$

(5) Measurement of volume resistivities of development magnetic carrier, charging conductive magnetic particles and external additive:

The volume resistivity is measured using the cell shown in FIG. 2, described above. More specifically, the cell A is packed with the sample 33 and the electrodes 31 and 32 are so provided as to come into contact with the sample 33, where a 1,000 V DC voltage is applied across the electrodes and the currents flowing at that time are measured using the ammeter. The measurement is made under conditions of contact area S between the packed sample 33 and the cell; 2 $cm^2$; thickness d: 3 mm; and load of the upper electrode: 15 kg.

Figure 10:
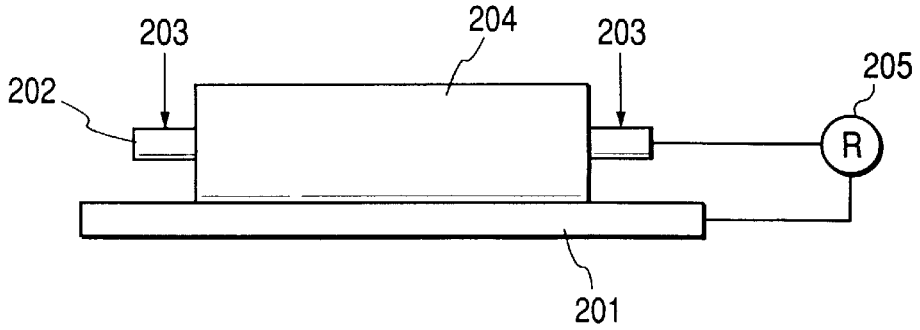
FIG. 10 schematically illustrates an appratus used to measure volume resistivity.

(6) Measurement of volume resistivities of charging conductive roller and conductive fiber of conductive fiber brush:

Volume resistivity is measured by the method shown in FIG. 10. Load is set at 500 g; applied voltage, 100 V; and nip width, about 2 mm. In the measuring apparatus shown in FIG. 10, reference numerals 201, 202, 203, 204 and 205 denote an aluminum plate, mandrel, load, roller or brush, and ohm-meter, respectively.

(7) Measurement of dispersed-particle diameter of external additive on toner particles:

Using a scanning electron microscope, a photograph is taken at 30,000 magnifications. Particle diameter of 100 particles of the external additive on toner particles are measured, and an average value thereof is regarded as dispersed-particle diameter.

(8) Measurement of volume resistivities of surface layer of latent image bearing member and surface layer of developer carrying member:

Volume resistivities of the surface layer of the latent image bearing member and the surface layer of the developer carrying member are measured in the following way: A surface layer is formed on a polyethylene terephthalate (PET) film on the surface of which gold has been vacuum-deposited. Its resistivity is measured using a volume resistivity measureing apparatus (4140 BpAMATER, manufactured by Hullet Packard Co.) in an environment of 23° C./65%RH by applying 100V.

(9) Measurement of hydrophobicity of fine powder:

0.2 g of a sample is added to 50 ml of water contained in an Erlenmeyer flask with a volume of 250 ml. Methanol is dropwise added from a buret until the whole sample has been swelled. Here, the solution inside the flask is continually stirred by means of a magnetic stirrer. The end point can be observed upon suspension of the whole sample in the solution. The hydrophobicity is expressed as a percentage of the methanol present in the liquid mixture of methanol and water when the reaction has reached the end point.

(10) Measurement of weight average particle diameter of fine particles:

A microtrack particle size analyzer Model 9230UPA (manufactured by Nikkiso K.K.) is used as an apparatus for measurement, which is made in the following way.

1) 20 ml of ethanol is put into a 50 cc glass beaker.
2) A sample is added so as to provide 200 mV of reflected power.
3) The sample is dispersed for 3 minutes using an ultrasonic wave generator UD200 (Tomih Seiko K.K.).
4) 6 ml of the sample is taken up. Measurement is made three times under temperature conditions of 22° C., and the weight average particle diameter is calculated from volume particle size distribution.

(11) Measurement of weight average particle diameter (50% average particle diameter) of charging conductive magnetic particles:

An SRA type microtrack particle size analyzer (manufactured by Nikkiso K.K.) is used as an apparatus for measurement. Measurement range is set at from 0.7 to 125 μm, and the weight average particle diameter is calculated from volume-based data.

(12) Measurement of particle diameter (weight average particle diameter) of toner:

The average particle diameter and particle size distribution of the toner can be measured using a Coulter counter Model TA-II or Coulter Multisizer (manufactured by Coulter Electronics, Inc.). In the present invention, Coulter Multisizer (manufactured by Coulter Electronics, Inc.) is used. An interface (manufactured by Nikkaki K.K.) that outputs number distribution and volume distribution and a personal computer PC9801 (manufactured by NEC.) are connected. As an electrolytic solution, an aqueous 1% NaCl solution is prepared using first-grade sodium chloride. For example, ISOTON R-II (Coulter Scientific Japan Co.) may be used. Measurement is carried out by adding as a dispersant from 0.1 to 5 ml of a surface active agent, preferably an alkylbenzene sulfonate, to from 100 to 150 ml of the above aqueous electrolytic solution, and further adding from 2 to 20 mg of a sample to be measured. The electrolytic solution in which the sample has been suspended is subjected to dispersion for about 1 minute to about 3 minutes in an ultrasonic dispersion machine. The volume distribution and number distribution are calculated by measuring the volume and number of toner particles with diameters of not smaller than 2 μm by means of the above Coulter Multisizer, using an aperture of 100 μm as its aperture. Then the values according to the present invention are determined, which are the volume-based, volume average particle diameter (Dv: the middle value of each channel is used as the representative value for each channel) and weight average particle diameter (D4) determined from the volume distribution, the number-based, length average particle diameter (D1) determined from number distribution, the volume-based, percentage of particles determined from the volume distribution and the number-based, percentage of particles determined from the number distribution.

According to the present invention, the volume resistivity of each of the charging member, the surface layer of the latent image bearing member, the development magnetic carrier or developer carrying member and the external additive of the toner are defined, whereby the image forming method can be provided which is improved in the charging performance of the charge injection into the latent image bearing member at the time of charging and may cause no disorder of electrostatic latent images in the developing zone at the time of development, promising a high image quality and a high running performance.

EXAMPLES

Examples of the present invention are given below. The present invention is by no means limited to these. In the following, "part(s)" refers to "part(s) by weight".

Development Magnetic Carrier

Production Example 1

In an aqueous medium, a phenol/formaldehyde (50:50) monomer was mixed and dispersed. Thereafter, based on the weight of the monomer, 600 parts of 0.25 μm magnetite particles surface-treated with a titanium coupling agent and 400 parts of 0.6 μm hematite particles were uniformly dispersed, and the monomer was polymerized while adding ammonia in an appropriate quantity to obtain a magnetic particle-including, spherical magnetic resin carrier core (average particle diameter: 33 μm; saturation magnetization: 38 $Am^2/kg$).

Meanwhile, 20 parts of toluene, 20 parts of butanol, 20 parts of water and 40 parts of ice were put into a four-necked flask, and 40 parts of a mixture of 15 mols of $CH_3SiCl_3$ and 10 mols of $(CH_3)_2SiCl_2$ was added thereto with stirring. After further stirring for 30 minutes, condensation reaction was carried out at 60° C. for 1 hour. Thereafter, the siloxanes were well washed with water, and then dissolved in a toluene/methyl ethyl ketone/butanol mixed solvent to obtain a silicone varnish with 10% of solid content.

To the silicone varnish thus obtained, based on 100 parts of the siloxane solid content, 2.0 parts of ion-exchanged water, 2.0 parts of curing agent (2) shown below, 1.0 part of aminosilane coupling agent (11) shown below and 5.0 parts of silane coupling agent (18) shown below were simultaneously added to produce carrier coat solution I. This solution I was applied on 100 parts of the above carrier core by means of a coating machine (SPIRACOATER, manufactured by Okada Seiko K.K.) so as to be in a resin coat weight of 1 part, to obtain coated carrier I. This carrier had a 50% average particle diameter of 33 μm, a volume resistivity of $4\times10^{13}$ Ω·cm and an impedance of $2\times10^{10}$ Ω·cm.

(2)

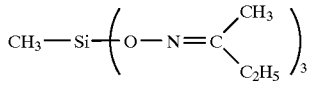

Development Magnetic Carrier

Production Example 2

Coated carrier II was obtained in the same manner as in Production Example 1 except that the magnetite particles were used in an amount of 100 parts.

Development Magnetic carrier

Production Example 3

Using 15 parts of NiO, 15 parts of ZnO and 70 parts of $Fe_2O_3$, these were made into fine particles, and thereafter water was added to effect granulation, followed by baking at 1,200° C. and then adjustment of particle size to obtain a ferrite carrier core with an average particle diameter of 35.8 μm.

The above core was coated with a solution prepared by incorporating 1% by weight of carbon black in the solution I, in the same manner as in Production Example 1 to obtain coated carrier III.

Development Magnetic Carrier

Production Example 4

Coated carrier IV was obtained in the same manner as in Production Example 3 except that the carrier core was prepared using 15 parts of MgO, 10 parts of MnO and 75 parts of $Fe_2O_3$.

Development Magnetic Carrier

Production Example 5

Coated carrier V was obtained in the same manner as in Production Example 1 except that a vinylidene fluoride/methyl methacrylate copolymer was used as the coat material.

Development Magnetic Carrier

Production Example 6

Coated carrier VI was obtained in the same manner as in Production Example 1 except that a methyl methacrylate copolymer was used as the coat material and was coated dividedly five times so as to be in a coat weight of 5 parts.

Development Magnetic Carrier

Production Examples 7 and 8

Coated carriers VII and VIII were obtained in the same manner as in Production Example 1 except that the ammonia was added under different conditions.

Development Magnetic Carrier

Production Example 9

Coated carrier IX was obtained in the same manner as in Production Example 3 except that the carrier core was prepared using 15 parts of MnO and 85 parts of $Fe_2O_3$ and the coat material was coated in a coat weight of 3 parts.

Development Magnetic Carrier

Production Example 10

Coated carrier X was obtained in the same manner as in Production Example 1 except that the magnetite particles and hematite particles were used in amounts of 300 parts and 700 parts, respectively.

Physical properties of the coated carriers I to X thus obtained are shown in Table 1.

Charging Magnetic Particles

Production Example 1

10 parts of MgO, 10 parts of MnO and 80 parts of $Fe_2O_3$ were each made into fine particles, and thereafter water was added and mixed to effect granulation, followed by baking at 1,300° C. and then adjustment of particle size to obtain a ferrite carrier core with an average particle diameter of 28 $\mu$m (saturation magnetization: 63 $Am^2/kg$).

The ferrite core thus obtained was coated with a vinylidene fluoride/methyl methacrylate copolymer in which 2 parts of carbon black was dispersed, so as to be in a coat weight of 1 part to obtain magnetic particles a.

This magnetic particles a had a 50% average particle diameter of 28.5 $\mu$m and a volume resistivity of $6\times10^6$ $\Omega\cdot$CM.

Charging Magnetic Particles

Production Example 2

Magnetic particles b were obtained in the same manner as in Example 1 except that the ferrite core was surface-treated with a material prepared by mixing 7 parts of methyl hydrogen in 99 parts of toluene and 1 part of water, so as to be in a coat weight of 0.3 part (solid content).

Charging Magnetic Particles

Production Example 3

Magnetic particles c were obtained in the same manner as in Example 1 except that the carbon black was not used.

Charging Magnetic Particles

Production Example 4

Magnetic particles d were obtained in the same manner as in Example 1 except that the ferrite core was coated with the same copolymer but in which the carbon black was dispersed in an amount of 5 parts, so as to be in a coat weight of 2 parts.

Charging Magnetic Particles

Production Example 5

Magnetic particles e were obtained in the same manner as in Example 1 except that the conditions for granulation were changed.

Charging Magnetic Particles

Production Example 6

Magnetic particles f were obtained in the same manner as in Example 1 except that the ferrite core was pulverized using a jet mill.

TABLE 1

| | Volume resistivity ($\Omega\cdot$cm) | Impedance ($\Omega\cdot$cm) | 50% average particle diameter ($\mu$m) | Magnetic properties: Saturation magnetization ($Am^2/kg$) | Magnetic properties: Coercive force (oersted) |
|---|---|---|---|---|---|
| Coated carrier I | $4\times10^{13}$ | $2\times10^{10}$ | 33.2 | 38 | 10 |
| Coated carrier II | $9\times10^{11}$ | $4\times10^{8}$ | 34.3 | 59 | 13 |
| Coated carrier III | $6\times10^{4}$ | $5\times10^{4}$ | 36.0 | 67 | 0 |
| Coated carrier IV | $2\times10^{12}$ | $7\times10^{9}$ | 35.4 | 55 | 7 |
| Coated carrier V | $5\times10^{14}$ | $5\times10^{10}$ | 33.5 | 38 | 10 |
| Coated carrier VI | $3\times10^{15}$ | $5\times10^{11}$ | 37.2 | 38 | 10 |
| Coated carrier VII | $7\times10^{13}$ | $4\times10^{10}$ | 55.4 | 38 | 8 |
| Coated carrier VIII | $1\times10^{13}$ | $1\times10^{10}$ | 17.5 | 38 | 10 |
| Coated carrier IX | $2\times10^{13}$ | $2\times10^{8}$ | 32.3 | 72 | 13 |
| Coated carrier X | $3\times10^{14}$ | $8\times10^{10}$ | 35.6 | 18 | 5 |

Physical properties of the magnetic particles a to f thus obtained are shown in Table 2.

TABLE 2

| | Volume resistivity (Ω · cm) | Weight average particle diameter (μm) |
|---|---|---|
| Magnetic particles a | $6 \times 10^6$ | 28.5 |
| Magnetic particles b | $3 \times 10^7$ | 28.2 |
| Magnetic particles c | $8 \times 10^{10}$ | 28.4 |
| Magnetic particles d | $7 \times 10^3$ | 29.1 |
| Magnetic particles e | $9 \times 10^6$ | 49.5 |
| Magnetic particles f | $2 \times 10^6$ | 4.5 |

Photosensitive Member

Production Example 1

The photosensitive member was a photosensitive member making use of an organic photoconductive material for negative charging. On an aluminum cylinder of 30 mm diameter, five functional layers were formed as first to fifth layers.

The first layer is a conductive-particle dispersed resin layer of about 20 μm thick, provided in order to level any defects on the aluminum cylinder and also prevent moires from being caused by the reflection of laser exposure light.

The second layer is a positive charge injection preventive layer (subbing layer), which is a medium resistance layer of about 1 μm thick, having the function to prevent the positive charges injected from the aluminum substrate, from cancelling the negative charges produced on the photosensitive member surface by charging, and having been adjusted to have a resistivity of about $10^6$ Ω·cm using 6-66-610-12 nylon and methoxymethylated nylon.

The third layer is a charge generation layer, which is a layer of about 0.3 μm thick, formed of a resin with a disazo pigment dispersed therein and generates positive and negative charge pairs upon exposure to laser light.

The fourth layer is a charge transport layer, which is formed of a polycarbonate resin with hydrazone particles dispersed therein and is a p-type semiconductor. Thus, the negative charges produced on the photosensitive member surface by charging can not move through this layer and only the positive charges generated in the charge generation layer can be transported to the photosensitive member surface.

The fifth layer is a charge injection layer, which is formed of a photocurable acrylic resin in which ultrafine $SnO_2$ particles and, in order to elongate the time of contact of the charging member with the photosensitive member to enable uniform charging, tetrafluoroethylene resin particles with a particle diameter of about 0.25 μm have been dispersed. Stated specifically, based on the weight of the resin, 160% by weight of oxygen-free type low-resistance $SnO_2$ particles with a particle diameter of about 0.03 μm and also 30% by weight of the tetrafluoroethylene resin particles and 1.2% by weight of a dispersant are dispersed.

The volume resistivity of the surface layer of photosensitive member 1 thus obtained was as low as $5\times10^{11}$ Ω·cm, compared with that of the charge transport layer alone which was $5\times10^{15}$ Ω·cm.

Photosensitive Member

Production Example 2

Photosensitive member 2 was produced in the same manner as in Photosensitive Member Production Example 1 except that the fifth layer thereof was formed using a material in which 300% by weight of oxygen-free type low-resistance $SnO_2$ particles with a particle diameter of about 0.03 μm were dispersed in a photocurable acrylic resin.

As a result, the volume resistivity of the photosensitive member surface layer was as low as $4\times10^7$ Ω·cm.

Photosensitive Member

Production Example 3

Photosensitive member 3 having a surface layer with a volume resistivity of $5\times10^{15}$ Ω·cm was produced in the same manner as in Photosensitive Member Production Example 1 except that the $SnO_2$ particles were not used.

Photosensitive Member

Production Example 4

Photosensitive member 4 having a surface layer with a volume resistivity of $2\times10^{13}$ Ω·cm was produced in the same manner as in Photosensitive Member Production Example 1 except that the $SnO_2$ particles were used in an amount of 100 parts.

Photosensitive Member

Production Example 5

Photosensitive member 5 was produced in the same manner as in Photosensitive Member Production Example 1 except that the same five-layer functional layers were formed on an aluminum cylinder of 80 mm diameter.

Cyan Toner Production Example 1

In 710 g of ion-exchanged water, 450 g of an aqueous 0.1M $Na_3PO_4$ solution was introduced, followed by heating to 60° C. and then stirring at 12,000 rpm using a TK-type homomixer (manufactured by Tokushu Kika Kogyo Co., Ltd.). To the resultant mixture, 68 g of an aqueous 1.0M $CaCl_2$ solution was added little by little to obtain an aqueous medium containing $Ca3(PO_4)_2$.

| (Monomers) | |
|---|---|
| Styrene | 165 g |
| n-Butyl acrylate | 35 g |
| (Colorant) | 15 g |
| C.I.Pigment Blue 15:3 | |
| (Charge control agent) | 3 g |
| Salicylic acid metal compound | |
| (Polar resin) | 10 g |
| Saturated polyester resin | |
| (Release agent) | 50 g |
| Ester wax (m.p.: 70° C.) | |

Materials formulated as above were heated to 60° C., followed by uniform dissolution and dispersion at 12,000 rpm using a TK-type homomixer (manufactured by Tokushu Kika Kogyo Co., Ltd.). In the mixture obtained, 10 g of a polymerization initiator 2,2'-azobis(2,4-dimethylvaleronitrile) was dissolved. Thus, a polymerizable monomer composition was prepared.

The above polymerizable monomer composition was introduced in the above aqueous medium, followed by stirring at 60° C. in an atmosphere of nitrogen, using the TK homomixer at 10,000 rpm for 10 minutes to granulate the polymerizable monomer composition. Thereafter, its temperature was raised to 80° C. while stirring with a paddle agitating blade, and the reaction was carried out for 10 hours. After the polymerization was completed, residual monomers were evaporated off under reduced pressure, the reaction system was cooled, and thereafter hydrochloric acid was added thereto to dissolve the calcium phosphate, followed by filtration, washing with water and then drying to obtain sharp blue suspension particles (cyan toner particles) with a weight average particle diameter of 5.5 μm. The cyan toner particles had shape factors of SF-1 of 105 and SF-2 of 113.

Based on 100 parts of the cyan toner particles thus obtained, 2.0 parts of anatase type hydrophobic fine titanium oxide powder 1 (volume resistivity: $7\times10^9$ Ω·cm; hydrophobicity: 65%) with a weight average particle diameter of 0.05 μm, having been treated with 10 parts of isobutyltrimethoxysilane in an aqueous medium, was externally added to obtain cyan toner 1 with a weight average particle diameter of 5.5 μm.

Cyan Toner Production Example 2

Polyester resin obtained by condensation of

| Cyan Toner Production Example 2 | |
|---|---|
| Polyester resin obtained by condensation of propoxylated bisphenol and fumaric acid | 100 parts |
| Phthalocyanine pigment | 4 parts |
| Aluminum compound of di-tert-butylsalicylic acid | 4 parts |
| Low-molecular weight polypropylene | 4 parts |

The above materials were thoroughly premixed using a Henschel mixer, and then melt-kneaded using a twin-screw extruder. After cooled, the kneaded product was crushed using a hammer mill to give coarse particles of about 1 to 2 mm in diameter, which were then finely pulverized using a fine grinding mill of an air-jet system. The finely pulverized product thus obtained was further classified and thereafter treated by mechanical impact to make spherical. Thus, a blue powder (cyan toner particles) with a weight average particle diameter of 5.8 μm was obtained. The cyan toner particles had shape factors of SF-1 of 133 and SF-2 of 121.

100 parts by weight of the above cyan toner particles and 1.5 parts of anatase type hydrophobic fine titanium oxide powder 2 (volume resistivity: $3\times10^{10}$ Ω·cm) with a weight average particle diameter of 0.05 μm and a hydrophobicity of 55%, having been treated with 20 parts of $n—C_4H_9—Si—(OCH_3)_3$ based on 100 parts of hydrophilic anatase type fine titanium oxide powder in an aqueous medium, were mixed using a Henschel mixer to obtain cyan toner 2 with a weight average particle diameter of 5.8 μm.

Cyan Toner Production Example 3

Cyan toner 3 with a weight average particle diameter of 5.5 μm was obtained in the same manner as in Cyan Toner Production Example 1 except that the anatase type fine titanium oxide powder 1 used therein was replaced with fine silica particles 3 (weight average particle diameter: 0.04 μm; hydrophobicity: 80%; volume resistivity: $4\times10^{14}$ Ω·cm) having been treated with 10 parts of dimethyldichlorosilane.

Cyan Toner Production Example 4

Cyan toner 4 with a weight average particle diameter of 5.6 μm was obtained in the same manner as in Cyan Toner Production Example 1 except that the anatase type fine titanium oxide powder 1 used therein was replaced with conductive fine titanium oxide particles 4 (weight average particle diameter: 0.15 μm; hydrophobicity: 50%; volume resistivity: $4\times10^3$ Ω·cm) having been treated with 10 parts of isobutyltrimethoxysilane.

Cyan Toner Production Example 5

Cyan toner 5 with a weight average particle diameter of 5.5 μm was obtained in the same manner as in Cyan Toner Production Example 1 except that as the external additive used therein 1% by weight of the anatase type fine titanium oxide powder 1 and 1% by weight of fine silica particles 5 with a weight average particle diameter of 0.05 μm, a hydrophobicity of 90% and a volume resistivity of $2\times10^{14}$ Ω·cm, having been treated with 10 parts of hexamethyldisilazane, were used in combination.

Cyan Toner Production Example 6

Cyan toner 6 with a weight average particle diameter of 5.5 μm was obtained in the same manner as in Cyan Toner Production Example 1 except that the anatase type fine titanium oxide powder 1 used therein was replaced with rutile type fine titanium oxide particles 6 with a weight average particle diameter of 0.05 μm, a hydrophobicity of 50% and a volume resistivity of $8\times10^{13}$ Ω·cm.

Cyan Toner Production Example 7

Cyan toner 7 with a weight average particle diameter of 5.5 μm was obtained in the same manner as in Cyan Toner Production Example 1 except that the anatase type fine titanium oxide powder 1 used therein was replaced with nickel plated fine styrene/methyl methacrylate resin particles 7 with a weight average particle diameter of 0.05 μm and a volume resistivity of $3\times10^{10}$ Ω·cm.

Cyan Toner Production Example 8

Cyan toner 8 with a weight average particle diameter of 6.1 μm was obtained in the same manner as in Cyan Toner Production Example 2 except that the finely pulverized product was not treated to make spherical.

Cyan Toner Production Example 9

Cyan toner 9 with a weight average particle diameter of 5.6 μm was obtained in the same manner as in Cyan Toner Production Example 6 except that the anatase type fine titanium oxide powder 1 used therein was replaced with coalesced anatase type fine titanium oxide particles 8 with a weight average particle diameter of 0.5 μm.

Cyan Toner Production Example 10

Cyan toner 10 with a weight average particle diameter of 5.5 μm was obtained in the same manner as in Cyan Toner Production Example 2 except that the hydrophilic anatase type fine titanium oxide powder used therein was replaced with fine titanium oxide particles 9 pulverized using the jet mill until the particles came to have a weight average particle diameter of 0.95 μm followed by treatment.

Yellow Toner Production Example

Yellow toner particles were obtained in the same manner as in Cyan Toner Production Example 1 and yellow toner 1 was obtained also in the same manner except that the phthalocyanine pigment used therein was replaced with C.I. Pigment Yellow 17.

Magenta Toner Production Example

Magenta toner particles were obtained in the same manner as in Cyan Toner Production Example 1 and magenta toner 1 was obtained also in the same manner except that the phthalocyanine pigment used therein was replaced with a quinacridone pigment.

Black Toner Production Example

Black toner particles were obtained in the same manner as in Cyan Toner Production Example 1 and black toner 1 was obtained also in the same manner except that the phthalocyanine pigment used therein was replaced with carbon black.

Constitution and physical properties of the respective toners thus obtained are shown in Table 3.

TABLE 3

| | Weight average particle diameter | Toner particles shape factor | | External additive | | | |
|---|---|---|---|---|---|---|---|
| | | | | External additive, No. | Volume resistivity | Weight average particle diameter | Hydrophobicity |
| | (μm) | SF-1 | SF-2 | | (Ω · cm) | (μm) | (%) |
| Cyan toner 1 | 5.5 | 105 | 113 | Anatase type hydrophobic fine Ti oxide powder 1 | $7 \times 10^9$ | 0.05 | 65 |
| Cyan toner 2 | 5.8 | 133 | 121 | Anatase type hydrophobic fine Ti oxide powder 2 | $3 \times 10^{10}$ | 0.05 | 55 |
| Cyan toner 3 | 5.5 | 105 | 113 | Fine silica powder 3 | $4 \times 10^{14}$ | 0.04 | 80 |
| Cyan toner 4 | 5.6 | 105 | 113 | Conductive fine Ti oxide powder 4 | $4 \times 10^3$ | 0.15 | 50 |
| Cyan toner 5 | 5.5 | 105 | 113 | Anatase type hydrophobic fine Ti oxide powder 1 | $7 \times 10^9$ | 0.05 | 65 |
| | | | | Fine silica powder 5 | $2 \times 10^{14}$ | 0.05 | 90 |
| Cyan toner 6 | 5.5 | 105 | 113 | Rutile type fine Ti oxide powder 6 | $8 \times 10^{13}$ | 0.05 | 50 |
| Cyan toner 7 | 5.5 | 105 | 113 | Fin resin particles 7 | $3 \times 10^{10}$ | 0.05 | — |
| Cyan toner 8 | 6.1 | 141 | 158 | Anatase type hydrophobic fine Ti oxide powder 1 | $3 \times 10^{10}$ | 0.05 | 55 |
| Cyan toner 9 | 5.6 | 105 | 113 | Anatase type hydrophobic fine Ti oxide powder 8 | $1 \times 10^{10}$ | 0.50 | 70 |
| Cyan toner 10 | 5.5 | 105 | 113 | Anatase type hydrophobic fine Ti oxide powder 9 | $4 \times 10^9$ | 0.018 | 70 |
| Yellow toner 1 | 5.6 | 109 | 115 | Anatase type hydrophobic fine Ti oxide powder 1 | $7 \times 10^9$ | 0.05 | 65 |
| Magenta toner 1 | 5.4 | 106 | 114 | Anatase type hydrophobic fine Ti oxide powder 1 | $7 \times 10^9$ | 0.05 | 65 |
| Black toner 1 | 5.5 | 106 | 113 | Anatase type hydrophobic fine Ti oxide powder 1 | $7 \times 10^9$ | 0.05 | 65 |

Example 1

The cyan toner 1 and the coated carrier I were blended in a toner concentration of 8% by weight to produce two component type cyan developer 1.

Next, the developing assembly of a commercially available copying machine GP55 (manufactured by CANON INC.) was modified as shown in FIG. 1. As the developing sleeve, a SUS stainless steel sleeve of 16 mm diameter was used which had been treated by sandblasting to adjust its surface shape to Ra=1.8 and Sm=25.1. As the charging member, the magnetic-brush charging assembly shown in FIG. 5 was used, where the magnetic particles a were used, and was rotated at 120% in the counter direction to the photosensitive member. DC/ AC electric fields (−700 V, 1 kHz/1.2 kvpp) were superimposingly applied to electrostatically charge the photosensitive member 1. The cleaning unit was detached, and the development contrast and reversal contrast to fog were set at 250 V and −150 V, respectively. A development bias having the discontinuous AC electric field as shown in FIG. 3 was applied, and images were reproduced using the above two component type cyan developer 1 in an environment of 23° C./65%RH. An original having an image area percentage of 10% was also continuously copied on 10,000 sheets. Results obtained were as shown in Table 4.

As can be seen from Table 4, the image forming means described above can achieve a good image quality, may cause only a small change in images caused by continuous copying and also has no problem on toner scatter, showing very good results.

The relation of volume resistivities in the present Example 1 was as follows:

$$B\ (6\times10^6\ \Omega\cdot cm) < C\ (7\times10^8\ \Omega\cdot cm) < A\ (5\times10^{11}\ \Omega\cdot cm) < D1\ (4\times10^{13}\ \Omega\cdot cm).$$

Comparative Example 1

Images were reproduced in the same manner as in Example 1 except that the photosensitive member was replaced with the photosensitive member 2. As a result, image density lowered and blurred images were formed. This is considered due to the volume resistivity of the photosensitive member surface layer, which was too low for the latent image charges to be well retained.

The relation of volume resistivities in the present Comparative Example 1 was as follows:

$$B\ (6\times10^6\ \Omega\cdot cm) < A\ (4\times10^7\ \Omega\cdot cm) < C\ (7\times10^8\ \Omega\cdot cm) < D1\ (4\times10^{13}\ \Omega\cdot cm).$$

Comparative Example 2

Images were reproduced in the same manner as in Example 1 except that the photosensitive member used therein was replaced with the photosensitive member 3. As a result, fog control was poor, and image ghost occurred periodically with the rotation of the photosensitive member. This is considered due to the volume resistivity of the photosensitive member surface layer, which was too high to be charged sufficiently by injection.

The relation of volume resistivities in the present Comparative Example 2 was as follows:

B ($6\times10^{6}$ Ω·cm)<C ($7\times10^{8}$ Ω·cm)<D1 ($4\times10^{13}$ Ω·cm)<A ($5\times10^{15}$ Ω·cm).

Example 2

Images were reproduced in the same manner as in Example 1 except that the magnetic particles, development magnetic carrier and cyan toner used therein were replaced with the magnetic particles b, the development magnetic carrier II and the cyan toner 2, respectively. As a result, the same good results as those in Example 1 were obtained until 20,000 sheet copying, thus the running performance was found to be superior to Example 1. This is presumed due to the magnetic particles treated with a different agent.

The relation of volume resistivities in the present Example 2 was as follows:

B ($3\times10^{7}$ Ω·cm)<C ($3\times10^{10}$ Ω·cm)<A ($5\times10^{11}$ Ω·cm)<D1 ($9\times10^{11}$ Ω·cm).

Comparative Example 3

Images were reproduced in the same manner as in Example 1 except that the development magnetic carrier used therein was replaced with the development magnetic carrier III. As a result, fog control was poor and also image density decreased. This is presumably because charges were injected into the photosensitive member surface through the development carrier in the developing zone to disturb latent images.

The relation of volume resistivities in the present Comparative Example 3 was as follows:

D1 ($6\times10^{4}$ Ω·cm)<B ($6\times10^{6}$ Ω·cm)<C ($7\times10^{8}$ Ω·cm)<A ($5\times10^{11}$ Ω·cm).

Comparative Example 4

Images were reproduced in the same manner as in Example 1 except that the magnetic particles of the magnetic-brush charging assembly was replaced with the magnetic particles c. As a result, fog control was poor, and image ghost occurred periodically with the rotation of the photosensitive member. This is considered due to the volume resistivity of the charging member, which was too high to be sufficiently charged by injection.

The relation of volume resistivities in the present Comparative Example 4 was as follows:

C ($7\times10^{8}$ Ω·cm)<D1 ($8\times10^{10}$ Ω·cm)<A ($5\times10^{11}$ Ω·cm)<B ($4\times10^{13}$ Ω·cm).

Comparative Example 5

Images were reproduced in the same manner as in Example 1 except that the magnetic particles of the magnetic-brush charging assembly was replaced with the magnetic particles d. As a result, good results were obtained at the initial stage, but fog began to be conspicuous after about 5,000 sheet copying, and image density began to decrease. This is considered due to the volume resistivity of the charging member, which was so low that the charging magnetic particles adhered to the photosensitive member surface and in that state were held and accumulated on the developer carrying member, resulting in disorder of latent images in the developing zone to cause image deterioration.

The relation of volume resistivities in the present Comparative Example 5 was as follows:

B ($7\times10^{3}$ Ω·cm)<C ($7\times10^{8}$ Ω·cm)<A ($5\times10^{11}$ Ω·cm)<D1 ($4\times10^{13}$ Ω·cm).

Comparative Example 6

Images were reproduced in the same manner as in Example 1 except that the cyan toner used therein was replaced with the cyan toner 3. As a result, good results were obtained at the initial stage, but fog began to be conspicuous after about 5,000 sheet copying, and image ghost occurred periodically with the rotation of the photosensitive member. This is considered due to the relation of volume resistivities in which, as shown below, the volume resistivity C of the external additive fine silica particles was larger than the volume resistivity A of the photosensitive member surface layer and hence the silica remaining after transfer was taken into the charging member, so that the charging performance was inhibited.

The relation of volume resistivities in the present Comparative Example 6 was as follows:

B ($6\times10^{6}$ Ω·cm)<A ($5\times10^{11}$ Ω·cm)<D1 ($4\times10^{13}$ Ω·cm)<C ($7\times10^{14}$ Ω·cm).

Comparative Example 7

Images were reproduced in the same manner as in Example 1 except that the cyan toner used therein was replaced with the cyan toner 4. As a result, fog much occurred and also image density decreased. This is presumed due to the volume resistivity of the external additive conductive fine titanium powder 4, which was so low that latent images were disturbed in the developing zone.

The relation of volume resistivities in the present Comparative Example 7 was as follows:

C ($4\times10^{3}$ Ω·cm)<B ($6\times10^{6}$ Ω·cm)<A ($5\times10^{11}$ Ω·cm)<D1 ($4\times10^{13}$ Ω·cm).

Example 3

Images were reproduced in the same manner as in Example 1 except that the development magnetic carrier used therein was replaced with the development magnetic carrier IV. As a result, as shown in Table 1, good results were obtained.

The relation of volume resistivities in the present Example 3 was as follows:

B ($6\times10^{6}$ Ω·cm)<C ($7\times10^{8}$ Ω·cm)<A ($5\times10^{11}$ Ω·cm)<D1 ($9\times10^{12}$ Ω·cm).

Example 4

Images were reproduced in the same manner as in Example 1 except that the development magnetic carrier used therein was replaced with the development magnetic carrier V. As a result, as shown in Table 1, good results were obtained.

The relation of volume resistivities in the present Example 4 was as follows:

B ($6\times10^{6}$ Ω·cm)<C ($7\times10^{8}$ Ω·cm)<A ($5\times10^{11}$ Ω·cm)<D1 ($5\times10^{14}$ Ω·cm).

Example 5

Images were reproduced in the same manner as in Example 1 except that the photosensitive member used therein was replaced with the photosensitive member 4. As a result, as shown in Table 1, good results were obtained although fog slightly occurred. This is considered due to the volume resistivity of the photosensitive member surface layer, which was higher to slightly lower injection charging performance.

The relation of volume resistivities in the present Example 5 was as follows:

B ($6\times10^{6}$ Ω·cm)<C ($7\times10^{8}$ Ω·cm)<A ($2\times10^{13}$ Ω·cm)<D1 ($4\times10^{13}$ Ω·cm).

Example 6

Images were reproduced in the same manner as in Example 1 except that the magnetic-brush charging assembly making use of the magnetic particles a was replaced with a conductive fiber brush charger using a conductive Rayon brush e having a volume resistivity of $9\times10^{5}$ Ω·cm. As a result, good results were obtained although fog slightly occurred after 10,000 sheet copying. This is considered due to the conductive Rayon brush, whose condition of rubbing friction against the photosensitive member slightly changed as a result of continuous service.

The relation of volume resistivities in the present Example 6 was as follows:

B ($9\times10^{5}$ Ω·cm)<C ($7\times10^{8}$ Ω·cm)<A ($5\times10^{11}$ Ω·cm)<D1 ($4\times10^{13}$ Ω·cm).

Example 7

Images were reproduced in the same manner as in Example 1 except that the cyan toner used therein was replaced with the cyan toner 5. As a result, good results were obtained at the initial stage, but fog slightly occurred after 10,000 sheet copying. This is considered due to the high-resistance silica fine particles 5 used as the external additive in combination, where the silica fine particles taken into the charging member slightly inhibited the injection charging performance, though slight as compared with Comparative Examples in which silica was used alone.

Comparative Example 8

Images were reproduced in the same manner as in Example 1 except that the cyan toner used therein was replaced with the cyan toner 6. As a result, good results were obtained at the initial stage, but fog began to be conspicuous after about 5,000 sheet copying. This is presumed to be, like Comparative Example 6, due to the titanium oxide replaced with the one having a crystal form of the rutile type, which caused an increase in the volume resistivity of the external additive.

The relation of volume resistivities in the present Comparative Example 8 was as follows:

B ($6\times10^{6}$ Ω·cm)<A ($5\times10^{11}$ Ω·cm)<D1 ($4\times10^{13}$ Ω·cm)<C ($8\times10^{13}$ Ω·cm).

Example 8

Images were reproduced in the same manner as in Example 1 except that the cyan toner used therein was replaced with the cyan toner 7. As a result, good results were obtained at the initial stage, but image density slightly decreased after 10,000 sheet copying, and also solid image uniformity slightly lowered. This is presumed due to the external additive which was resin particles, and resulted in a slight lowering of fluidity of toner.

The relation of volume resistivities in the present Example 8 was as follows:

B ($6\times10^{6}$ Ω·cm)<C ($3\times10^{10}$ Ω·cm)<A ($5\times10^{11}$ Ω·cm)<D1 ($4\times10^{13}$ Ω·cm).

Comparative Example 9

Images were reproduced in the same manner as in Example 1 except that the development magnetic carrier used therein was replaced with the development magnetic carrier VI. As a result, fog began to be conspicuous after about 5,000 sheet copying. This is presumed due to the volume resistivity of the development magnetic carrier, which was too high to provide a sufficient charge build of the toner supplied.

The relation of volume resistivities in the present Comparative Example 9 was as follows:

B ($6\times10^{6}$ Ω·cm)<C ($7\times10^{8}$ Ω·cm)<A ($5\times10^{11}$ Ω·cm)<D1 ($3\times10^{15}$ Ω·cm).

Example 9

Images were reproduced in the same manner as in Example 1 except that the development magnetic carrier used therein was replaced with the development magnetic carrier VII. As a result, toner scatter began to be slightly conspicuous after about 7,000 sheet copying, but no problem in practical use. This is presumed due to the particle diameter of the carrier, which was so large that its ability to hold toner lowered.

The relation of volume resistivities in the present Example 9 was as follows:

B ($6\times10^{6}$ Ω·cm)<C ($7\times10^{8}$ Ω·cm)<A ($5\times10^{11}$ Ω·cm)<D1 ($7\times10^{13}$ Ω·cm).

Example 10

Images were reproduced in the same manner as in Example 1 except that the development magnetic carrier used therein was replaced with the development magnetic carrier VIII. As a result, a gradient of image density was slightly seen at the front side and rear side of images after about 3,000 sheet copying, but no problem in practical use. This is presumed to be due to the particle diameter of the carrier, which was so small that its developer transport performance was slightly unstable.

The relation of volume resistivities in the present Example 10 was as follows:

B ($6\times10^{6}$ Ω·cm)<C ($7\times10^{8}$ Ω·cm)<A ($5\times10^{11}$ Ω·cm)<D1 ($1\times10^{13}$ Ω·cm).

Example 11

Images were reproduced in the same manner as in Example 1 except that the development magnetic carrier used therein was replaced with the development magnetic carrier IX. As a result, image density slightly decreased after about 7,000 sheet copying, but no problem in practical use. This is presumed due to the magnetic properties of the carrier, which were so high that the developer deteriorated slightly earlier.

The relation of volume resistivities in the present Example 11 was as follows:

B ($6\times10^{6}$ Ω·cm)<C ($7\times10^{8}$ Ω·cm)<A ($5\times10^{11}$ Ω·cm)<D1 ($2\times10^{13}$ Ω·cm).

Example 12

Images were reproduced in the same manner as in Example 1 except that the development magnetic carrier used therein was replaced with the development magnetic carrier X. As a result, a gradient of image density was slightly seen at the front end and rear end of images after about 3,000 sheet copying, but no problem in practical use. This is presumed to be due to the magnetic properties of the carrier, which were so small that the developer coating performance slightly lowered.

The relation of volume resistivities in the present Example 12 was as follows:

B ($6\times10^6$ Ω·cm)<C ($7\times10^8$ Ω·cm)<A ($5\times10^{11}$ Ω·cm)<D1 ($3\times10^{14}$ Ω·cm).

Example 13

Images were reproduced in the same manner as in Example 1 except that the magnetic particles a of the magnetic-brush charging assembly was replaced with the magnetic particles e. As a result, fog came to be slightly seen after about 5,000 sheet copying, but no problem in practical use. This is presumed due to the particle diameter of the magnetic particles, which was so large that the charging performance lowered to reduce the potential contrast for inhibiting fogging (the difference between the potential at the non-image area of the latent image bearing member and the potential of the DC component of the development bias applied at the time of development).

The relation of volume resistivities in the present Example 13 was as follows:

B ($9\times10^6$ Ω·cm)<C ($7\times10^8$ Ω·cm)<A ($5\times10^{11}$ Ω·cm)<D1 ($4\times10^{13}$ Ω·cm).

Example 14

Images were reproduced in the same manner as in Example 1 except that the magnetic particles a of the magnetic-brush charging assembly was replaced with the magnetic particles f. As a result, fog came to be slightly seen after about 3,000 sheet copying, but no problem in practical use. This is presumed due to the particle diameter of the magnetic particles, which was so small that the magnetic particles moved up to the developing zone to disturb latent images.

The relation of volume resistivities in the present Example 14 was as follows:

B ($2\times10^6$ Ω·cm)<C ($7\times10^8$ Ω·cm)<A ($5\times10^{11}$ Ω·cm)<D1 ($4\times10^{13}$ Ω·cm).

Example 15

Images were reproduced in the same manner as in Example 1 except that the cyan toner used therein was replaced with the cyan toner 8. As a result, fog came to be slightly seen after about 3,000 sheet copying, but no problem in practical use. This is presumed due to the shape of toner particles, which was so amorphous that transfer residual toner increased to disturb latent images.

The relation of volume resistivities in the present Example 15 was as follows:

B ($6\times10^6$ Ω·cm)<C ($7\times10^8$ Ω·cm)<A ($5\times10^{11}$ Ω·cm)<D1 ($4\times10^{13}$ Ω·cm).

Example 16

Images were reproduced in the same manner as in Example 1 except that the cyan toner used therein was replaced with the cyan toner 9. As a result, good results were obtained although image density slightly decreased from the beginning. This is presumed due to the particle diameter of the external additive, which was so large that the developing performance lowered.

The relation of volume resistivities in the present Example 16 was as follows:

B ($6\times10^6$ Ω·cm)<C ($1\times10^{10}$ Ω·cm)<A ($5\times10^{11}$ Ω·cm)<D1 ($4\times10^{13}$ Ω·cm).

Example 17

Images were reproduced in the same manner as in Example 1 except that the cyan toner used therein was replaced with the cyan toner 10. As a result, very good results were obtained at the initial stage, but fog came to be slightly seen after about 8,000 sheet copying, but no problem in practical use. This is presumed due to the particle diameter of the external additive, which was so small that they buried in the toner particle surfaces earlier.

The relation of volume resistivities in the present Example 17 was as follows:

B ($6\times10^6$ Ω·cm)<C ($4\times10^9$ Ω·cm)<A ($5\times10^{11}$ Ω·cm)<D1 ($4\times10^{13}$ Ω·cm).

Results of evaluation on the above Examples 1 to 17 and Comparative Examples 1 to 9 are shown in Tables 4 and 5.

TABLE 4

| | Photosensitive member No. (resistivity) | Charging member No. (resistivity) | Development carrier No. (resistivity) | Toner No. (resistivity of external additive) | Image density (initial stage/ after 10,000 sh.) | Fog | *1 (1) | *2 (2) |
|---|---|---|---|---|---|---|---|---|
| Example: | | | | | | | | |
| 1 | 1 ($5\times10^{11}$ Ω · cm) | a ($6\times10^6$ Ω · cm) | I ($4\times10^{13}$ Ω · cm) | 1 ($7\times10^9$ Ω · cm) | 1.4–1.5 | 0.2–0.7% | 1 | 1 |
| | | | | | 1.4–1.5 | 0.4–1.0% | 1 | 1 |
| Comparative Example: | | | | | | | | |
| 1 | 2 ($4\times10^7$ Ω · cm) | a | I | 1 | 0.8–1.1 | 1.3–1.8% | 4 | 1 |
| | | | | | 1.0–1.2 | 1.8–2.3% | 4 | 1 |
| 2 | 3 ($5\times10^{15}$ Ω · cm) | a | I | 1 | 1.4–1.6 | 1.8–2.5% | 3 | 1 |
| | | | | | 1.4–1.5 | 2.3–3.1% | 4 | 1 |

TABLE 4-continued

| | Photosensitive member No. (resistivity) | Charging member No. (resistivity) | Development carrier No. (resistivity) | Toner No. (resistivity of external additive) | Image density (initial stage/ after 10,000 sh.) | Fog | *1 (1) | *2 (2) |
|---|---|---|---|---|---|---|---|---|
| Example: | | | | | | | | |
| 2 | 1 | b ($3 \times 10^7$ Ω · cm) | II ($9 \times 10^{11}$ Ω · cm) | 2 ($3 \times 10^{10}$ Ω · cm) | 1.4–1.5 | 0.4–0.8% | 1 | 1 |
| | | | | | 1.5–1.6 | 0.6–1.5% | 2 | 1 |
| Comparative Example: | | | | | | | | |
| 3 | 1 | a | III ($6 \times 10^4$ Ω · cm) | 1 | 0.8–1.0 | 1.6–2.0% | 3 | 1 |
| | | | | | 0.7–0.9 | 2.1–3.0% | 4 | 3 |
| 4 | 1 | c ($8 \times 10^{10}$ Ω · cm) | I | 1 | 1.2–1.5 | 1.6–2.3% | 3 | 1 |
| | | | | | 1.1–1.5 | 1.9–3.0% | 4 | 2 |
| 5 | 1 | d ($7 \times 10^3$ Ω · cm) | I | 1 | 1.4–1.5 | 0.4–1.0% | 2 | 1 |
| | | | | | 1.3–1.6 | 1.7–2.4% | 4 | 2 |
| 6 | 1 | a | I | 3 ($4 \times 10^{14}$ Ω · cm) | 1.4–1.5 | 0.5–1.0% | 2 | 1 |
| | | | | | 1.3–1.6 | 1.5–2.3% | 3 | 1 |
| 7 | 1 | a | I | 4 ($4 \times 10^3$ Ω · cm) | 0.7–0.9 | 1.2–1.8% | 3 | 1 |
| | | | | | 0.7–1.1 | 2.1–3.5% | 4 | 3 |
| Example: | | | | | | | | |
| 3 | 1 | a | IV ($2 \times 10^{12}$ Ω · cm) | 1 | 1.4–1.5 | 0.4–0.8% | 1 | 1 |
| | | | | | 1.4–1.6 | 0.7–1.2% | 2 | 2 |
| 4 | 1 | a | V ($5 \times 10^{14}$ Ω · cm) | 1 | 1.4–1.5 | 0.2–0.8% | 1 | 1 |
| | | | | | 1.4–1.6 | 0.5–1.1% | 2 | 2 |
| 5 | 4 ($6 \times 10^6$ Ω · cm) | a | I | 1 | 1.4–1.6 | 0.7–1.0% | 2 | 1 |
| | | | | | 1.4–1.6 | 1.0–1.5% | 2 | 2 |
| 6 | 1 | e ($9 \times 10^5$ Ω · cm) | I | 1 | 1.4–1.5 | 0.3–0.8% | 1 | 1 |
| | | | | | 1.4–1.6 | 1.0–1.3% | 2 | 2 |
| 7 | 1 | a | I | 5 ($7 \times 10^8$ Ω · cm | 1.4–1.5 | 0.2–0.6% | 1 | 1 |
| | | | | & $2 \times 10^{14}$ Ω · cm) | 1.4–1.5 | 0.6–1.2% | 2 | 1 |
| Comparative Example: | | | | | | | | |
| 8 | 1 | a | I | 6 ($8 \times 10^{13}$ Ω · cm) | 1.4–1.5 | 0.4–0.8% | 2 | 1 |
| | | | | | 1.3–1.5 | 1.4–2.0% | 3 | 2 |
| Example: | | | | | | | | |
| 8 | 1 | a | I | 7 ($3 \times 10^{10}$ Ω · cm) | 1.4–1.5 | 0.4–0.7% | 2 | 1 |
| | | | | | 1.3–1.4 | 0.8–1.2% | 2 | 3 |

(1): Solid image uniformity (initial stage/after 10,000 sheets)
(2): Toner scatter (initial stage/after 10,000 sheets)

TABLE 5

| | Photo-sensitive member No. (resistivity) | Charging member No. (resistivity) | Development carrier No. (resistivity) | Toner No. (resistivity of external additive) | Image density (initial stage/ after 10,000 sh.) | Fog | *1 (1) | *2 (2) |
|---|---|---|---|---|---|---|---|---|
| Comparative Example: | | | | | | | | |
| 9 | 1 | a | VI | 1 | 1.4–1.5 | 0.4–0.8% | 2 | 2 |
| | | | | | 1.1–1.5 | 1.8–2.5% | 4 | 4 |
| Example: | | | | | | | | |
| 9 | 1 | a | VII | 1 | 1.4–1.5 | 0.3–0.7% | 1 | 1 |
| | | | | | 1.3–1.5 | 0.8–1.2% | 2 | 3 |
| 10 | 1 | a | VIII | 1 | 1.4–1.5 | 0.2–0.6% | 1 | 1 |
| | | | | | 1.3–1.5 | 0.5–0.8% | 2 | 2 |
| 11 | 1 | a | IX | 1 | 1.4–1.5 | 0.3–0.7% | 1 | 1 |
| | | | | | 1.2–1.4 | 1.0–1.3% | 3 | 2 |
| 12 | 1 | a | X | 1 | 1.4–1.5 | 0.2–0.5% | 1 | 1 |
| | | | | | 1.4–1.6 | 0.6–0.9% | 3 | 1 |
| 13 | 1 | e | I | 1 | 1.4–1.5 | 0.2–0.6% | 1 | 1 |
| | | | | | 1.4–1.5 | 0.6–1.2% | 2 | 1 |
| 14 | 1 | f | I | 1 | 1.4–1.5 | 0.2–0.6% | 1 | 1 |
| | | | | | 1.4–1.5 | 1.0–1.3% | 2 | 1 |
| 15 | 1 | a | I | 8 | 1.3–1.4 | 0.4–0.8% | 2 | 1 |
| | | | | | 1.2–1.4 | 1.0–1.3% | 2 | 2 |
| 16 | 1 | a | I | 9 | 1.3–1.4 | 0.2–0.6% | 2 | 1 |
| | | | | | 1.2–1.3 | 0.5–1.0% | 2 | 2 |

TABLE 5-continued

| | Photo-sensitive member No. (resistivity) | Charging member No. (resistivity) | Development carrier No. (resistivity) | Toner No. (resistivity of external additive) | Image density (initial stage/after 10,000 sh.) | Fog (initial stage/after 10,000 sh.) | *1 (1) | *2 (2) |
|---|---|---|---|---|---|---|---|---|
| 17 | 1 | a | I | 10 | 1.4–1.5 | 0.2–0.4% | 1 | 1 |
| | | | | | 1.4–1.5 | 0.8–1.2% | 2 | 2 |

(1): Solid image uniformity (initial stage/after 10,000 sheets)
(2): Toner scatter (initial stage/after 10,000 sheets)

In Tables 4 and 5;

*1) Solid uniformity:

Rank 1: On CLC-SK paper, five-point density difference: 0.05 or less.

Rank 2: On CLC-SK paper, five-point density difference: more than 0.05 to 0.1.

Rank 3: On CLC-SK paper, five-point density difference: more than 0.1 to 0.15.

Rank 4: On CLC-SK paper, five-point density difference: more than 0.15.

*2) Toner scatter:

Toner scatter was evaluated by examining any contamination due to toner on the outer surfaces of the upstream side toner scatter preventive part and downstream side toner scatter preventive part of the developing container and any contamination due to toner on portions other than the developing container, and according to the following evaluation criteria.

Rank 1: Not seen at all.

Rank 2: Contamination is slightly seen on the outer surface of the upstream side toner scatter preventive part of the developing container, but not seen on the outer surface of the downstream side toner scatter preventive part.

Rank 3: Contamination is seen on the outer surface of the upstream side toner scatter preventive part and the outer surface of the downstream side toner scatter preventive part of the developing container, but no contamination is seen on portions other than the developing container.

Rank 4: Contamination is seen also on portions other than the developing container.

Example 18

Figure 4:
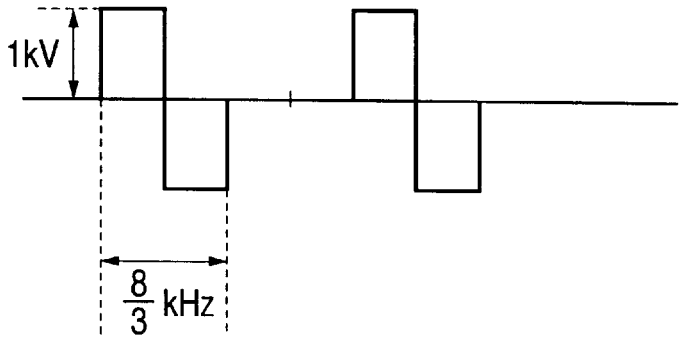
FIG. 4 shows an alternating electric field used in Example 18.

Images were reproduced in the same manner as in Example 1 except that development was performed by applying, in place of the development bias having discontinuous alternating electric field shown in FIG. 3, a development bias having the discontinuous alternating electric field shown in FIG. 4. As a result, solid image uniformity slightly lowered after about 7,000 sheet copying, but good results were obtained.

Example 19

Images were reproduced in the same manner as in Example 1 except that development was performed by applying, in place of the development bias having discontinuous alternating electric field shown in FIG. 3, a development bias having a rectangular continuous alternating electric field of 2 kHz and 2 kvpp. As a result, fog slightly occurred, but good results were obtained.

Example 20

Images were reproduced in the same manner as in Example 1 except that the developing sleeve was replaced with the one having a surface shape of Ra=5.5 $\mu$m and Sm=95 $\mu$m. As a result, highlight reproducibility slightly lowered, but good results were obtained. This is presumed due to the sleeve surface roughness, which was so large that the sleeve caused an uneven developing performance of the toner.

Example 21

Images were reproduced in the same manner as in Example 1 except that the developing sleeve was replaced with the one having a surface shape of Ra=0.18 $\mu$m and Sm=8 $\mu$m. As a result, image density slightly decreased, but good results were obtained. This is presumed due to the sleeve surface roughness, which was so small that the developer carrying performance of the sleeve lowered.

Example 22

Images were reproduced in the same manner as in Example 1 except that, using CLC500 (manufactured by CANON INC.), the developing sleeve was replaced with the one having a diameter of 24.5 mm, the photosensitive member 1 was replaced with the photosensitive member 5 and the fixing roller was replaced with a PFA tube roller. As a result, good results were obtained although the front-end/rear-end image density difference slightly occurred. This is presumed due to the drum/sleeve diameter ratio, which was so great that the developer stagnation at the developing zone came into an unstable state.

Example 23

In the same manner as the cyan two component type developer of Example 1, a yellow two component type developer, a magenta two component type developer and a black two component type developer were prepared using the yellow toner 1, the magenta toner 1 and the black toner 1, respectively. The four color two component type developers were set in the image forming apparatus constituted as shown in FIG. 6, and images were reproduced on 20,000 sheets by using as a primary charging assembly the magnetic-brush charging assembly shown in FIG. 5, without use of any cleaning unit. As a result, good full-color images were formed.

Example 24

Images were reproduced on 3,000 sheets in the same manner as in Example 1 but using a developing assembly of the non-magnetic one component type development system shown in FIG. 7, using an elastic urethane rubber sleeve provided with a silicone resin layer in which methyl methacrylate resin particles were dispersed so as to have a volume resistivity of $3\times10^{12}$ Ω·cm, and using as the blade a silicone rubber coated with polyamide resin. As a result, good results were obtained.

The relation of volume resistivities in the present Example 24 was as follows:

B ($6\times10^{6}$ Ω·cm)<C ($7\times10^{8}$ Ω·cm)<A ($5\times10^{11}$ Ω·cm)<D2 ($3\times10^{12}$ Ω·cm).

Carrier Core Production Example A 7 parts of MgO, 3 parts of CaO and 90 parts of $Fe_2O_3$ were each made into fine particles, and thereafter water was added and mixed to effect granulation, followed by baking at 1,100° C. and then adjustment of particle size to obtain carrier core A comprised of ferrite with a 50% average particle diameter of 35.3 μm (saturation magnetization: 44 $Am^2/kg$).

Carrier Core Production Example B

Ferrite carrier core B with a 50% average particle diameter of 35.8 μm (saturation magnetization: 55 $Am^2/kg$) was obtained in the same manner as in Carrier Core Production Example A except for using 15 parts of NiO, 15 parts of ZnO and 70 parts of $Fe_2O_3$.

Carrier Core Production Example C

In an aqueous medium, a phenol/formaldehyde (50:50) monomer was mixed and dispersed. Thereafter, based on the weight of the monomer, 60 parts of 0.4 μm magnetite particles surface-treated with a titanium coupling agent and 40 parts of 1.2 μm hematite particles were uniformly dispersed, and the monomer was added to produce carrier core C which was a magnetic particle-including, spherical magnetic resin carrier core (saturation magnetization: 38 $Am^2/kg$).

Carrier Core Production Example D

Carrier core D (saturation magnetization: 28 $Am^2/kg$) was obtained in the same manner as in Carrier Core Production Example C except that the magnetite particles and hematite particles were used in amounts of 40 parts and 60 parts, respectively.

Carrier Core Production Example E

Carrier core E (saturation magnetization: 59 $Am^2/kg$) was obtained in the same manner as in Carrier Core Production Example D except that the hematite particles were not used.

Carrier Production Example A 20 parts of toluene, 20 parts of butanol, 20 parts of water and 40 parts of ice were put into a four-necked flask, and 40 parts of a mixture of 15 mols of $CH_3SiCl_3$ and 10 mols of $(CH_3)_2SiCl_2$ was added thereto with stirring. After further stirring for 30 minutes, condensation reaction was carried out at 60° C. for 1 hour. Thereafter, the siloxanes were well washed with water, and then dissolved in a toluene/methyl ethyl ketone/butanol mixed solvent to produce a silicone varnish with 10% of solid content.

To the silicone varnish thus obtained, based on 100 parts of the siloxane solid content, 2.0 parts of ion-exchanged water, 2.0 parts of curing agent (2) shown below and 3.0 part of aminosilane coupling agent (8) shown below were simultaneously added to produce carrier coat solution A.

(2)

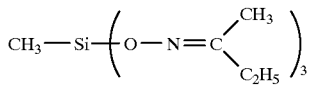

(8)

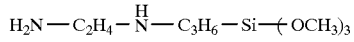

This solution A was applied on 100 parts of the carrier core A by means of a coating machine (SPIRACOATER, manufactured by Okada Seiko K.K.) so as to be in a resin coat weight of 1.0 part, to produce coated carrier A. This carrier had a 50% average particle diameter of 35.5 μm, a volume resistivity of $2\times10^{13}$ Ω·cm and an impedance of $4\times10^{8}$ Ω·cm.

Carrier Production Example B

Coated carrier B was obtained in the same manner as in Carrier Production Example A except that the carrier core A was replaced with the carrier core B.

Carrier Production Examples C to E

Coated carriers C to E were obtained in the same manner as in Carrier Production Example A except that the carrier core A was replaced with the carrier cores C to E, respectively.

Carrier Production Example F

Coated carrier F was obtained in the same manner as in Carrier Production Example A except that as the coat solution a coat solution was used which was prepared by mixing 50 parts of a styrene/2-ethylhexyl acrylate/methyl methacrylate (50:20:30) copolymer and 50 parts of a vinylidene fluoride/tetrafluoroethylene (50:50) copolymer and dissolving the resultant mixture in a toluene/methyl ethyl ketone mixed solvent.

Physical properties of the coated carriers A to F thus obtained are shown in Table 6.

TABLE 6

| | Volume resistivity (Ω ·cm) | Impedance (Ω · cm) | 50% average particle diameter (μm) | Magnetic properties: Saturation magnetization ($Am^2/kg$) | Magnetic properties: Coercive force (oersted) |
|---|---|---|---|---|---|
| Coated carrier A | $2\times10^{13}$ | $4\times10^{8}$ | 35.5 | 44 | 10 |
| Coated carrier B | $5\times10^{8}$ | $3\times10^{7}$ | 35.9 | 55 | 3 |
| Coated carrier C | $8\times10^{13}$ | $7\times10^{5}$ | 34.8 | 38 | 10 |
| Coated carrier D | $2\times10^{14}$ | $8\times10^{9}$ | 35.2 | 28 | 5 |

TABLE 6-continued

| | Volume resistivity (Ω ·cm) | Impedance (Ω · cm) | 50% average particle diameter (μm) | Magnetic properties: Saturation magnetization ($Am^2/kg$) | Magnetic properties: Coercive force (oersted) |
|---|---|---|---|---|---|
| Coated carrier E | $2 \times 10^{15}$ | $2 \times 10^{11}$ | 34.3 | 59 | 12 |
| Coated carrier F | $7 \times 10^{13}$ | $6 \times 10^{8}$ | 35.4 | 44 | 10 |

Photosensitive Member

Production Example A

The photosensitive member A was a photosensitive member making use of an organic photoconductive material for negative charging. On an aluminum cylinder of 30 mm diameter, five functional layers were formed as first to fifth layers.

The first layer of the functional layers is a conductive layer, which is a conductive-particle dispersed resin layer of about 20 μm thick, provided in order to level any defects on the aluminum cylinder and also prevent moires from being caused by the reflection of laser exposure light.

The second layer is a positive charge injection preventive layer (subbing layer), which is a medium resistance layer of about 1 μm thick, having the function to prevent the positive charges injected from the aluminum substrate, from cancelling the negative charges produced on the photosensitive member surface by charging, and having been adjusted to have a resistivity of about $10^6$ Ω·cm using 6-66-610-12-nylon and methoxymethylated nylon.

The third layer is a charge generation layer, which is a layer of about 0.3 μm thick, formed of a resin with a disazo pigment dispersed therein and generates positive and negative charge pairs upon exposure to laser light.

The fourth layer is a charge transport layer, which is formed of a polycarbonate resin with hydrazone particles dispersed therein and is a p-type semiconductor. Thus, the negative charges produced on the photosensitive member surface by charging can not move through this layer and only the positive charges generated in the charge generation layer can be transported to the photosensitive member surface.

The fifth layer is a charge injection layer, which is formed of a photocurable acrylic resin in which ultrafine $SnO_2$ particles treated with a silane coupling agent and, in order to elongate the time of contact of the charging member with the photosensitive member to enable uniform charging, tetrafluoroethylene resin particles with a particle diameter of about 0.25 μm have been dispersed. Stated specifically, based on the weight of the resin, 140% by weight of oxygen-free type low-resistance $SnO_2$ particles with a particle diameter of about 0.03 μm and also 30% by weight of the tetrafluoroethylene resin particles and 1.2% by weight of a dispersant are dispersed.

The volume resistivity of the surface layer of photosensitive member thus obtained was as low as $5\times10^{12}$ Ω·cm, compared with that of the charge transport layer alone which was $5\times10^{15}$ Ω·cm.

Photosensitive Member

Production Example B

Photosensitive member B was produced in the same manner as in Photosensitive Member Production Example A except that the fifth layer thereof was formed using a material in which 300% by weight of oxygen-free type low-resistance $SnO_2$ particles with a particle diameter of about 0.03 μm were dispersed in a photocurable acrylic resin.

As a result, the volume resistivity of the photosensitive member B surface layer was as low as $4\times10^{17}$ Ω·cm.

Photosensitive Member

Production Example C

Photosensitive member C having a surface layer with a volume resistivity of $5\times10^{15}$ Ω·cm was produced in the same manner as in Photosensitive Member Production Example A except that the $SnO_2$ particles were not added in the fifth layer.

Cyan Toner Production Example A

In 710 g of ion-exchanged water, 450 g of an aqueous 0.1M $Na_3PO_4$ solution was introduced, followed by heating to 60° C. and then stirring at 12,000 rpm using a TK-type homomixer (manufactured by Tokushu Kika Kogyo Co., Ltd.). To the resultant mixture, 68 g of an aqueous 1.0M $CaCl_2$ solution was added little by little to produce an aqueous medium containing $Ca_3(PO_4)_2$.

| (Monomers) | |
|---|---|
| Styrene | 165 g |
| n-Butyl acrylate | 35 g |
| (Colorant) | 15 g |
| C.I. Pigment Blue 15:3 | |
| (Charge control agent) | 3 g |
| Salicylic acid metal compound | |
| (Polar resin) | 10 g |
| Saturated polyester resin | |
| (Release agent) | 50 g |
| Ester wax (m.p.: 70° C.) | |

Materials formulated as above were heated to 60° C., followed by uniform dissolution and dispersion at 12,000 rpm using a TK-type homomixer (manufactured by Tokushu Kika Kogyo Co., Ltd.). In the mixture obtained, 10 g of a polymerization initiator 2,2'-azobis(2,4-dimethylvaleronitrile) was dissolved. Thus, a polymerizable monomer composition was prepared.

The above polymerizable monomer composition was introduced in the above aqueous medium, followed by stirring at 60° C. in an atmosphere of nitrogen, using the TK homomixer at 10,000 rpm for 10 minutes to granulate the polymerizable monomer composition. Thereafter, its temperature was raised to 80° C. over a period of 1 hour while stirring with a paddle agitating blade, and the reaction was carried out for 10 hours. After the polymerization was completed, residual monomers were evaporated off under reduced pressure, the reaction system was cooled, and thereafter hydrochloric acid was added thereto to dissolve the calcium phosphate, followed by filtration, washing with water and then drying to produce sharp blue suspension particles (cyan toner particles) with a weight average particle diameter of 5.5 μm. The cyan toner particles had shape factors of SF-1 of 106 and SF-2 of 112.

Based on 100 parts of the cyan toner particles thus obtained, 2.0 parts of anatase type hydrophobic fine titanium oxide powder A (weight average particle diameter: 0.05 μm; hydrophobicity: 62%; volume resistivity: 9×109 Ω·cm) having been treated with isobutyltrimethoxysilane and having a specific surface area of 100 $m^2/g$ as measured by the BET method, was externally added to produce cyan toner A with a weight average particle diameter of 5.5 μm.

Production Examples C to E

Yellow toner C, magenta toner D and black toner E were obtained in the same manner as in Cyan Toner Production Example A except that the C.I. Pigment Blue 15:3 used as the colorant was replaced with C.I. Pigment Yellow 17, a dimethyl quinacridone pigment and carbon black, respectively.

Constitution and physical properties of the respective toners thus obtained are shown in Table 7.

TABLE 7

| | Weight average particle diameter | Toner particles shape factor | | External additive | | | |
|---|---|---|---|---|---|---|---|
| | | | | | Volume resistivity | Weight average particle diameter | Hydrophobicity |
| | (μm) | SF-1 | SF-2 | External additive, No. | (Ω · cm) | (μm) | (%) |
| Cyan toner A | 5.5 | 106 | 112 | Anatase type hydrophobic fine Ti oxide powder A | $9 \times 10^9$ | 0.05 | 62 |
| Cyan toner B | 5.8 | 143 | 156 | Anatase type hydrophobic fine Ti oxide powder B | $7 \times 10^9$ | 0.05 | 55 |
| Yellow toner C | 5.5 | 107 | 113 | Anatase type hydrophobic fine Ti oxide powder A | $9 \times 10^9$ | 0.05 | 62 |
| Magenta toner D | 5.5 | 106 | 113 | Anatase type hydrophobic fine Ti oxide powder A | $9 \times 10^9$ | 0.05 | 62 |
| Black toner E | 5.5 | 108 | 116 | Anatase type hydrophobic fine Ti oxide powder A | $9 \times 10^9$ | 0.05 | 62 |

Cyan Toner Production Example B

Polyester resin obtained by condensation of

| Cyan Toner Production Example B | |
|---|---|
| Polyester resin obtained by condensation of propoxylated bisphenol and fumaric acid | 100 parts |
| Phthalocyanine pigment | 4 parts |
| Aluminum compound of di-tert-butylsalicylic acid | 4 parts |
| Low-molecular weight polypropylene | 4 parts |

The above materials were thoroughly premixed using a Henschel mixer, and then melt-kneaded using a twin-screw extruder. After cooled, the kneaded product was crushed using a hammer mill to give coarse particles of about 1 to 2 mm in diameter, which were then finely pulverized using a fine grinding mill of an air-jet system. The finely pulverized product thus obtained was further classified to produce a blue powder (cyan toner particles) with a weight average particle diameter of 5.8 μm. The cyan toner particles had shape factors of SF-1 of 143 and SF-2 of 156.

100 parts by weight of the above cyan toner particles and 1.5 parts of anatase type hydrophobic fine titanium oxide powder B with a weight average particle diameter of 0.05 μm, a hydrophobicity of 55%, a volume resistivity of $7\times10^9$ Ω·cm and a light transmittance of 70%, having been treated with 20 parts of $n—C_4H_9—Si—(OCH_3)_3$ based on 100 parts of hydrophilic anatase type fine titanium oxide powder in an aqueous medium, were mixed using a Henschel mixer to produce cyan toner B with a weight average particle diameter of 5.8 μm.

Yellow Toner, Magenta Toner and Black Toner

Example 25

The cyan toner A and the coated carrier A were blended in a toner concentration of 7% by weight to produce cyan two component type developer A.

Figure 8:
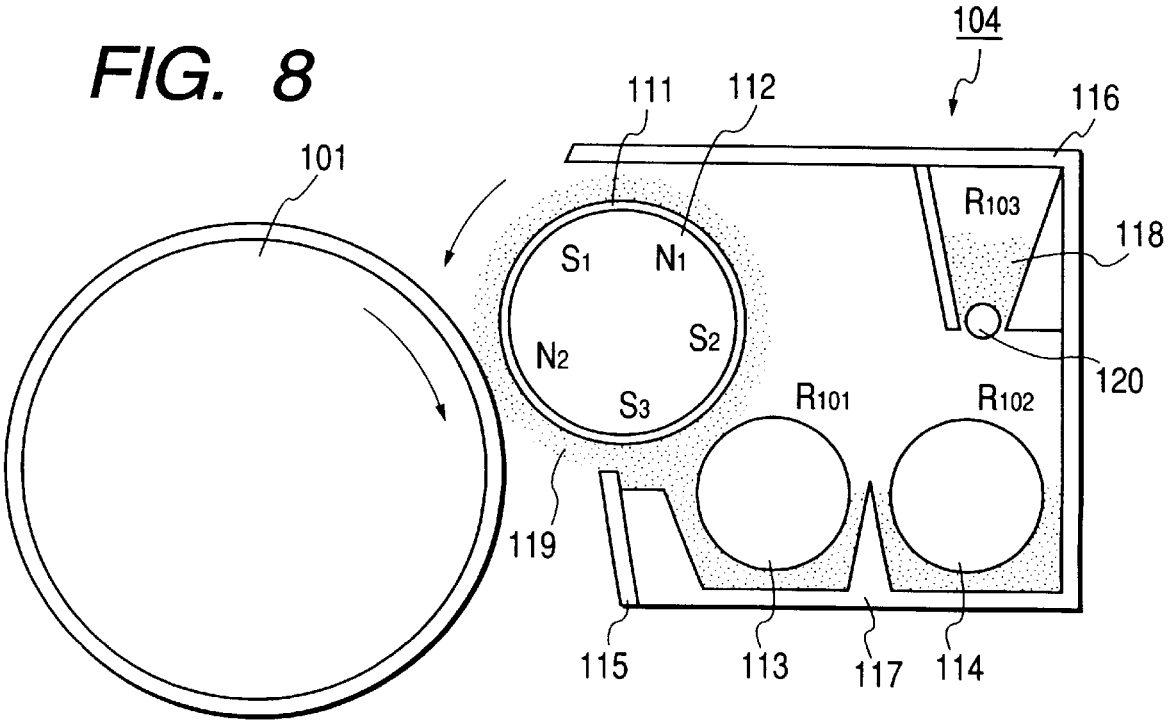
FIG. 8 schematically illustrates an example of an image forming apparatus that can carry out the image forming method of the present invention.

Next, the developing assembly of a commercially available copying machine GP55 (manufactured by CANON INC.) was modified as shown in FIG. 8. Its primary charging assembly was replaced with the magnetic-brush charging assembly shown in FIG. 5, where copper-zinc-iron ferrite with a 50% average particle diameter of 28 μm, a weight average particle diameter of 28.5 μm and a volume resistivity of $7\times10^6$ Ω·cm was used as magnetic particles. Its photosensitive member was replaced with the above photosensitive member A. The alternating electric field was changed to the development bias having the discontinuous AC electric field as shown in FIG. 3 was applied, and the development contrast was set at 250 V, and the potential contrast for inhibiting fogging (the difference between the potential at the non-image area of the latent image bearing member and the potential of the DC component of the development bias applied at the time of development) was set at 150 V. Without use of any cleaning unit, images were reproduced using the cyan two component type developer A in an environment of 23° C./65% RH while supplying the cyan toner A. Also, an original having an image area percentage of 10% was continuously copied in 10,000 sheets. Results obtained were as shown in Table 8.

As can be seen from Table 8, the above two component type developer can achieve a good image quality, causes little change in images due to continuous copying and also has no problem on toner scatter, showing very good results.

The relation of volume resistivities in the present Example 25 was as follows:

B ($7\times10^6$ Ω·cm)<C ($9\times10^9$ Ω·cm)<A ($5\times10^{12}$ Ω·cm)<D1 ($2\times10^{13}$ Ω·cm).

Comparative Example 10

Development was performed in the same manner as in Example 25 except that the coated carrier used therein was replaced with the coated carrier B, to obtain the results as shown in Table 8.

In the present Comparative Example, it is seen that the carrier having composition conventionally preferably used as the carrier of the developer was so small in its volume resistivity that the latent image potential on the photosensitive member was disordered at the time of development.

The relation of volume resistivities in the present Comparative Example 10 was as follows:

B ($7\times10^6$ Ω·cm)<D1 ($5\times10^8$ Ω·cm)<C ($9\times10^9$ Ω·cm)<A ($5\times10^{12}$ Ω·cm).

Comparative Example 11

Development was performed in the same manner as in Example 25 except that the photosensitive member used therein was replaced with the photosensitive member B, obtaining the results as shown in Table 8.

In the present Comparative Example, it is seen that the photosensitive member surface layer was so small in its volume resistivity that the latent image potential was diffused to have cause serious fog and disorder of solid images.

The relation of volume resistivities in the present Comparative Example 11 was as follows:

B ($7\times10^6$ Ω·cm)<A ($4\times10^{17}$ Ω·cm)<C ($9\times10^9$ Ω·cm)<D1 ($2\times10^{13}$ Ω·cm).

Comparative Example 12

Development was performed in the same manner as in Example 25 except that the photosensitive member used therein was replaced with the photosensitive member C, obtaining the results as shown in Table 8.

In the present Comparative Example, it is presumed that the photosensitive member surface layer was so large in its volume resistivity that it became difficult to control latent image potential and to control charge potential, resulting deterioration of image quality.

The relation of volume resistivities in the present Comparative Example 12 was as follows:

B ($7\times10^6$ Ω·cm)<C ($9\times10^9$ Ω·cm)<Dl ($2\times10^{13}$ Ω·cm)<A ($5\times10^{15}$ Ω·cm).

Example 26

Development was performed in the same manner as in Example 25 except that the coated carrier used therein was replaced with the coated carrier C, obtaining the results as shown in Table 8.

In the present Example, the results obtained were equivalent to, or better than, those obtained in Example 26.

The relation of volume resistivities in the present Example 26 was as follows:

B ($7\times10^6$ Ω·cm)<C ($9\times10^9$ Ω·cm)<A ($5\times10^{12}$ Ω·cm)<D1 ($8\times10^{13}$ Ω·cm).

Example 27

Development was performed in the same manner as in Example 25 except that the coated carrier used therein was replaced with the coated carrier D, obtaining the results as shown in Table 8.

In the present Example, it is seen that the solid image uniformity was slightly lowered, but good results were obtained. The lowering of solid image uniformity is presumed due to a high impedance of the carrier.

The relation of volume resistivities in the present Example 27 was as follows:

B ($7\times10^6$ Ω·cm)<C ($9\times10^9$ Ω·cm)<A ($5\times10^{12}$ Ω·cm)<D1 ($7\times10^{14}$ Ω·cm).

Comparative Example 13

Development was performed in the same manner as in Example 25 except that the coated carrier used therein was replaced with the coated carrier E, to obtain the results as shown in Table 8.

In the present Comparative Example, the carrier of the developer was so high in a volume resistivity that the image density was lowered, obtaining no satisfactory results.

The relation of volume resistivities in the present Comparative Example 13 was as follows:

B ($7\times10^6$ Ω·cm)<C ($9\times10^9$ Ω·cm)<A ($5\times10^{12}$ Ω·cm)<D1 ($2\times10^{15}$ Ω·cm).

Example 28

Development was performed in the same manner as in Example 25 except that, using the developing assembly shown in FIG. 9, the sleeve and the drum were rotated in the same direction as surface movement shown by arrows in FIG. 9. The results obtained are shown in Table 8.

In the present Example, the sleeve rotational direction was changed, where both of the image density and the solid image uniformity slightly were lowered, but good results were obtained.

Example 29

Development was performed in the same manner as in Example 25 except that the discontinuous alternating electric field as shown in FIG. 3 was replaced with the discontinuous alternating electric field as shown in FIG. 4, to obtain the results as shown in Table 8.

In the present Example, the period of the alternating electric field was changed, where fog slightly occurred, but good results were obtained.

Example 30

Development was performed in the same manner as in Example 25 except that the toner used therein was replaced with the toner B, obtaining the results as shown in Table 8.

In the present Example, the manner of producing the toner was changed, so that solid image uniformity was slightly lowered, but good results were obtained.

The relation of volume resistivities in the present Example 30 was as follows:

B ($7\times10^6$ Ω·cm)<C ($7\times10^9$ Ω·cm)<A ($5\times10^{12}$ Ω·cm)<D1 ($2\times10^{13}$ Ω·cm).

Example 31

Development was performed in the same manner as in Example 25 except that the coated carrier used therein was replaced with the coated carrier F, obtaining the results as shown in Table 8.

In the present Example, the coat material of the carrier was changed, so that fog and toner scatter slightly occurred, but good results were obtained.

The relation of volume resistivities in the present Example 31 was as follows:

B ($7\times10^6$ Ω·cm)<C ($9\times10^9$ Ω·cm)<A ($5\times10^{12}$ Ω·cm)<D1 ($7\times10^{13}$ Ω·cm).

The evaluation results of the above Examples 25 to 31 and Comparative Examples 10 to 13 are shown in Table 8.

TABLE 8

| | Carrier | Toner | Developing assembly | Photosensitive member | Alternating electric field | Image density | Fog | Solid*1 image uniformity | Toner*2 scatter |
|---|---|---|---|---|---|---|---|---|---|
| Example: | | | | | | | | | |
| 25 | A | A | FIG. 8 | A | FIG. 3 | 1.4–1.5 | 0.4–1.0% | 1 | 1 |
| Comparative Example: | | | | | | | | | |
| 10 | B | A | FIG. 8 | A | FIG. 3 | 0.9–1.2 | 1.6–3.5% | 2 | 2 |
| 11 | A | A | FIG. 8 | B | FIG. 3 | 1.1–1.3 | 1.5–2.3% | 3 | 1 |
| 12 | A | A | FIG. 8 | C | FIG. 3 | 1.0–1.4 | 0.9–2.8% | 3 | 1 |
| Example: | | | | | | | | | |
| 26 | C | A | FIG. 8 | A | FIG. 3 | 1.4–1.5 | 0.4–0.8% | 1 | 1 |
| 27 | D | A | FIG. 8 | A | FIG. 3 | 1.3–1.4 | 0.4–1.0% | 2 | 1 |
| Comparative Example: | | | | | | | | | |
| 13 | E | A | FIG. 8 | A | FIG. 3 | 1.0–1.2 | 0.6–1.5% | 3 | 2 |
| Example: | | | | | | | | | |
| 28 | A | A | FIG. 9 | A | FIG. 3 | 1.2–1.3 | 0.4–0.7% | 2 | 1 |
| 29 | A | A | FIG. 8 | A | FIG. 4 | 1.4–1.5 | 0.7–1.2% | 1 | 1 |
| 30 | A | B | FIG. 8 | A | FIG. 3 | 1.4–1.5 | 0.7–1.2% | 2 | 1 |
| 31 | F | A | FIG. 8 | A | FIG. 3 | 1.4–1.6 | 0.7–1.3% | 1 | 2 |

Example 32

In the same manner as in the cyan two component type developer used in Example 26, a yellow two component type developer, a magenta two component type developer and a black two component type developer were prepared using the yellow toner C, the magenta toner D and the black toner E, respectively. The four color two component type developers were set in the image forming apparatus constituted as shown in FIG. 6, and images were reproduced on 20,000 sheets. As a result, good full-color images were formed.

What is claimed is:

1. An image forming method comprising the steps of:

bringing a contact charging means into contact with a latent image bearing member for holding thereon an electrostatic latent image, to electrostatically charge the latent image bearing member;

forming an electrostatic latent image on the latent image bearing member thus charged; and using a developing assembly comprising a developing container holding therein a two component type developer having a toner with toner particles and a magnetic carrier and a developer carrying member for carrying thereon the two component type developer and transporting the developer to a developing zone, and developing in the developing zone the electrostatic latent image held on the latent image bearing member by the use of a toner of the two component type developer to form a toner image;

wherein;

said latent image bearing member has a surface layer having a volume resistivity A of from $10^8$ to $10^{15}$ Ω·cm;

said contact charging means comprises an assembly for electrostatically charging the latent image bearing member by applying a voltage to a charging member having a volume resistivity B of from $10^4$ to $10^9$ Ω·cm;

said toner has, as an external additive, fine particles having a volume resistivity C of from $10^7$ to $10^{11}$ Ω·cm; and said magnetic carrier has a volume resistivity D1 of from $10^9$ to $10^{15}$ Ω·cm;

said volume resistivity A of the surface layer of the latent image bearing member, said volume resistivity B of the contact charging means, said volume resistivity C of the external additive of the toner and said volume resistivity D1 of the magnetic carrier satisfying the following relationship:

B<C<A<D1.

2. The image forming method according to claim 1, wherein said fine particles contained as the external additive has a dispersed-particle diameter of from 0.03 μm to 0.4 μm.

3. The image forming method according to claim 1, wherein the surface layer of the latent image bearing member has a volume resistivity of from $10^{10}$ to $10^{13}$ Ω·cm, the charging member has a volume resistivity of from $10^7$ to less than $10^9$ Ω·cm, the fine particles of the external additive has a volume resistivity C of from $10^9$ to $10^{10}$ Ω·cm, and the magnetic carrier has a volume resistivity of from $10^{13}$ to $10^{15}$ Ω·cm.

4. The image forming method according to claim 1, which further comprises after the developing step a transfer step for transferring the toner image to a transfer-receiving medium, wherein (I) a latent image bearing member charging zone in the charging step, (II) an electrostatic latent image developing zone in the developing step and (III) a toner image transfer zone in the transfer step are successively positioned in the direction the latent image bearing member moves, where any cleaning means for removing, in contact with the latent image bearing member surface, the toner remaining on its surface after the transfer step is not provided between the transfer zone and the charging zone and between the charging zone and the developing zone, and the toner remaining on the latent image bearing member surface after the transfer step is removed by the developing assembly in the developing step at the same time.

5. The image forming method according to claim 1, wherein said external additive has at least an anatase type titanium oxide.

6. The image forming method according to claim 1, wherein said external additive has an anatase type titanium oxide having been surface-treated with at least one of a coupling agent and an oil.

7. The image forming method according to claim 1, wherein said external additive has an anatase type titanium oxide having been surface-treated with at least one of a silane coupling agent and a silicone oil.

8. The image forming method according to claim 1, wherein said external additive has surface-treated fine particles and has a hydrophobicity of from 20% to 80%.

9. The image forming method according to claim 1, wherein said charging member has conductive fiber or conductive magnetic particles.

10. The image forming method according to claim 1, wherein said contact charging means comprises a magnetic-brush charging assembly to which conductive magnetic particles are magnetically bound.

11. The image forming method according to claim 10, wherein said conductive magnetic particles have a weight average particle diameter of from 5 $\mu$m to 45 $\mu$m.

12. The image forming method according to claim 10, wherein said conductive magnetic particles have a weight average particle diameter smaller than the weight average particle diameter of said magnetic carrier.

13. The image forming method according to claim 1, wherein said magnetic carrier has ferrite particles constituted of a magnetic ferrite component represented by the following Formula (I):

$$(Fe_2O_3)_x(A)_y(B)_z \quad (I)$$

wherein A represents MgO, $Ag_2O$ or a mixture thereof; B represents $Li_2O$, MnO, CaO, SrO, $Al_2O_3$, $SiO_2$ or a mixture of any of these; and x, y and z each represent a weight ratio and fulfill the following conditions:

$$0.2 \leqq x \leqq 0.95;$$

$$0.005 \leqq y \leqq 0.3;$$

$$0 \leqq z \leqq 0.795; \text{ and}$$

$$x+y+z \leqq 1.$$

14. The image forming method according to claim 1, wherein said magnetic carrier has spherical carrier particles produced by a polymerization process in which $Fe_2O_3$, FeO, $Fe_3O_4$, $Al_2O_3$, $SiO_2$, CaO, SrO or MgO or a mixture of any of these or a ferrite compound is dispersed in a binder resin.

15. The image forming method according to claim 1, wherein said carrier is coated with at least one of a cross-linkable silicone resin and a fluorine-containg resin.

16. The image forming method according to claim 1, wherein said surface layer of said latent image bearing member has a volume resistivity of from $1\times10^8$ to $1\times10^{14}$ $\Omega$·cm, and said magnetic carrier has an impedance of from $9\times10^7$ to $9\times10^{10}$ $\Omega$·cm and a 50% average particle diameter of from 20 $\mu$m to 50 $\mu$m.

17. The image forming method according to claim 16, wherein said magnetic carrier is coated with a coat material comprising a cross-linkable silicone resin containing a curing agent represented by the following Formula (II).

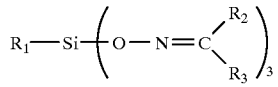

(II)

wherein $R_1$ represents a substituent selected from the group consisting of $CH_3$, $C_2H_5$ and

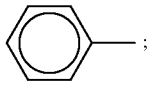

;

and $R_2$ and $R_3$ each represent a substituent selected from the group consisting of $CH_3$, $C_2H_5$ and derivatives thereof.

18. The image forming method according to claim 1, wherein the surface of said developer carrying member is moved in a counter direction to a movement direction of the surface of said latent image bearing member.

19. The image forming method according to claim 1, wherein said latent image bearing member has a cylindrical shape with a diameter d1 and said developer carrying member has a cylindrical shape with a diameter d2, and a ratio of the diameter d1 to the diameter d2, d1/d2, is from 1.0 to 3.0.

20. The image forming method according to claim 19, wherein the ratio of the diameter d1 to the diameter d2, d1/d2, is from 1.0 to 2.2.

21. The image forming method according to claim 1, wherein a development bias having a discontinuous alternating voltage is applied to said developer carrying member at the time of development performed by said developing assembly.

22. The image forming method according to claim 1, wherein said toner particles have toner particles produced by a polymerization process.

23. The image forming method according to claim 1, wherein said toner particles have shape factors SF-1 of from 100 to 150 and SF-2 of from 100 to 140.

24. An image forming method comprising the steps of:

bringing a contact charging means into contact with a latent image bearing member for holding thereon an electrostatic latent image, to electrostatically charging the latent image bearing member;

forming an electrostatic latent image on the latent image bearing member thus charged; and using a developing assembly comprising a developing container holding therein a one component type developer having toner particles and a developer carrying member for carrying thereon the one component type developer held in the developing container and transporting the developer to a developing zone, and developing in the developing zone the electrostatic latent image held on the latent image bearing member by bringing at least a developer layer formed of the one component type developer carried on the developer carrying member into contact with the surface of the latent image bearing member, to form a developer image;

wherein;

said latent image bearing member has a surface layer having a volume resistivity A of from $10^8$ to $10^{15}$ $\Omega$·cm;

said contact charging means comprises an assembly for electrostatically charging the latent image bearing member by applying a voltage to a charging member having a volume resistivity B of from $10^4$ to $10^9$ Ω·cm;

said one component type developer has, as an external additive, fine particles having a volume resistivity C of from $10^7$ to $10^{11}$ Ω·cm; and said developer carrying member has a surface layer having a volume resistivity D2 of from $10^9$ to $10^{15}$ Ω·cm;

said volume resistivity A of the surface layer of the latent image bearing member, said volume resistivity B of the contact charging means, said volume resistivity C of the external additive of the one component type developer and said volume resistivity D2 of the surface layer of the developer carrying member satisfying the following relationship:

$$B<C<A<D2.$$

25. The image forming method according to claim 24, wherein said fine particles contained as the external additive has a dispersed-particle diameter of from 0.03 μm to 0.4 μm.

26. The image forming method according to claim 24, wherein the surface layer of the latent image bearing member has a volume resistivity of from $10^{10}$ to $10^{13}$ Ω·cm, the charging member has a volume resistivity of from $10^7$ to less than $10^9$ Ω·cm, the fine particles of the external additive has a volume resistivity C of from $10^9$ to $10^{10}$ Ω·cm, and the surface layer of the developer carrying member has a volume resistivity of from $10^{13}$ to $10^{15}$ Ω·cm.

27. The image forming method according to claim 24, which further comprises after the developing step a transfer step for transferring the developer image to a transfer-receiving medium, and wherein (I) a latent image bearing member charging zone in the charging step, (II) an electrostatic latent image developing zone in the developing-step and (III) a developer image transfer zone in the transfer step are successively positioned in the direction the latent image bearing member moves, where any cleaning means for removing, in contact with the latent image bearing member surface, the one component type developer remaining on its surface after the transfer step is not provided between the transfer zone and the charging zone and between the charging zone and the developing zone, and the one component type developer remaining on the latent image bearing member surface after the transfer step is removed by the developing assembly in the developing step at the same time.

28. The image forming method according to claim 24, wherein said external additive has at least an anatase type titanium oxide.

29. The image forming method according to claim 24, wherein said external additive has an anatase type titanium oxide having been surface-treated with at least one of a coupling agent and an oil.

30. The image forming method according to claim 24, wherein said external additive has an anatase type titanium oxide having been surface-treated with at least one of a silane coupling agent and a silicone oil.

31. The image forming method according to claim 24, wherein said external additive has surface-treated fine particles and has a hydrophobicity of from 20% to 80%.

32. The image forming method according to claim 24, wherein said charging member has conductive fiber or conductive magnetic particles.

33. The image forming method according to claim 24, wherein said contact charging means comprises a magnetic-brush charging assembly to which conductive magnetic particles are magnetically bound.

34. The image forming method according to claim 33, wherein said conductive magnetic particles have a weight average particle diameter of from 5 μm to 45 μm.

35. The image forming method according to claim 24, wherein said toner particles have toner particles produced by a polymerization process.

36. The image forming method according to claim 24, wherein said toner particles have shape factors SF-1 of from 100 to 150 and SF-2 of from 100 to 140.

* * * * *

UNITED STATES PATENT AND TRADEMARK OFFICE

CERTIFICATE OF CORRECTION

PATENT NO. : 5,994,019
DATED : November 30, 1999
INVENTOR(S) : Kenji Okado et al.

It is certified that error appears in the above-identified patent and that said Letters Patent is hereby corrected as shown below:

Title Page:
Insert --[*] Notice: This patent issued on a continued prosecution application filed under 37 CFR 1.53(d), and is subject to the twenty year patent term provisions of 35 U.S.C. 154(a)(2).--

[57] Abstract:
Line 12, "contains" should read --contain--.

Column 6:
Line 42, "has" should be deleted.

Column 7:
Line 9, "powder-)" should read --powder)--.

Column 8:
Line 14, "as-exemplified" should read --as exemplified--.

Column 10:
Line 27, "than-the" should read --than the--.

Column 11:
Line 7, "cceleratingly" should read --acceleratingly--.

Column 15:
Line 45, "becomes" should read --become--.

Column 22:
Line 67, is-that" should read --is that--.

Column 24:
Line 13, "stationaily" should read --stationarily--.

Column 26:
Line 44, "its-part" should read --its part--;
Line 64, "blow" should read --below--.

UNITED STATES PATENT AND TRADEMARK OFFICE

CERTIFICATE OF CORRECTION

PATENT NO. : 5,994,019
DATED : November 30, 1999
INVENTOR(S) : Kenji Okado et al.

It is certified that error appears in the above-identified patent and that said Letters Patent is hereby corrected as shown below:

Column 28:
Line 38, "other" should read -- the other--.

Column 29:
Line 64, "unit" should read --units--.

Column 34:
Line 55, "measureing" should read --measuring--;
Line 56, "Hullet" should read --Hewlett--.

Column 36:
Line 22, "was" should read --were--;
Line 40-45, "

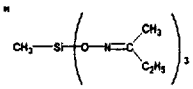

(2)"

Should read --

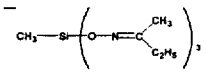

(2)--

$(CH_3)_2N-C_3H_6-Si-(OCH_3)_3$ (11)
$n\cdot C_3H_7-Si-(OCH_3)_3$ (18)

Column 38:
Line 13, "This" should read --These--.

Column 39:
Line 25, "moires" should read --moirés--.

Column 53:
Line 60, "kvpp." should read --kVpp.--.

Column 57:
Line 24, "moires" should read --moirés--.

Column 63:
Line 64, "wherein;" should read --wherein--.

UNITED STATES PATENT AND TRADEMARK OFFICE

CERTIFICATE OF CORRECTION

PATENT NO. : 5,994,019
DATED : November 30, 1999
INVENTOR(S) : Kenji Okado et al.

It is certified that error appears in the above-identified patent and that said Letters Patent is hereby corrected as shown below:

Column 64:
Line 3, "member (2nd occurrence) should read --member which is in contact with the latent image bearing member, the charging means--;
Line 5, "Ω·cm;" should read -- Ω·cm at the part which is in contact with the latent image bearing member;--;
Line 47, "has" should read --have--;
Line 52, "has" should read --have--.

Column 65:
Line 24, "to which" should read --having--;
Line 25, "are magnetically bound" should read --which serves as the assembly for electrostatically charging the latent image bearing member, and a non-magnetic sleeve holding therein a magnet for magnetically binding the conductive magnet particles.--;
Line 50, "$0 \leq Z \leq 0.795$;" should read --$0 < Z \leq 0.795$;--;
Line 60, "fluorine-containg" should read --flouorine-containing--.

Column 66:
Line 64, "wherein;" should read --wherein--.

Column 67:
Line 3, "member" (2nd occurrence) should read --member which is in contact with the latent image bearing member, the charging means--;
Line 5 "Ω·cm;" should read --Ω·cm at the part which is in contact with the latent image bearing member;--;
Line 23, "has" should read --have--;
Line 28, "has" should read --have--;
Line 37, "developing-step" should read --delveloping step--.

UNITED STATES PATENT AND TRADEMARK OFFICE

CERTIFICATE OF CORRECTION

PATENT NO. : 5,994,019
DATED : November 30, 1999
INVENTOR(S) : Kenji Okado et al.

It is certified that error appears in the above-identified patent and that said Letters Patent is hereby corrected as shown below:

Column 68:
Line 28, "to which" should read --having--;
Line 29, "are magnetically bound" should read --which serves as the assembly for electrostatically charging the latent image bearing member, and a non-magnetic sleeve holding therein a magnet for magnetically binding the conductive magnetic particles.--

Signed and Sealed this

Twenty first Day of August, 2001

Nicholas P. Godici

*Attest:*

*Attesting Officer*

NICHOLAS P. GODICI
*Acting Director of the United States Patent and Trademark Office*